US012742323B2

(12) United States Patent
Frein

(10) Patent No.: US 12,742,323 B2
(45) Date of Patent: Sep. 22, 2026

(54) FRAMING ASSEMBLY

(71) Applicant: Thomas G. Frein, Midway, AR (US)

(72) Inventor: Thomas G. Frein, Midway, AR (US)

( * ) Notice: Subject to any disclaimer, the term of this patent is extended or adjusted under 35 U.S.C. 154(b) by 0 days.

(21) Appl. No.: 18/788,102

(22) Filed: Jul. 29, 2024

(65) Prior Publication Data

US 2024/0384530 A1 Nov. 21, 2024

Related U.S. Application Data

(63) Continuation-in-part of application No. 17/378,788, filed on Jul. 19, 2021, now Pat. No. 12,065,830, and a continuation-in-part of application No. 29/750,325, filed on Sep. 13, 2020, now Pat. No. Des. 925,775, and a continuation-in-part of application No. 17/019,275, filed on Sep. 13, 2020, now Pat. No. 11,072,927.

(60) Provisional application No. 63/158,997, filed on Mar. 10, 2021, provisional application No. 62/993,844, filed on Mar. 24, 2020, provisional application No. 62/899,949, filed on Sep. 13, 2019.

(51) Int. Cl.
*E04B 7/02* (2006.01)

(52) U.S. Cl.
CPC ..... *E04B 7/022* (2013.01)

(58) Field of Classification Search
CPC ... E04B 7/024; E04B 9/02; E04B 9/06; E04C 2/38; E04D 13/1612
USPC ..... 52/302.3
See application file for complete search history.

(56) References Cited

U.S. PATENT DOCUMENTS 3,343,474 A * 9/1967 Sohda ..... F24F 7/04 52/302.3
3,368,473 A * 2/1968 Sohda ..... E04B 1/7612 52/783.17
4,635,419 A * 1/1987 Forrest ..... E04D 13/172 454/260
4,642,958 A * 2/1987 Pewitt ..... E04D 13/17 52/302.3
5,487,247 A * 1/1996 Pigg ..... F24S 20/67 52/302.1
5,577,356 A * 11/1996 Hubbard ..... E04B 2/705 52/295
5,803,805 A * 9/1998 Sells ..... E04D 13/174 454/364
5,890,322 A * 4/1999 Fears ..... F24F 7/025 52/302.1
5,950,389 A 9/1999 Porter
6,012,626 A 1/2000 Irvin
6,015,343 A * 1/2000 Castillo ..... F24F 7/02 454/365
6,481,172 B1 11/2002 Porter
6,491,579 B1 * 12/2002 O'Hagin ..... E04D 1/30 454/339
7,024,829 B2 4/2006 Sharp et al.
(Continued)

FOREIGN PATENT DOCUMENTS

EP 2186961 5/2010

*Primary Examiner* — James J Buckle, Jr.
(74) *Attorney, Agent, or Firm* — Rashauna Norment

(57) ABSTRACT

A framing assembly has a plurality of T-rafter splines for use as ridge beams for roofing construction, wall splines for wall construction, and floor beams for flooring construction of a building. Each T-rafter has a support member flanked by two flanges, with the flanges supporting the weight of purlins, rafters, ridge brace, walls, or floor joists.

20 Claims, 47 Drawing Sheets

(56) References Cited

U.S. PATENT DOCUMENTS

| | | | | |
|---|---|---|---|---|
| 8,689,511 | B2 | 4/2014 | Fleming, III | |
| 8,915,022 | B2 * | 12/2014 | Klink | F24F 7/025 52/302.1 |
| 10,024,057 | B2 | 7/2018 | Gibson | |
| 11,072,927 | B1 * | 7/2021 | Frein | E04C 2/38 |
| 2007/0131308 | A1 | 6/2007 | Martin | |
| 2008/0236058 | A1 * | 10/2008 | Antonie | E04D 13/17 52/302.1 |
| 2009/0293395 | A1 | 12/2009 | Porter | |
| 2012/0045983 | A1 | 2/2012 | Eskola, III | |
| 2017/0058516 | A1 | 3/2017 | Liberman et al. | |
| 2023/0106808 | A1 * | 4/2023 | Achard | G01C 15/006 33/1 G |

* cited by examiner

FRAMING ASSEMBLY

(B) CROSS-REFERENCE TO RELATED APPLICATIONS

The present utility patent application is a continuation-in-part of allowed, co-pending U.S. patent application Ser. No. 17/378,788, filed Jul. 19, 2021, which claims the benefit of and priority to U.S. Provisional Patent Application No. 63/158,997, filed on Mar. 10, 2021, and is a continuation-in-part of U.S. patent application Ser. No. 29/750,325, filed on Sep. 13, 2020 which issued as U.S. Design Pat. No. D925,775 on Jul. 20, 2021, and is a continuation-in-part of U.S. patent application Ser. No. 17/019,275, filed Sep. 13, 2020, which issued as U.S. Pat. No. 11,072,927 on Jul. 27, 2021, and which claims the benefit of and priority to U.S. Provisional Patent Application No. 62/899,949, filed on Sep. 13, 2019, and U.S. Provisional Patent Application No. 62/993,844, filed on Mar. 24, 2020, each of the foregoing applications are incorporated herein by reference in its entirety.

(C) FEDERALLY SPONSORED RESEARCH AND DEVELOPMENT

Not applicable.

(D) BACKGROUND OF THE INVENTION

1. Field of the Invention

The present invention generally relates to a framing assembly for constructing at least part of a frame of a building structure. More particularly, the invention is a framing assembly comprising at least one T-rafter spline for use when not using structural insulated panels (SIPs) during construction of a building.

2. Description of Arguably Related Art Including Information Disclosed for 37 CFR 1.97 and 1.98

Conventional framing methods and framing assemblies are used for constructing a building including, but are not limited to, stick framing and timber framing. With timber framing, heavy timber beams or post and beam framing alternatives form the building structure. Timber frame buildings may be generally assembled on the ground, then raised into position and secured. Wall studs or vertical elements may generally extend the full height of the timber frame structure. Rafter beams (or ridge support beams) may generally extend at least part of the length of the timber frame structure to form the roof.

Structural insulated panels (SIPs) are often used with timber framing, leaving the entire frame visible. Depending on the materials used for the wall studs and roof beams, raising the frame may require using cranes to lift the wall sections and roof sections. Examples of building structures are houses and other residential structure; however, other building structures are contemplated. Some interior building décor features have exposed ceiling beams and/or exposed upstanding wall columns. Depending on the building construction, the exposed beams are either part of the framing itself or are added later in the construction process. Leaving exposed framing is a distinct feature of a timber frame building.

The ceiling panels and wall panels may be either sheetrock, plywood, or SIPs. SIPs are preferred with timber frame buildings. SIPs generally have two layers (or skins) sandwiching a recessed core. The core may be a foam core. The two SIP layers may be oriented strand board (OSB), sheet metal, plywood, or any other material suitable for the purpose. The SIPs are coupled together with lumber studs, rafters, or splines, then secured with nail or screw fasteners, and connected to the floor with a sill plate. The structure of these splines, lumber studs, or lumber beams remains deficient for the desired combination of supporting the SIPs, bearing the wall load and the roof load, and creating an exterior protrusion resembling an exposed beam or an exposed column. See U.S. Pat. No. 5,950,389 (Porter), U.S. Patent Application Publication No. 2007/01311308 (Martin), and U.S. Patent Application Publication No. 2017/0058516 (Liberman et al.).

Problems with conventional timber frame structures or exposed beam structures using timber include, but are not limited to, lumber shrinkage, warpage, and checking. Other problems include the increased cost for materials and labor, and the need for cranes to assemble the building. Problems with using SIPs include lack of exposed beams without compromising the strength of the SIPs.

Another disadvantage for using SIPs with timber frame construction is maintaining moisture control and air quality due to inadequate air circulation or ventilation within the building. The vapor buoyancy effect causes moist air to rise and to remain stagnate in the highest part of the enclosed building. If adequate air circulation is not addressed, the structure will become vulnerable to mold growth and wood rot. Ridge support beams are often exposed to continued moisture and poor air circulation, both of which further contributes to ridge rot. Ridge rot is one of the leading failures in SIP construction, especially in cold, wet climates, for example, on the Alaskan western coast. Furthermore, spacing between assembled SIPs joints and other roof structural elements can also lead to air leakage between the assembled SIP joints. Air leakage allows moist air to rise toward the spacing between assembled SIP joints. This moisture air often collects on the exterior outer skin of the SIPs where the moisture air then cools and vapor condenses on the underside of the outer skin of the SIPs. The trapped condensed moisture leads to decay and mold growth in the SIPs.

Yet another problem with SIP construction involves the internal skeletal structure of the timber frame building. In general, a timber frame building utilizes a single, heavy ridge structural beam, rafter beam, or ridge support beams upon which a plurality of SIPs and rafter splines are mounted. The ridge support beam supports the building load and the weight of the roof, including the weight and impact from snow, wind, and other environmental impact, for example, earthquakes.

None of the identified patent references discloses, teaches, or suggests the combination of components and structural arrangement of the claimed invention.

A need exists for a framing assembly having a plurality of rafter splines and a plurality of extended rafter splines, each preferably made from manufactured or engineered wood products, a plurality of modified structural insulated panels, and at least one surface attachment member when constructing a building to create the appearance of exposed beams without using heavy timber beams.

A need exists for a framing assembly used to construct a timber frame-style building without the expense and cost of using heavy construction equipment, namely, a crane.

A need exists for a framing assembly that uses a configured structural composite lumber and dimensional lumber, along with modified structural insulated panels, to construct a dimensionally stable, strong, and environmentally friendly building having the appearance of exposed beams.

A need exists for a framing assembly having at least one rafter vent assembly comprising at least one brace member and a connecting member, with the connecting member having a plurality of vent tubes for SIP construction that aids in air circulation to vent or outtake moist stale air into the exterior environment, and that provides intake of drier fresh air that can be metered and controlled while not affecting interior temperature within the building structure.

A need exists for a framing assembly to form part of a building skeletal structure, the framing assembly comprising a plurality of rafter vent assemblies, each rafter vent assembly comprising two brace members, a connecting member having a plurality of vent tubes for supplemental ventilation; a plurality of panels; a plurality of rafter splines; and a ridge support beam member.

A need exists for a framing assembly that uses one or more T-rafter splines when constructing a building, wherein each T-rafter spline may be used either as a ridge beam when constructing the roof, as a floor beam when floor joints cannot span the entire width of a building, as a wall spline or vertical column that provides structural support and visual appeal as at least a partially exposed timber column, or as a perimeter beam.

(E) SUMMARY OF THE INVENTION

Due to the described disadvantages inherent in the known types of framing methods for constructing a timber frame building structure or a structure having exposed beams, one embodiment of the present invention provides a new and improved a framing assembly for constructing and framing a building structure having exposed beams, wherein the framing assembly comprises (includes or has) a plurality of rafter splines, a plurality of extended rafter splines, a plurality of panels, and at least one surface attachment member that are used to construct the frame of a building structure to have exposed interior beams. The framing assembly may further include a plurality of wall splines, which once selectively installed between two of the plurality of panels, forms an exposed upstanding column. One or more of the wall splines and one or more of the rafter splines may be used as an alternative to using conventional wall studs or conventional roof rafters when a respective exposed column, an exposed rafter beam, or an exposed column is desired. When the modified wall spline or the modified rafter spline is not used between two particular structural insulated panels (SIPs), conventional SIPs or a SIP having at least one conventional side may be used with a conventional wall stud or rafter beam.

Each of the spline types preferably comprises manufactured wood products rather than heavy lumber. Each spline is a support member. Each spline may further have a pair of flanges that abut against and sandwich a lower portion of the lateral sides of the support member to form a T-shaped wall column or a T-shaped rafter beam. The plurality of panels forms wall panel sections, ceiling panel sections, exterior roof panels, and exterior wall panels. These panels are preferably modified SIPs. The splines are selectively installed with modified SIPs to couple the modified SIPs together, with a lower portion of each spline protruding outwardly from the joined SIPs as an exposed beam or an exposed column.

The overall frame may be built at the construction site or pre-built in sections offsite then delivered to the construction site for final assembly. The top of each spline flange is essentially a ledge upon which the inner layer (or skin) of the modified SIP rests. Each conventional SIP having an outer layer (or skin), a recessed core, and an inner layer (or skin) is modified to accommodate the spline alternative. The user may selectively use the splines between each coupled modified SIP or may alternate with using conventional splines and conventional SIPs. The surface attachment members are surface materials that may be selectively attached or applied to a lower portion of each spline as a decorative feature of wood beams or painted beams.

In one embodiment, a framing assembly for constructing the frame of a building structure, the framing assembly comprising (including or having):

(a) a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member forming a lower portion of the rafter spline and with the upper portion of the support member forming the upper portion of the rafter spline; and (b) a plurality of panels, each of the plurality of panels having two opposing sides, with at least one of the two sides having an overhang;

(c) wherein at least one of the plurality of rafter splines is sandwiched between one of the two sides of two of the respective panels, with at least a portion of the upper portion of the rafter spline positioned underneath each panel overhang, and with the assembly of each of the plurality of rafter splines and the plurality of panels selectively forming ceiling sections or roof sections of the building structure; and (d) wherein the upper portion of each rafter spline supports the overhang of two of the plurality of panels, with the lower portion of each rafter spline forming an exposed beam.

The framing assembly not only uses splines to join the modified SIPs together, but also supports the modified SIPs and the roof framework. The splines are mounted between the connected modified SIPs, with the lower, distal portions of the splines extending beyond the SIPs, forming exposed beams or exposed upstanding columns. The splines also provide additional structural strength to the modified SIP outer panels, allowing these panels to be used in longer intervals without using additional support elements, such as braces.

In yet another embodiment, a framing assembly is provided for constructing and framing a building structure that has exposed rafter beams while providing supplemental ventilation and additional structural support. Here, the invention is a framing assembly comprising (including or having) at least one rafter vent assembly which may be an interior rafter vent assembly, an exterior rafter vent assembly, or both. Each of the plurality of vent tubes in both versions of the rafter vent assembly is upstanding from the connecting plate. The plurality of vent tubes provides for air circulation.

The interior rafter vent assembly has: (1) at least one brace member comprising a brace flange, with the brace flange further defining at least one bore therethrough and with the brace flange extending from the brace member at an angle; and (2) a connecting member comprising two end plates, a connecting plate, and a plurality of vent tubes, with the connecting plate having two side members configured to form a peak, with the connecting plate affixed between the two end plates, and with the connecting member being coupled to the underside, bottom, or outer-side inner skin of two abutting roof panels (SIPs) which form an apex gap or spacing in the roof line. The brace flange may define at least one bore. The at least one bore of the brace flange is selectively aligned over and coupled to an individual vent tube of the plurality of vent tubes to couple the roof SIP to the connecting member. The connecting member may be coupled onto a ridge beam support member. The connecting member is coupled or otherwise attached between two rafter splines of the building frame for supplemental ventilation and moisture control. The interior connecting member is visible from within the building structure.

The exterior or external rafter vent assembly has an exterior or external connecting member comprising a connecting plate and a plurality of vent tubes, with the connecting member being coupled directly to or over the exterior, top, or outer-side outer skin of two abutting roof panels (SIPs) which form an apex gap or spacing in the roof line. This version does not have the two end plates affixed to the opposing ends of the connecting plate. This version is beneficial at least for aesthetic purposes to avoid having the exposed underside of the connecting member shown in the interior of the building. During installation, the connecting member is lowered into place over the roof SIPs. The vent tubes still are capable of venting moist air from within the building to the external environment due to the gap between the joined SIPS. The connecting member is attached to the SIPs using fasteners, preferably screws. A brace member is not used for the external connecting member arrangement because the external connecting member itself acts as a flange.

A plurality of the rafter vent assemblies structurally supports a plurality of panels or SIPs in addition to providing intake and outtake air flow. Each rafter vent assembly prevents accumulation of moist stagnate air from the ridge area of the structure. The brace member attaches to the SIP so that the assembled panel-brace member can be attached to the connecting member. When the connecting member is an interior connecting member, the end plates of the interior connecting member attach the rafter vent assembly to the building structure at the rafter splines. With this invention, intake of drier fresh air can be metered and controlled while not affecting interior temperature within the building structure. The rafter vent assembly may also provide for aesthetic ornamental features of a heavy timber frame structure.

The framing assembly of the rafter vent assembly embodiment may further include a plurality of panels, a plurality of rafter splines, a plurality of wall splines, a plurality of truss plates, a plurality of mend plates (not shown), and/or a bent for forming the building frame structure. The modified SIPs and the modified extended rafter splines from the other embodiments are preferred. The modified plurality of wall splines from the other embodiments are preferred. Opposing rafter splines are abutted against each other and coupled together with the end plates affixed to the interior connecting member or with the independent end plates in the external connecting member embodiment. The opposing rafter splines are essentially a first rafter spline from a first side of the structure abutting a second rafter spline from a second side of the structure. The plurality of assembled opposing rafter splines are spaced along the length of the rafter ridge beam, forming rafter spline sections. A plurality of wall splines is coupled to each of the corresponding plurality of rafter splines with the mend plates. The bottom of the wall splines are placed on top of a bottom plate when erecting a framing bent, particularly for a timber frame construction.

In another embodiment, the framing assembly includes at least one T-rafter which is a modified rafter spline used when building with dimensional lumber rather than SIPs. One or more T-rafters may also be used as wall splines or for the floor frame.

It is an object of the invention to provide a framing assembly having a plurality of rafter splines and a plurality of extended rafter splines, each made from manufactured or engineered wood products, a plurality of structural insulated panels, and at least one surface attachment member when constructing a building to create the appearance of exposed beams without using heavy timber beams.

It is an object of the invention to provide a framing assembly used to construct a timber frame-style building without the expense and cost of using heavy construction equipment, namely, a crane.

It is yet another object of the invention to provide a framing assembly that uses a configured structural composite lumber and dimensional lumber, along with structural insulated panels, to construct a dimensionally stable, strong, and environmentally friendly building having the appearance of exposed beams.

It is an object of this invention to provide a framing assembly that has at least one rafter vent assembly comprising at least one brace member and a connecting member, with the rafter vent assembly providing supplemental ventilation, aiding in air circulation to vent moist stale air into the environment, minimizing ridge rot, providing intake of drier fresh air that can be metered and controlled while not affecting the interior temperature within the building structure, and supporting the building structure.

It is another object of the invention to provide a framing assembly that uses one or more T-rafter splines when constructing a building, wherein each T-rafter spline may be used either as a ridge beam when constructing the roof, as a floor beam when floor joints cannot span the entire width of a building, as a wall spline or vertical column that provides structural support and visual appeal as at least a partially exposed timber column, or as a perimeter beam These and other aspects, objects, embodiments, and advantages of the invention will become apparent from the accompanying drawing figures and the following detailed description of the preferred embodiments of the invention.

(F) BRIEF DESCRIPTION OF THE SEVERAL VIEWS OF THE DRAWING

The invention may be more readily described by reference to the accompanying drawing figures and the following description of the drawing figures. The reference numbers apply to each embodiment of the invention. In the drawing, FIG. 1 is a perspective view of a rafter spline or a wall spline, showing part of a framing assembly;

(G) DETAILED DESCRIPTION OF THE INVENTION

The present invention, preferred embodiments of the invention, and the accompanying drawing figures as described herein should not be construed as limited to the illustrated drawing. Rather, the illustrated embodiment(s) are detailed to provide a thorough disclosure suitable to convey the scope of the invention to those skilled in the art. For the sake of simplicity, the conjunctive "and" may also be taken to include the disjunctive "or" and vice versa, whenever necessary to give the claims of this patent application the broadest interpretation and construction possible.

Figure 51:
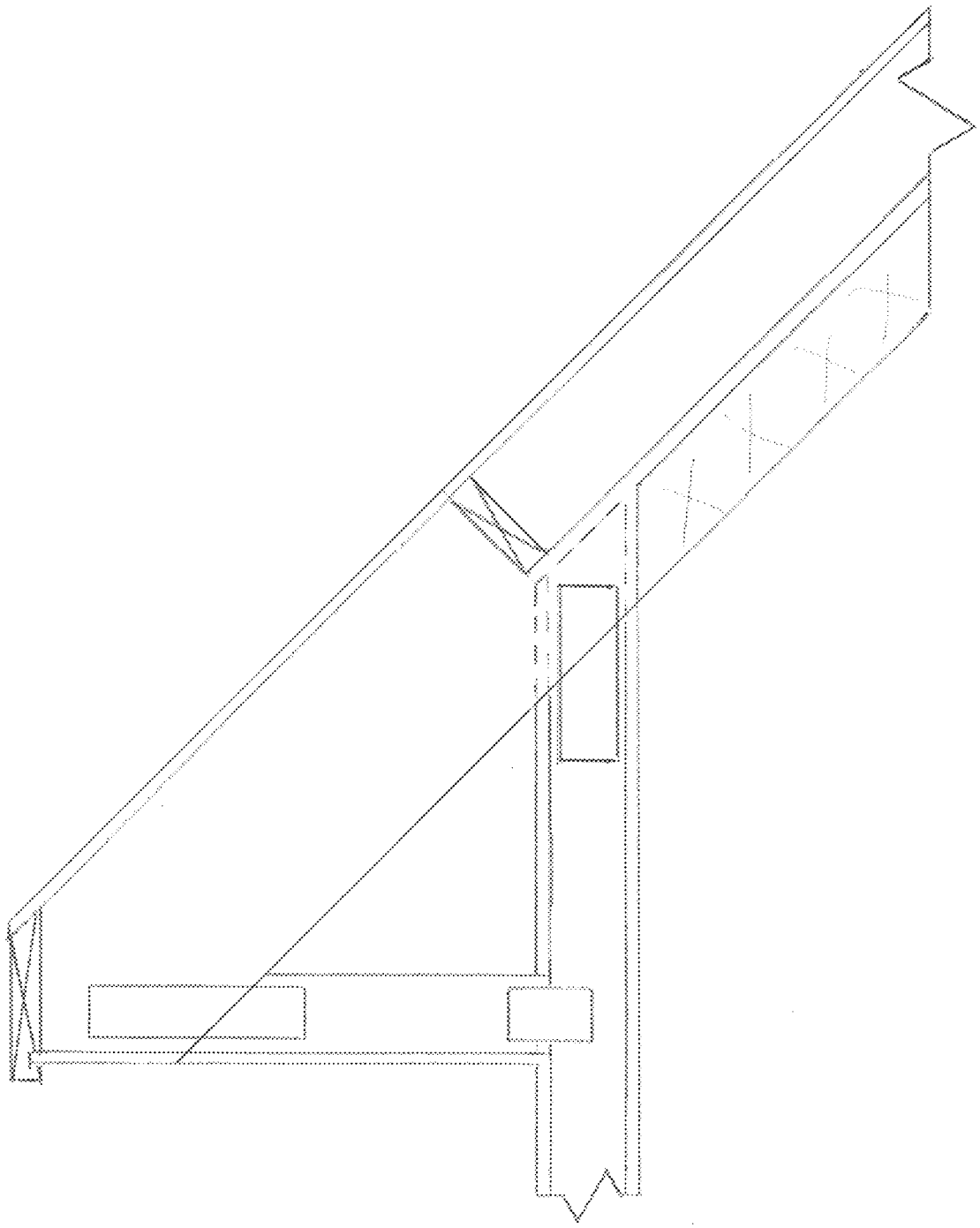
FIG. 51 is a side elevation view of another embodiment of the framing assembly.
Figure 52:
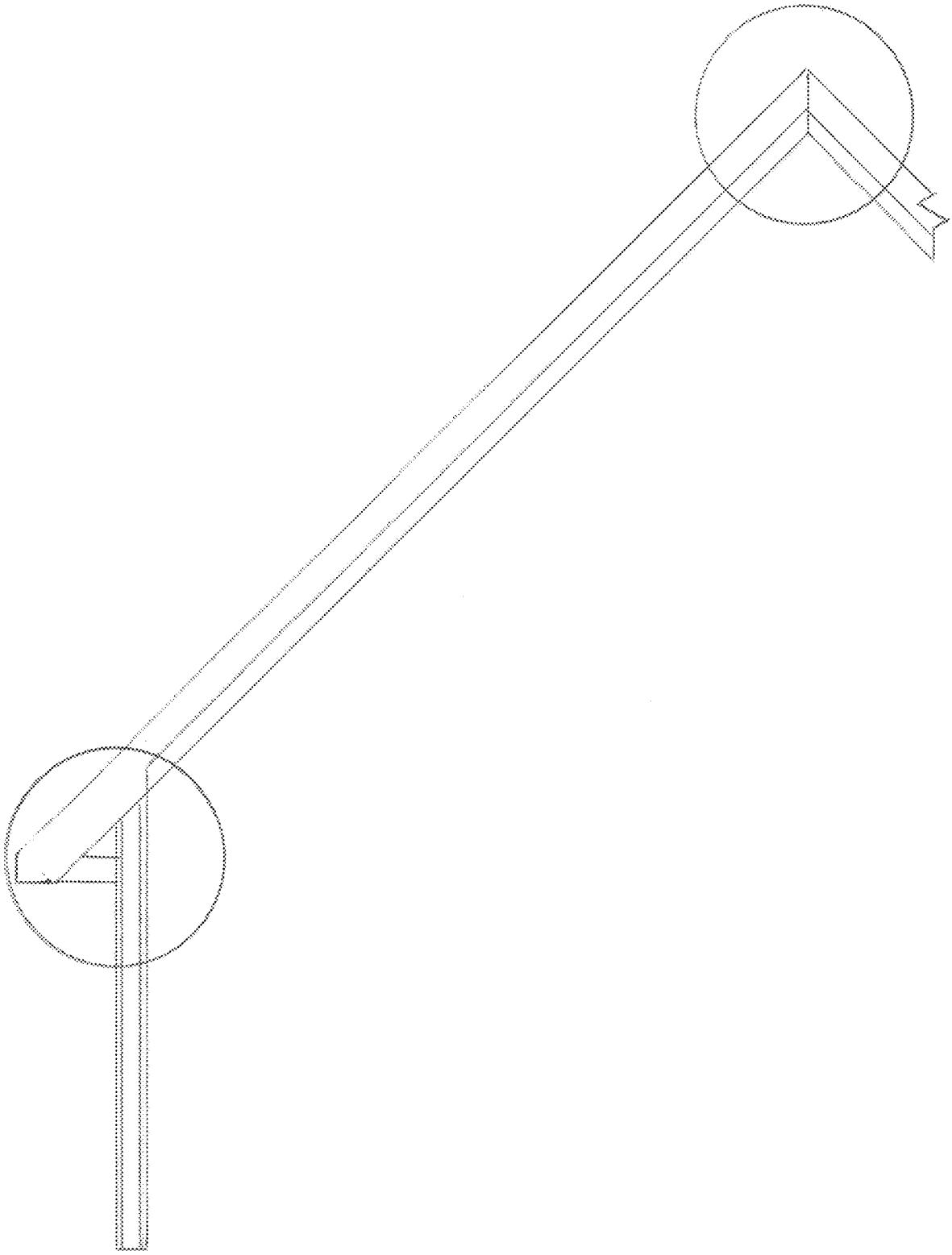
FIG. 52 is another side elevation view of the framing assembly.

Referring more particularly to the drawing by characters of reference, FIGS. 1-30 depict one embodiment of the invention for a framing assembly having modified SIPs, rafter splines, and wall splines. FIGS. 31-50 depict another embodiment of the invention for a framing assembly having at least one rafter vent assembly that cooperates with one or more SIPs and rafters. FIGS. 51 and 52 depict yet another embodiment of the invention for a framing assembly having a modified soffit. FIGS. 53-56 depict another embodiment of the invention for a framing assembly having at least one T-rafter spline used as at least one of the main supports for construction, namely, as a T-rafter, as a wall spline, or as a floor beam.

More particularly for FIGS. 1-30, the invention is a framing assembly for constructing the frame of a building structure having at least one exposed beam, the framing assembly comprising:

1. a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member a lower portion of the rafter spline and with the upper portion of the support member forming the upper portion of the rafter spline;
2. a plurality of extended rafter splines, each of the plurality of extended rafter splines comprising an extended rafter support member and a pair of flanges,
   a. the extended rafter support member having a lower portion, an upper portion, a first end separated from a second end by a longitudinal body, with the longitudinal body of the extended rafter support member having a length longer than a length of each of a pair of flanges and extending beyond a roof of the building structure as a rafter tail to form part of an eave; and b. the pair of rafter flanges, with the extended rafter support member having a depth or height more than a depth or height of each of the pair of flanges, with each of the pair of flanges abutting and flanking the lower portion of the extended rafter support member forming a lower portion of the extended rafter spline, and with the upper portion of the extended rafter support member forming an upper portion of the extended rafter spline;

3. a plurality of structural insulated panels, each structural insulated panel comprising an outer skin having a top, a bottom, and at least one side; a core within the structural insulated panel, the core having a top, a bottom, an end and at least one side; and an inner skin having a top, a bottom, an end, and at least one side, with the outer skin, the core, and the inner skin mounted together as a layer of the structural insulated panel further, with the structural insulated panel further comprising at least one side of each of the outer skin, the core, and the inner skin, and with at least one side of the top of the outer skin forming an overhang over at least one recessed side of the core and the inner skin;

4. wherein at least one the plurality of rafter splines or at least one of the plurality of extended rafter splines is coupled to the at least one panel side of the plurality of structural insulated panels by abutting a portion of the top of the respective rafter spline support member or extended rafter spline support member against an underside of the structural insulated panel outer skin overhang, by abutting the upper portion of a lateral side of the respective rafter spline support member or extended rafter spline support member against both the end of the recessed core and the inner skin of the structural insulated panel, and by abutting an outer-side of the inner skin to the top of one of the respective rafter spline flanges or extended rafter spline flanges, repeating the assembly with another structural insulated panel to the opposing side of the rafter spline or the extended rafter spline.

As shown in FIGS. 20-30, the framing assembly uses modified splines 1, 101, modified structural insulated panels 15, and surface attachment members 14 to construct a building structure resembling a timber frame, exposed beams, or exposed columns. Conventional splines insertably mounted between conventional SIPs are replaced by modified splines that are insertably mounted between modified SIPs. Although various types of wall panels, ceiling panels, and roof panels may be used, the preferred materials are modified SIPs. Each spline is lighter and more cost effective than using a heavy beam or heavy column. The design and structure of the splines carry the required load of the panels and the roof.

The wall splines 1 are arranged as a vertical element or upstanding column used to connect the wall panels 15 together. When not used as a column, the modified wall spline may be alternatively interchanged with a conventional wall spline without the pair of flanges. The rafter splines are arranged as rafters or beams to connect ceiling panels or roof panels together. More particularly, a lower, wider portion of each wall spline, each rafter spline, and each extended rafter spline are mounted between the respective wall panel sections, ceiling panel sections, or roof panel sections. By sandwiching the wall splines between two panels, the resulting frame is more rigid and does not need additional bracing. A plurality of fasteners secures each of the splines to the panels.

As depicted in FIGS. 1-14, each of the plurality of splines 1, 101 has a support member 2, 102, and a pair of flanges 7, 107. Each flange 7, 107 abuts a lateral side 3, 103 of the support member 2, 102. The spline resembles a T-shaped beam, with the support member flanked by flanges forming the lower, distal, and bottom portion of the spline. The abutted seams of the support member and flanges may be visible until covered with a surface material attachment 14. Using a unitary spline without seams is not recommended. The upper, proximal, or top portion of the spline is the support member. This upper portion of the spline 1, 101 has a width smaller than a width of the lower portion of the spline 1, 101 due to the pair of flanges sandwiching the lower portion of the support member.

In a preferred embodiment shown in FIGS. 20-30, the plurality of splines may be used as a plurality of wall splines, a plurality of rafter splines, or a plurality of extended rafter splines, with the support member of each of these types of splines having substantially same length as a length of each of the pair of flanges that flank the support member. With the plurality of extended rafter splines, one end of the support member of the extended rafter spline has a length longer than a length of each of the pair of flanges that flank the support member.

Each wall spline is essentially a wall stud alternative for supporting the wall panels and for supporting the weight or load of the roof of the building structure, and for providing an exposed upstanding column appearance. Each rafter spline and each extended rafter spline is essentially a rafter for supporting the ceiling panels and the roof panels, and for supporting the weight or load of the ceiling and the roof of the building structure. The extended rafter splines may be further used to form a soffit of the roof line. A user may selectively decrease the depth of the exposed lower, exposed beam portion of the spline by trimming or cutting off the excess material. The length of each spline may extend from floor to ceiling for wall splines/columns or wall to wall for rafter splines/beams. To extend the length of a wall spline or a rafter spline beyond the length of the available materials, another respective wall spline or rafter spline is positioned to align and abut the other spline.

The support member 2, 102 may be part of a wall spline, a rafter spline, or an extended rafter spline. Each support member of a spline is preferably made of structural composite lumber ("SCL"), although other comparable materials may be used. The length of each spline and corresponding support member depend on the specifications for constructing the building structure and depends on the pitch and length of the roof. For example, the splines may be 20 to 24 feet long. Using SCL for the spline support member provides more accuracy and desired length in the construction. The width of the support member ranges from approximately 1.5 inches up to 3 inches, depending on the required load. The wall spline dimensions range from 2-inch×4 inch or 2-inch×6-inch studs or columns. The rafter spline dimensions range from 2-inch×8 inch, 2 inch×10 inch, or 2 inch×12 inch rafters. An example of a preferred support member dimensions is 2-inch width×16-inch depth/height×20-foot length. The dimensions used for a rafter spline or an extended rafter spline will depend on the size of the support member SCL, the flanges DL, and the pitch and length of the roof. The spline support member may be mounted and secured with truss plates, bend plates, or other connecting members.

As shown in the figures, the distal or lower portion of the support member 2, 102 is sandwiched between the two flanges 7, 107, with the distal, lower, or second end of the support member 2, 102 being aligned with the distal, lower, or second end of the two flanges 7, 107. The proximal or upper portion of the support member is upstanding and has a depth (or height) longer than a depth (or height) of the flanges. The size of the flanges may range from 2 inch×4 inch board, 2 inch×6 inch board, 2 inch×8 inch board, 2 inch×10 inch board, or 2 inch×12 inch board, depending on the specifications for constructing the building structure. The width of each flange is preferably equal to or less than half the width of the support member.

The pair of flanges may be a component of a wall spline, a rafter spline, or an extended rafter spline. Each flange of a spline is preferably made of dimensional lumber ("DL") board, although other comparable materials may be used. Each flange is essentially a mirror image to the corresponding flange. The one lateral side 8, 108 of the flange is permanently adhered to the lateral side 3, 103 of a particular support member, leaving the opposing lateral side 8, 108 of the flange exposed. Each flange is adhered to the support member by an adhesive member, then pressure is applied to further adhere the flange boards to the support member. The adhesive member is preferably glue or other high-grade construction bonding material. Fasteners, preferably screws or bolts, may be used to further secure the flange boards to the support member.

The top of the flange 7, 107 board creates a ledge 10, 110 to support the wall panel section 25, the ceiling panel section 25, or the roof panel section 25. Using the flanges provides a method of building a structure having exposed beams without relying on additional framing elements. The bottom 5 of the adhered flanges 7, 107 and support member 2, 102 form a flat surface upon which a surface attachment member 14 may be attached. Each wall flange has a length substantially the same as the wall support member. In the preferred embodiment shown in the figures, each wall flange is essentially a substantially rectangular or straight-edge shaped column and may be selectively used along any section of wall. The rafter flanges are essentially the same as the wall flanges but are considered upstanding beams.

In another embodiment, one or both rafter spline flanges are angled for use as in a rafter valley. Here, the angle may range from 30 degrees-45 degrees depending on the pitch of the roof, for example, a roof having a 6/12 pitch versus a roof having a 12/12 pitch. A valley rafter spline having angled flanges would carry more load than a top rafter spline, because the valley rafter spline is typically larger than the top rafter spline. An angled or beveled flange may also be used when joining outer roof panels to form a roof valley or a hip roof. The flange angle would be determined by the angle needed to join the outer panels. This framing assembly may further include a collar tie or a rafter tie to form a truss.

For the embodiment depicted in FIGS. 15-19 wherein extended rafter splines are used, the end of each flange 107 abuts the top 4 of the wall spline 1 at an angle 109, with the rafter support member also terminating at an angle 106 as a rafter tail that extends beyond the wall to form part of an eave overhang. When used as part of a rafter spline 1 or an extended rafter spline 101, the support member 102 may be mounted to one or more connecting members 16, such as truss plates or bend plates.

A surface attachment member 14 may be applied to the end of the lower portion of the spline. The surface treatment used as the surface attachment may be selected from the group consisting of paint, spray, veneer, backing, or combinations thereof.

The rafter splines may further include rafter ties to form a truss, as needed. Each upstanding end of a wall spline may be further fastened or otherwise coupled to a corresponding rafter spline, with the opposite end of the rafter spline being fastened to another rafter spline arrangement forming a frame that can be raised into position.

The modified SIP inner skin 22, and where applicable the preferred foam core 21, is trimmed to accommodate the spline 1, 101, leaving the unmodified outer skin 17 with an overhang 20 to essentially form an L-shape of the SIP 15. The outer skin 17 overhang 20 of the modified SIP 25 is approximately half the width of the spline 1, 101 support member 2, 102. The figures depict the assembly of the outer 17 skin overhang 20 of two modified SIPS 25 may be secured to the top 4, 104 of one spline 1, 101 support member 2, 102. When the spline is installed with the modified wall SIP, ceiling SIP, or roof SIP, part of the top of the spline support member abuts the underside of the outer skin overhang, with the lateral side of the upper portion of the spline support member abutting the trimmed foam core and the inner skin, and with the exposed outer-side of the inner skin abutting the top of one of the spline flange ledges. The modified SIP is secured to the spline with a plurality of fasteners. The fasteners used to secure the SIP to the flange ledge must be long enough to penetrate the entire cross section of the SIP panel and into the spline flange. The installation process is repeated for a second, adjacent modified SIP, with the overhang outer skin of the second modified SIP positioned over the unencumbered part of the top of the spline support member. The framing assembly, with the assembled sections of modified SIPs and splines, may be raised or otherwise positioned into place in the building structure. The exposed side of the assembled modified SIPs outer skins form a continuous surface.

During installation, the bottom of the modified SIPs is coupled to a sill plate that is mounted to the floor. The bottom of the modified SIP retains the conventional recess of the foam core within the outer skin and inner skin for coupling to the sill plate. The modified SIP wall panel height is determined by the desired eave height of the building and the location of where the roof and walls meet. The roof/ceiling SIP panels preferably has a depth of approximately 6 inches or 8 inches, depending on the R value or the amount of insulation required for the building. Each SIP wall panel preferably has a depth or thickness of approximately 6 inches or 4 inches. If a surface attachment member is applied to the lower portions of the splines, the user may elect to apply the surface attachment member to all three sides of the exposed spline, to two sides of the exposed spline, or to only one side of the exposed spline.

The framing assembly may further include an eave. The eave includes a lookout 29 upstanding from and mounted to a soffit 28. The lookout is essentially a board or other structural material having a top, a bottom, two opposing lateral sides, a distal end, and a proximal end. The distal end of the lookout is closest to the building structure, while the proximal end is near the roof overhang. The lookout proximal end is fastened to the modified rafter spline (rafter tail) and fastened at the distal end to a wall spline. The eave provides additional strength and stability to the building frame in addition to straightening the walls. A mend plate, truss plate, or stud strap may also be used to attach the lookout to both the extended rafter spline and to the wall spline.

The soffit is mounted to the bottom of the lookout. The soffit extends beyond the length of both the lookout and the extended rafter spline (or other roof tail) by approximately ½ inches. The soffit may be made from long engineered wood members, preferably oriented strand boards, and may further define a groove therein. The soffit, lookout, and extended roof spline form a truss so that the roof load is transferred to a bending moment. The soffit acts as a beam and counteracts the bending moment. This configuration results in a stronger, stiffer exterior wall. This arrangement is particularly useful for vaulted ceilings.

A fascia header may be added via the soffit groove. The framing assembly may further include collar ties, rafter ties, or both to further strengthen the structure. The ties may be made from the same material as the rafter splines, or it may be made out of metal. The ties may be used for structural purposes, ornamental purposes, or both.

The roof panel sections lay over the outer skin of the roof SIP or ceiling SIPs. A crane is not needed during this construction. The sections may weigh approximately 200-300 pounds but may be winched and lifted into place before fastening—all without using a crane. When a ridge beam is used, two rafter splines are joined and fastened together to form a straight roof peak. When a ridge beam is not used, an end plate connects two rafter splines to form the roof peak.

In yet another embodiment of the invention, a framing assembly for constructing the frame of a building structure having at least one exposed beam, the framing assembly comprising:

a. a plurality of rafter splines, each of the plurality of rafter splines comprising a support member having a lower portion and an upper portion, and a pair of flanges, with the support member having a depth or height more than a depth or height of each of the pair of flanges, and with each of the pair of flanges abutting and being affixed to the lower portion of the support member a lower portion of the rafter spline and with the upper portion of the support member forming the upper portion of the rafter spline;

b. a plurality of extended rafter splines, each of the plurality of extended rafter splines comprising an extended rafter support member and a pair of flanges,
   i. the extended rafter support member having a lower portion, an upper portion, a first end separated from a second end by a longitudinal body, with the longitudinal body of the extended rafter support member having a length longer than a length of each of a pair of flanges and extending beyond a roof of the building structure as a rafter tail to form part of an eave; and
   ii. the pair of rafter flanges, with the extended rafter support member having a depth or height more than a depth or height of each of the pair of flanges, with each of the pair of flanges abutting and flanking the lower portion of the extended rafter support member forming a lower portion of the extended rafter spline, and with the upper portion of the extended rafter support member forming an upper portion of the extended rafter spline;

c. a plurality of structural insulated panels, each structural insulated panel comprising an outer skin having a top, a bottom, and at least one side; a core within the structural insulated panel, the core having a top, a bottom, an end and at least one side; and an inner skin having a top, a bottom, an end, and at least one side, with the outer skin, the core, and the inner skin mounted together as a layer of the structural insulated panel further, with the structural insulated panel further comprising at least one side of each of the outer skin, the core, and the inner skin, and with at least one side of the top of the outer skin forming an overhang over at least one recessed side of the core and the inner skin;

d. wherein at least one the plurality of rafter splines or at least one of the plurality of extended rafter splines is coupled to the at least one panel side of the plurality of structural insulated panels by abutting a portion of the top of the respective rafter spline support member or extended rafter spline support member against an underside of the structural insulated panel outer skin overhang, by abutting the upper portion of a lateral side of the respective rafter spline support member or extended rafter spline support member against both the end of the recessed core and the inner skin of the structural insulated panel, and by abutting an outer-side of the inner skin to the top of one of the respective rafter spline flanges or extended rafter spline flanges, repeating the assembly with another structural insulated panel to the opposing side of the rafter spline or the extended rafter spline.

In the embodiment depicted in FIGS. 31-41 and in another embodiment depicted on FIGS. 42-50 and using different reference numbering than the embodiments shown in FIGS. 1-30, the invention is a framing assembly that comprises (includes or has) at least one interior rafter vent assembly 1. For the embodiment depicted in FIGS. 31-41, the at least one rafter vent assembly is an interior rafter vent assembly. For the embodiment depicted in FIGS. 42-50, the at least one rafter vent assembly is an exterior rafter vent assembly. One or more interior rafter vent assemblies may be used along the interior peak or ridge rafter support beam of the roof of the building structure to allow supplemental ventilation. One or more exterior rafter vent assemblies may be used along the exterior peak of the roof of the building structure to allow supplemental ventilation. A user may selectively use a combination of interior rafter vent assemblies and exterior rafter vent assemblies along the length of the roof peak.

The rafter vent assembly serves at least two purposes. One purpose allows for venting excess moisture around the panel (or SIP) to the exterior environment. Another purpose allows for additional structural support for the opposing roof panels in position during construction and assembly. The rafter vent assembly provides supplemental ventilation, aids in air circulation to vent moist stale air into the environment, minimizing ridge rot, provides intake of drier fresh air that can be metered and controlled while not affecting the interior temperature within the building structure, and supports the building structure.

The interior rafter vent assembly can act as a ridge beam itself when fastened to opposing inside facing panels (SIPs) together during construction. The interior rafter vent assembly can provide adhesion strength of the SIP foam core which further adds to the overall strength of the building structure.

Figure 1:
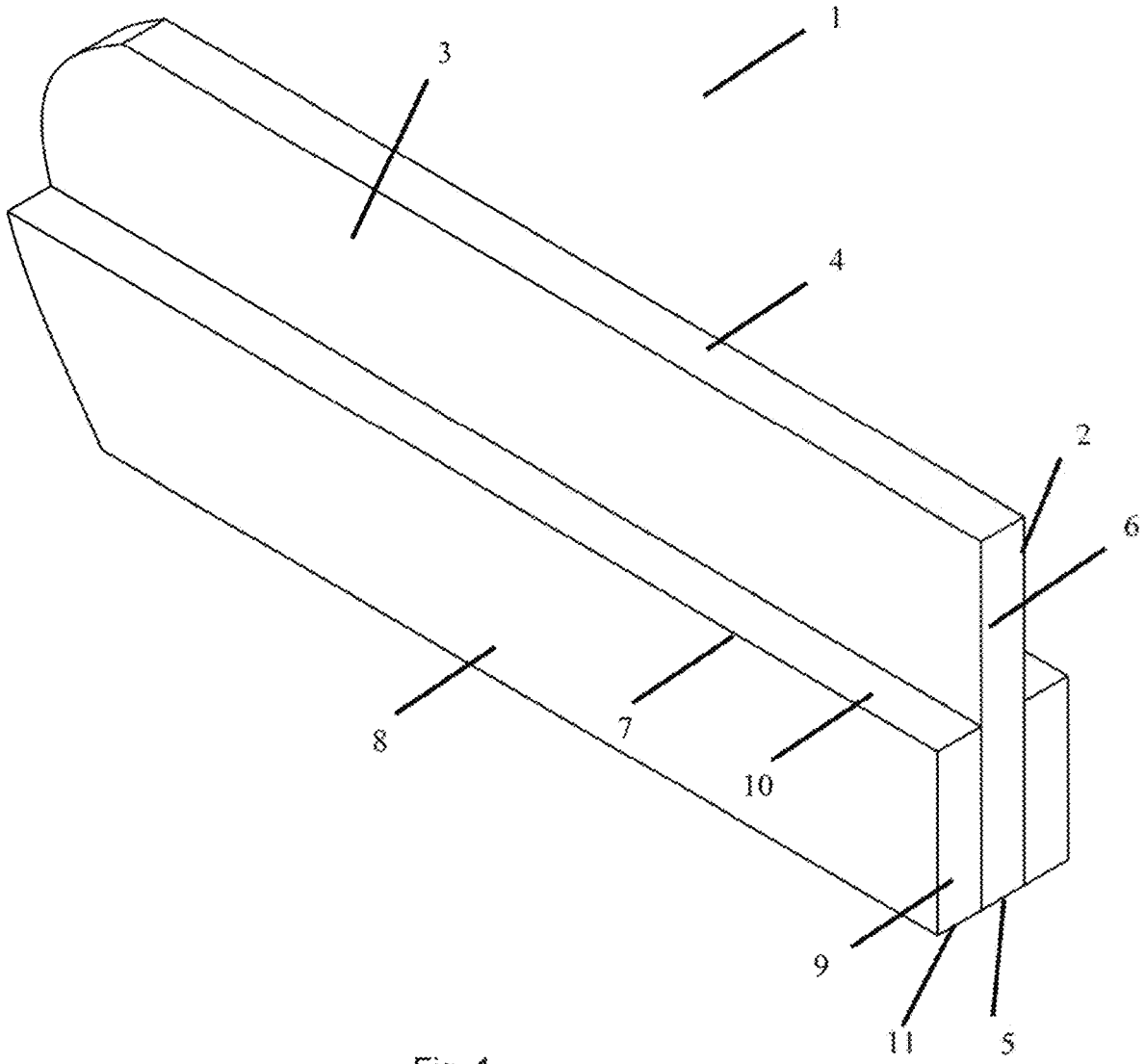
Figure 2:
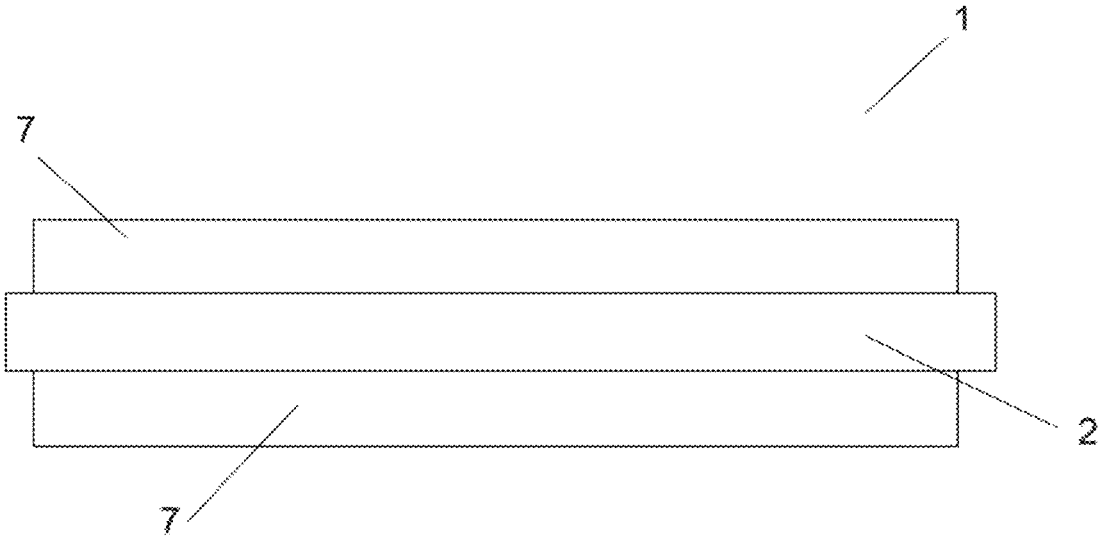
FIG. 2 is is a top plan view thereof.
Figure 3:
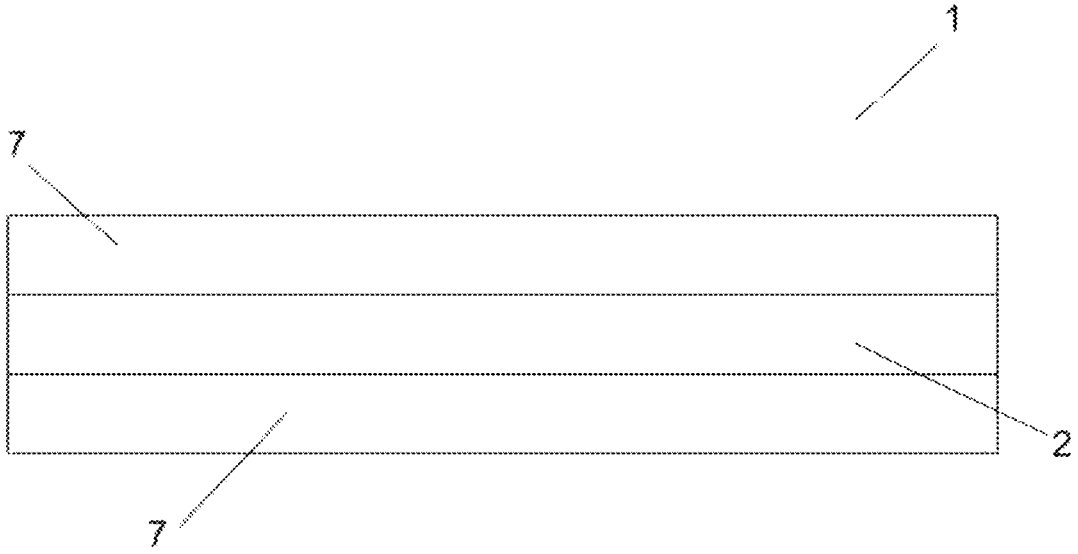
FIG. 3 is a bottom plan view thereof.
Figure 4:
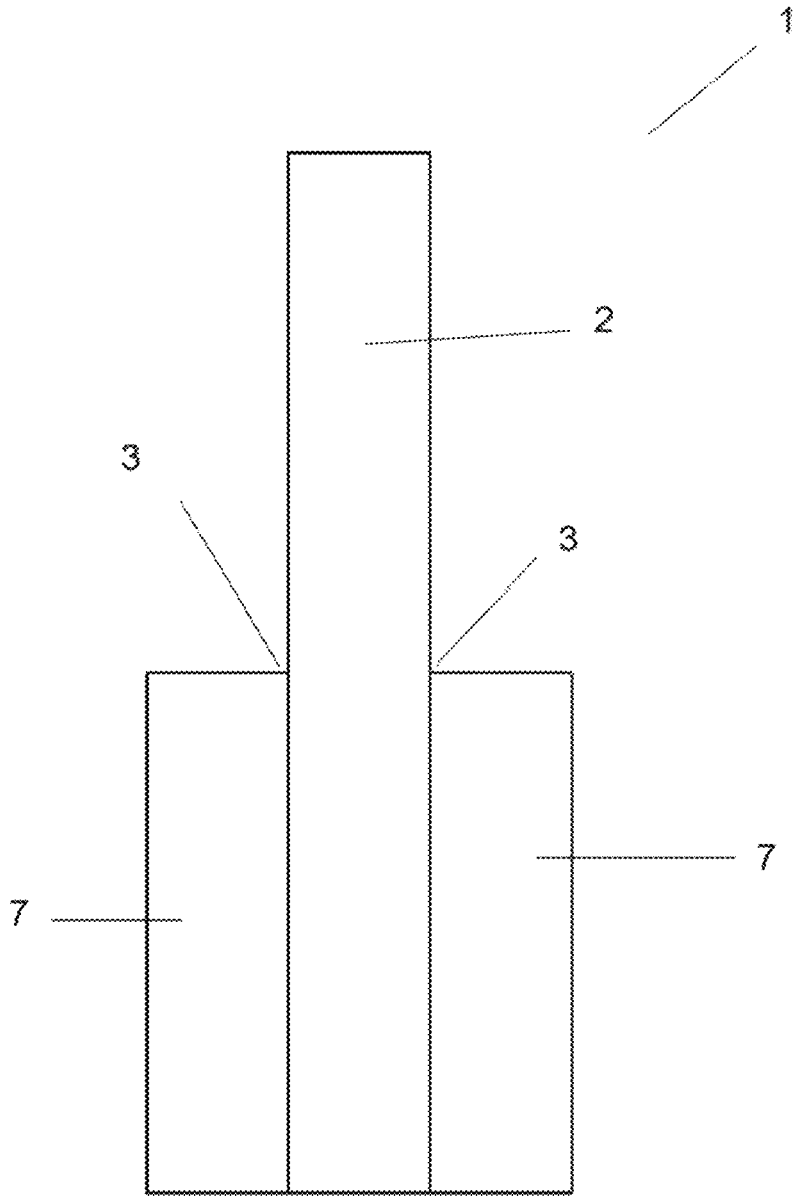
FIG. 4 is front elevation view thereof.
Figure 5:
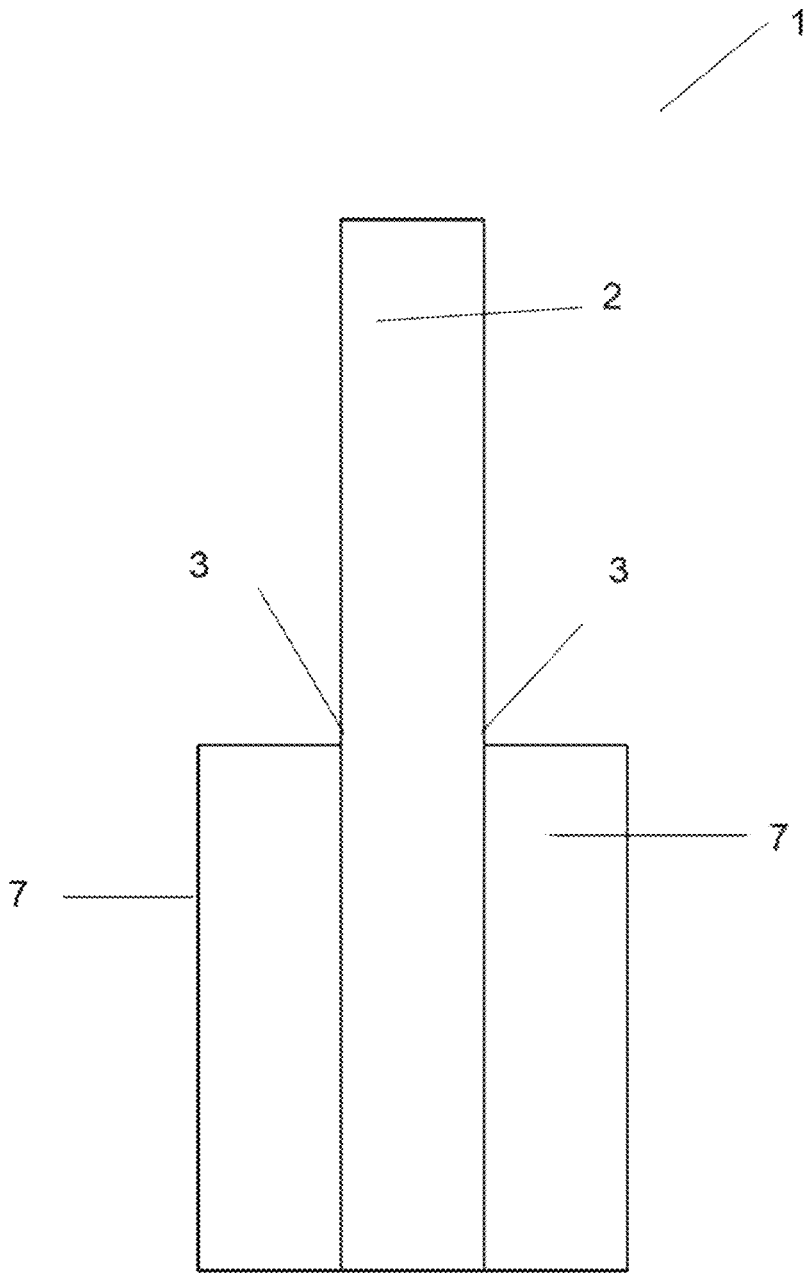
FIG. 5 is is a rear elevation view thereof.
Figure 6:
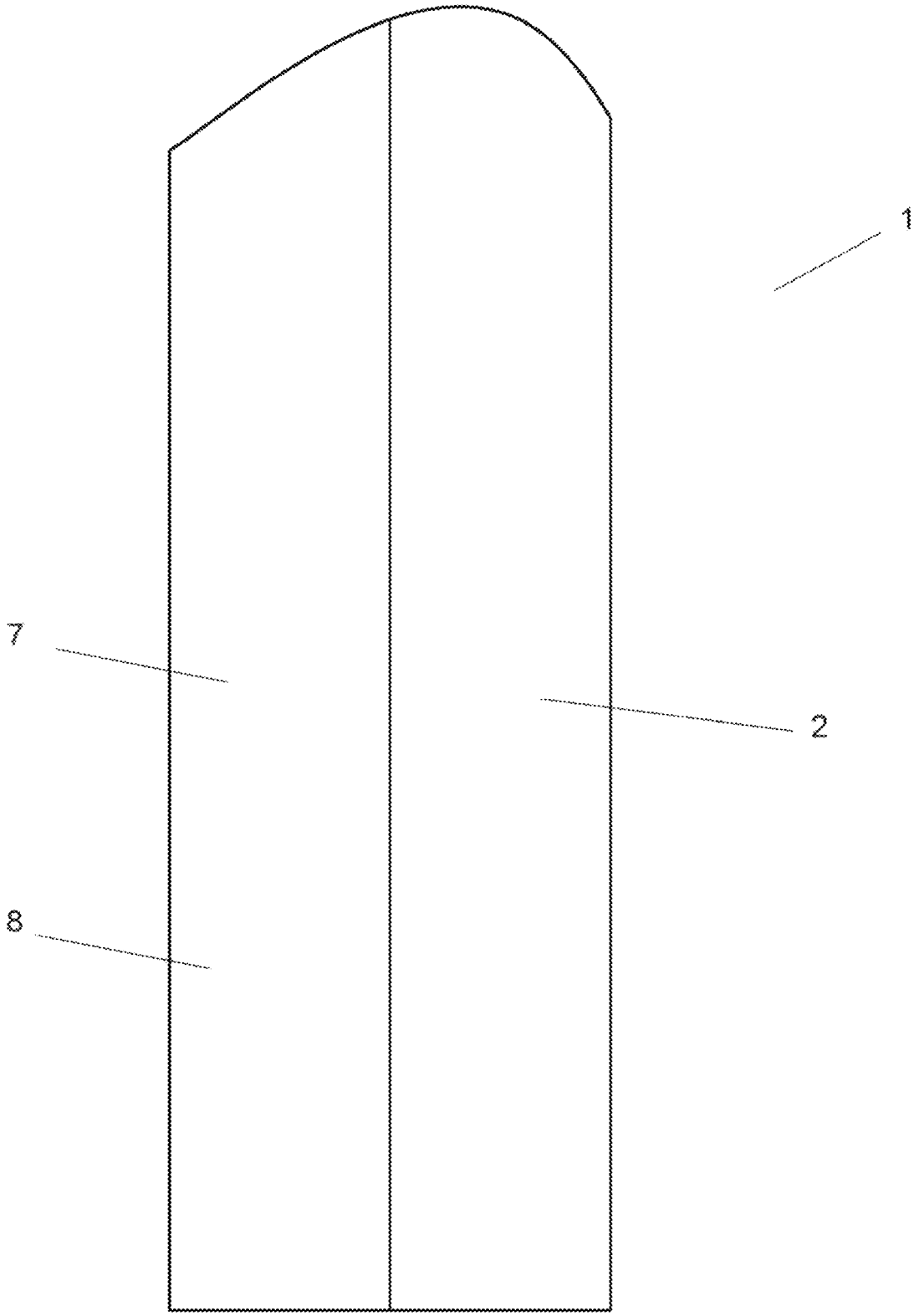
FIG. 6 is is a left side elevation view thereof, with the right side being a mirror image.
Figure 7:
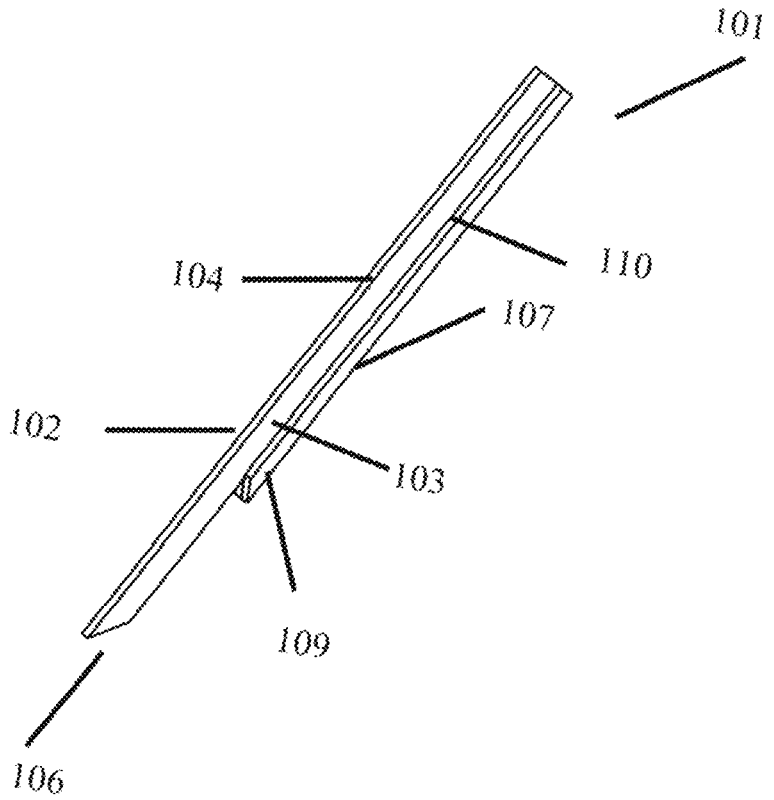
FIG. 7 is a perspective view of an extended rafter spline of the framing assembly.
Figure 8:
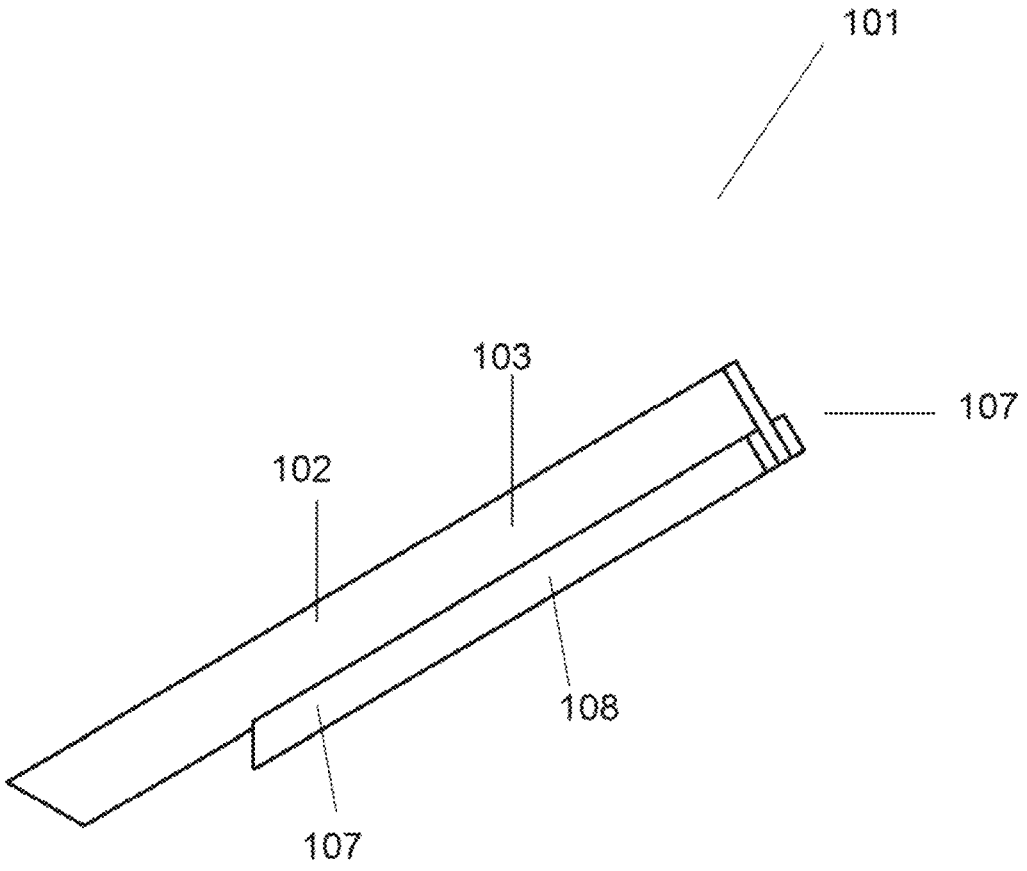
FIG. 8 is another perspective view of FIG. 7 thereof.
Figure 9:
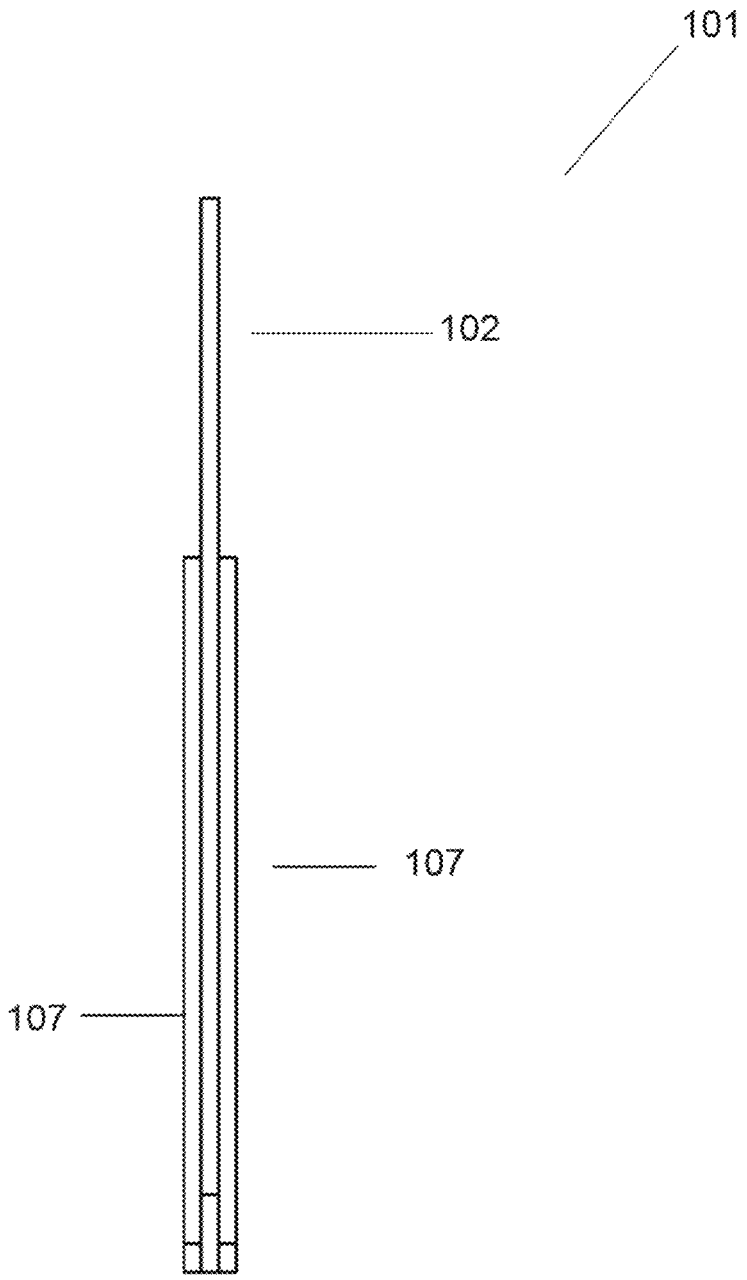
FIG. 9 is a top plan view of FIG. 7 thereof.
Figure 10:
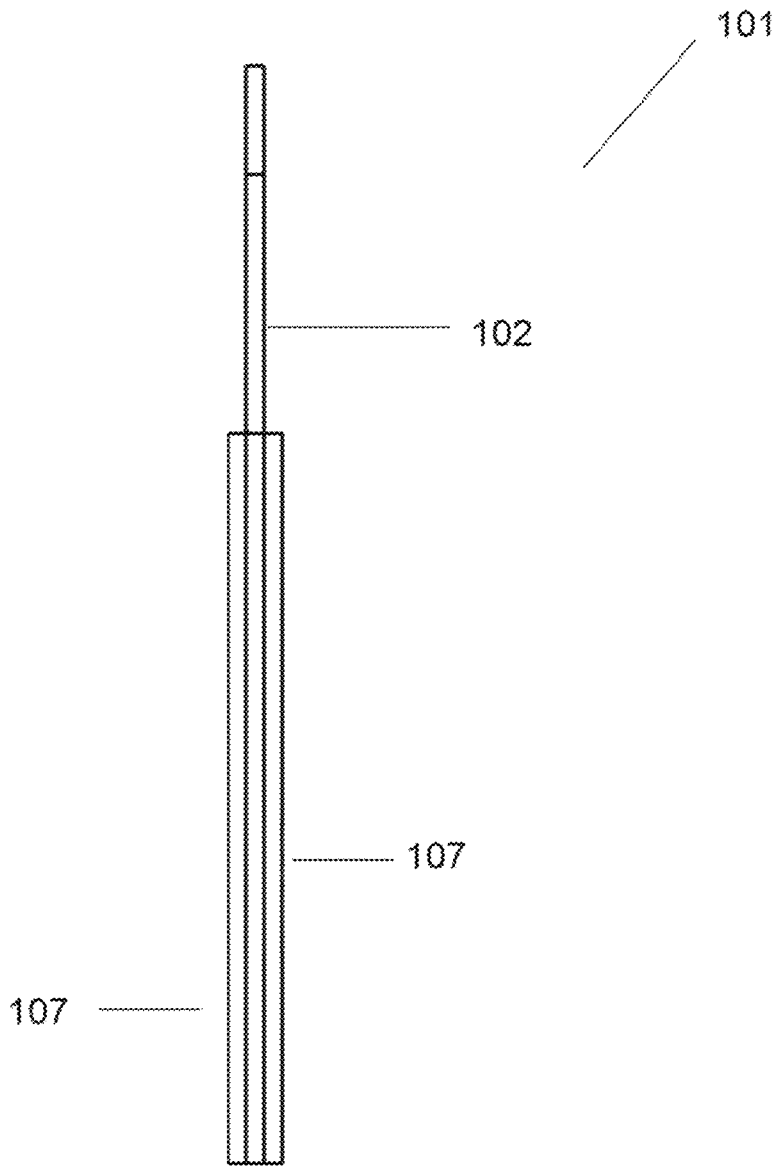
FIG. 10 is a bottom plan view of FIG. 7 thereof.
Figure 11:
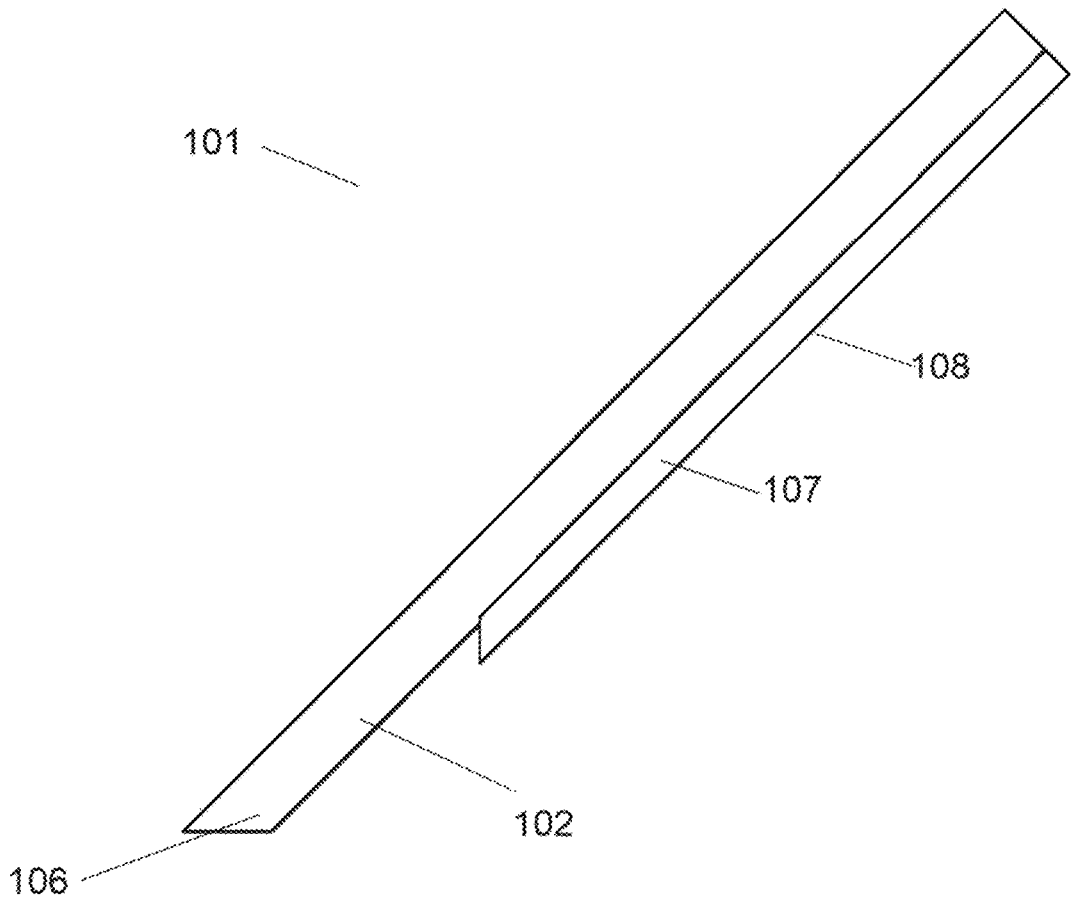
FIG. 11 is a left side elevation view of FIG. 7 thereof.
Figure 12:
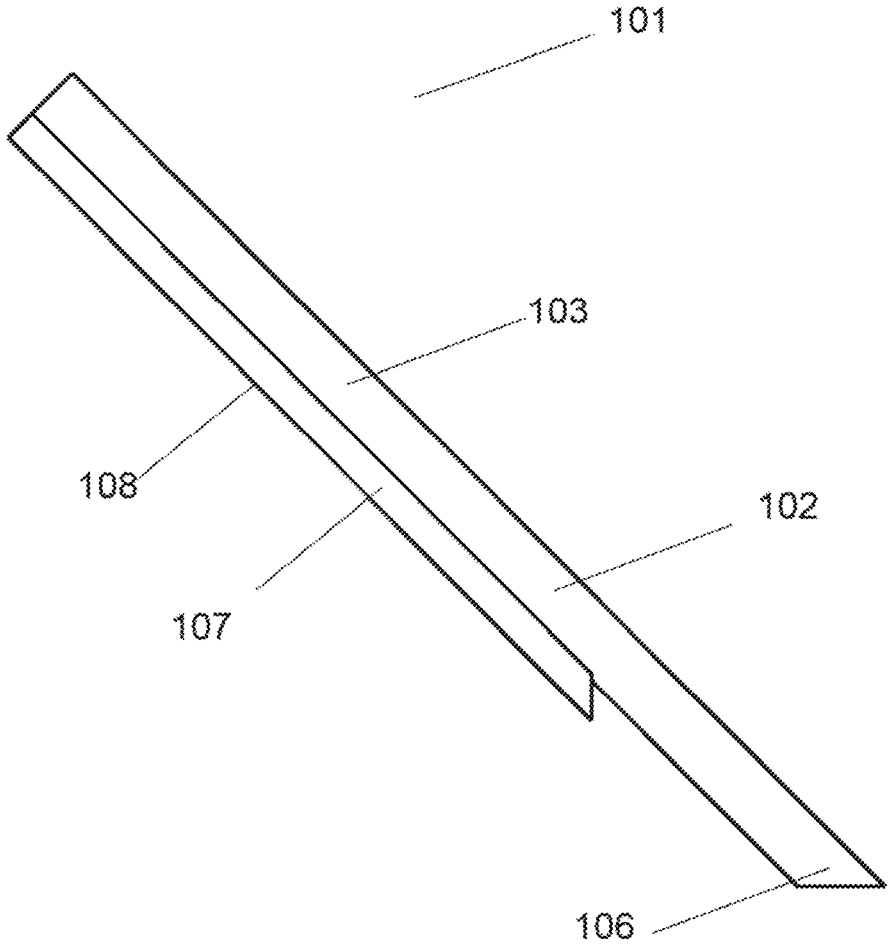
FIG. 12 is a right side elevation view of FIG. 7 thereof.
Figure 13:
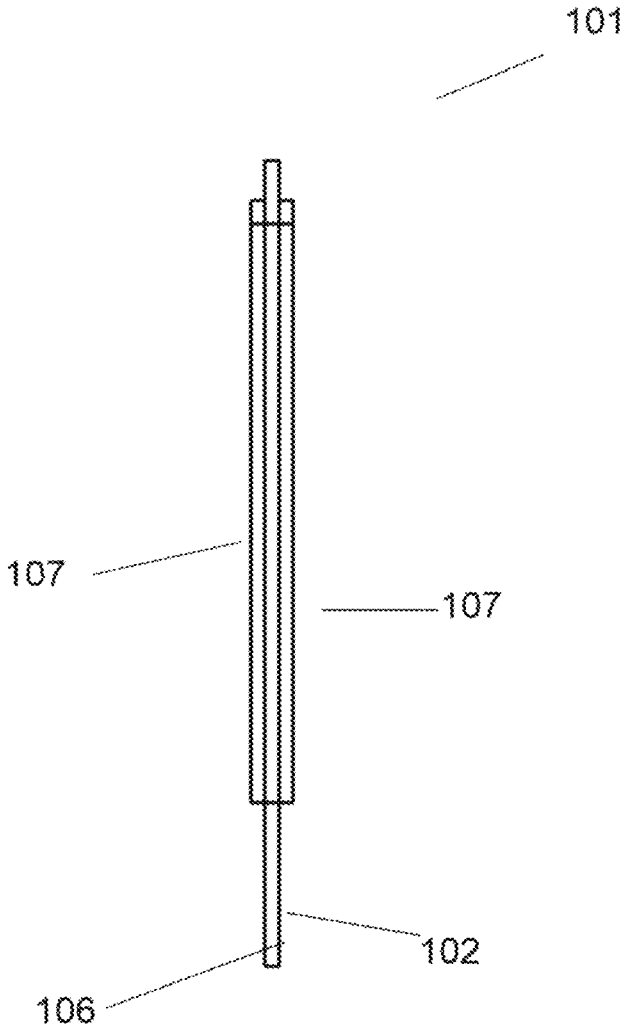
FIG. 13 is a front elevation view of FIG. 7 thereof.
Figure 14:
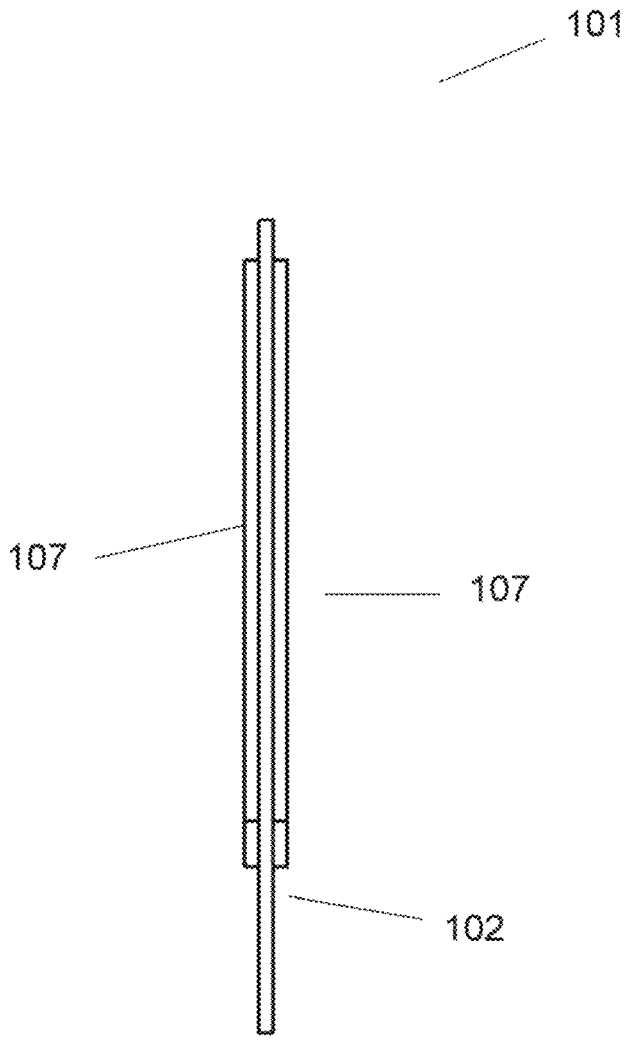
FIG. 14 is a rear elevation view of FIG. 7 thereof.
Figure 15:
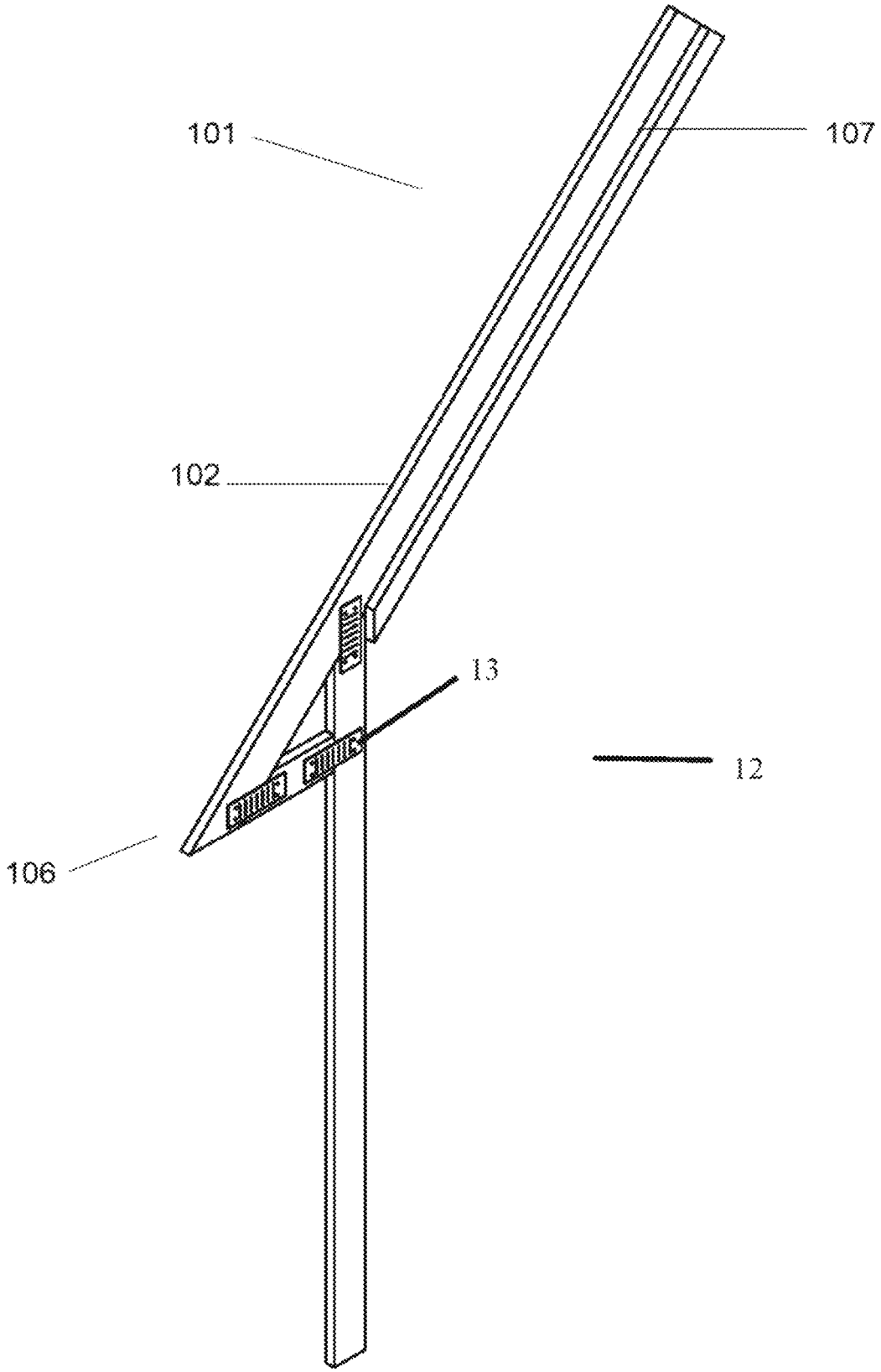
FIG. 15 is a perspective view, showing an extended rafter spline coupled to a wall spline, shown in use.
Figure 16:
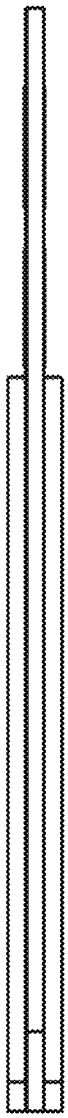
FIG. 16 is a top plan view of FIG. 15 thereof.
Figure 17:
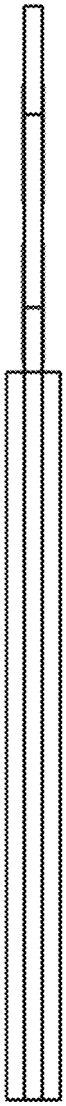
FIG. 17 is a bottom plan view of FIG. 15 thereof.
Figure 18:
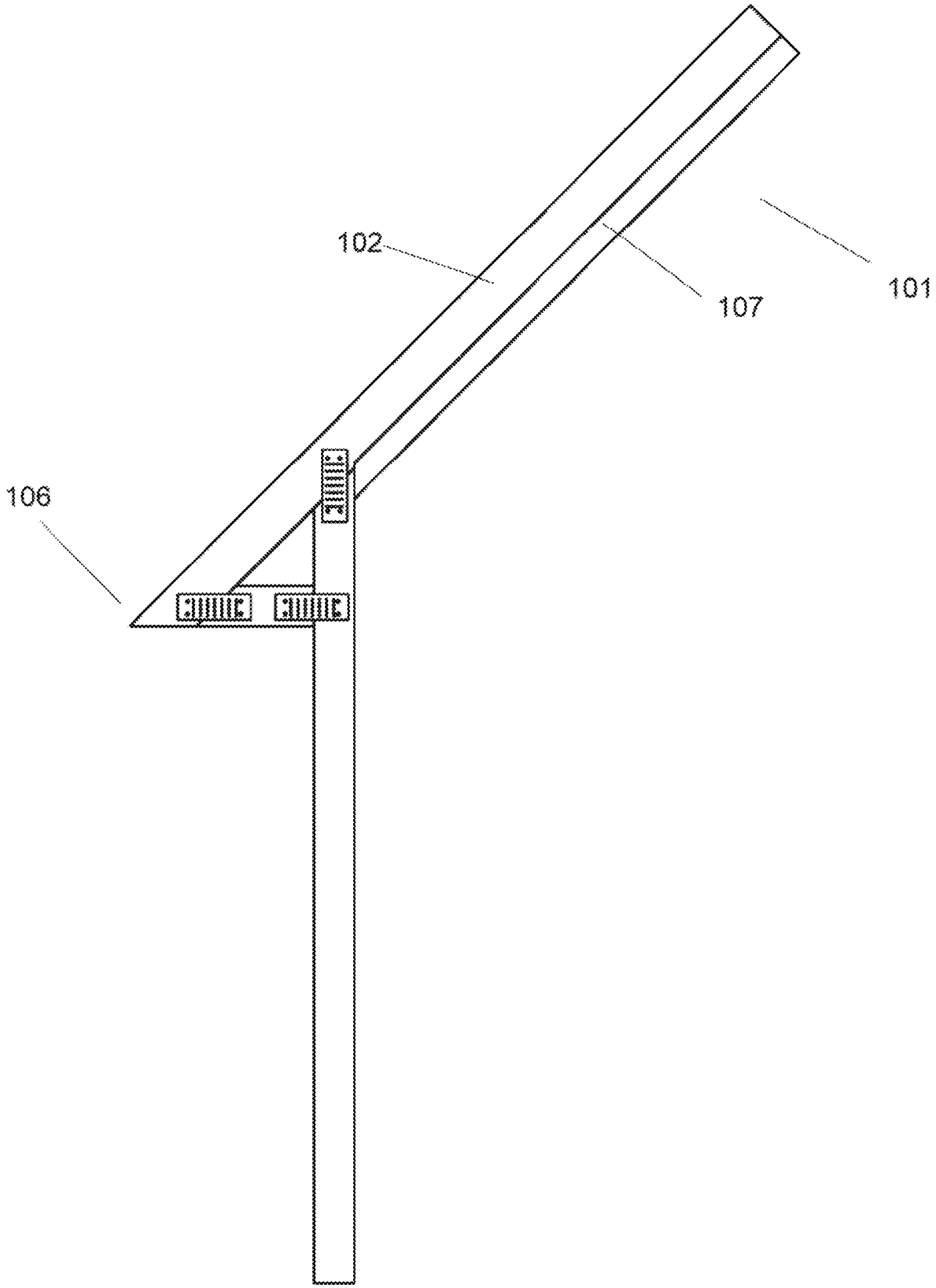
FIG. 18 is a left side elevation view of FIG. 15 thereof, with the right side elevation view being a mirror image.
Figure 19:
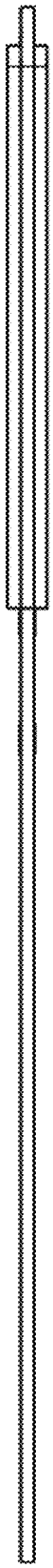
FIG. 19 is a front plan elevation view of FIG. 15 thereof.
Figure 20:
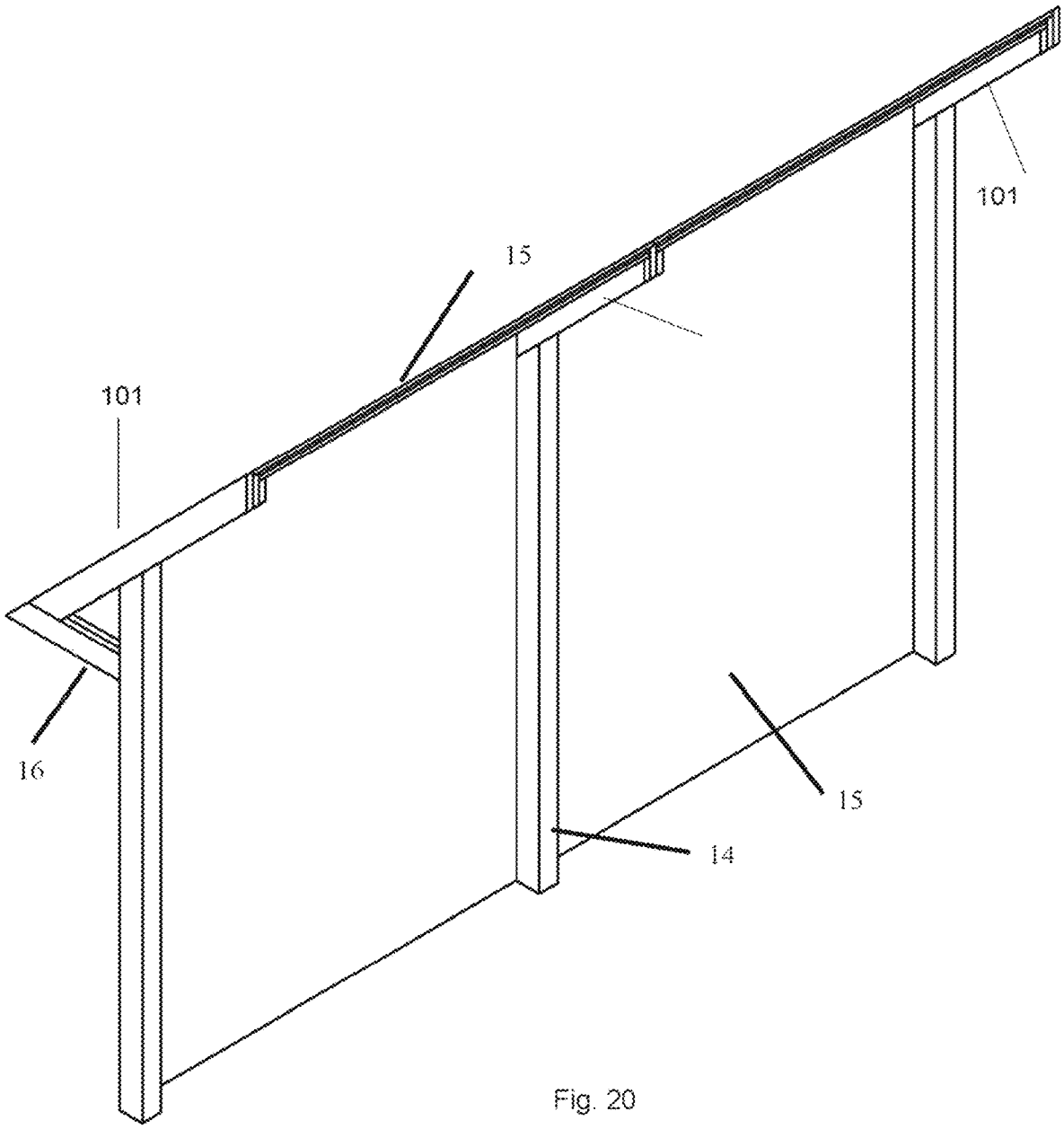
FIG. 20 is a perspective view of another embodiment of FIG. 15 thereof, showing a plurality of surface attachment members coupled to a plurality of wall splines.
Figure 21:
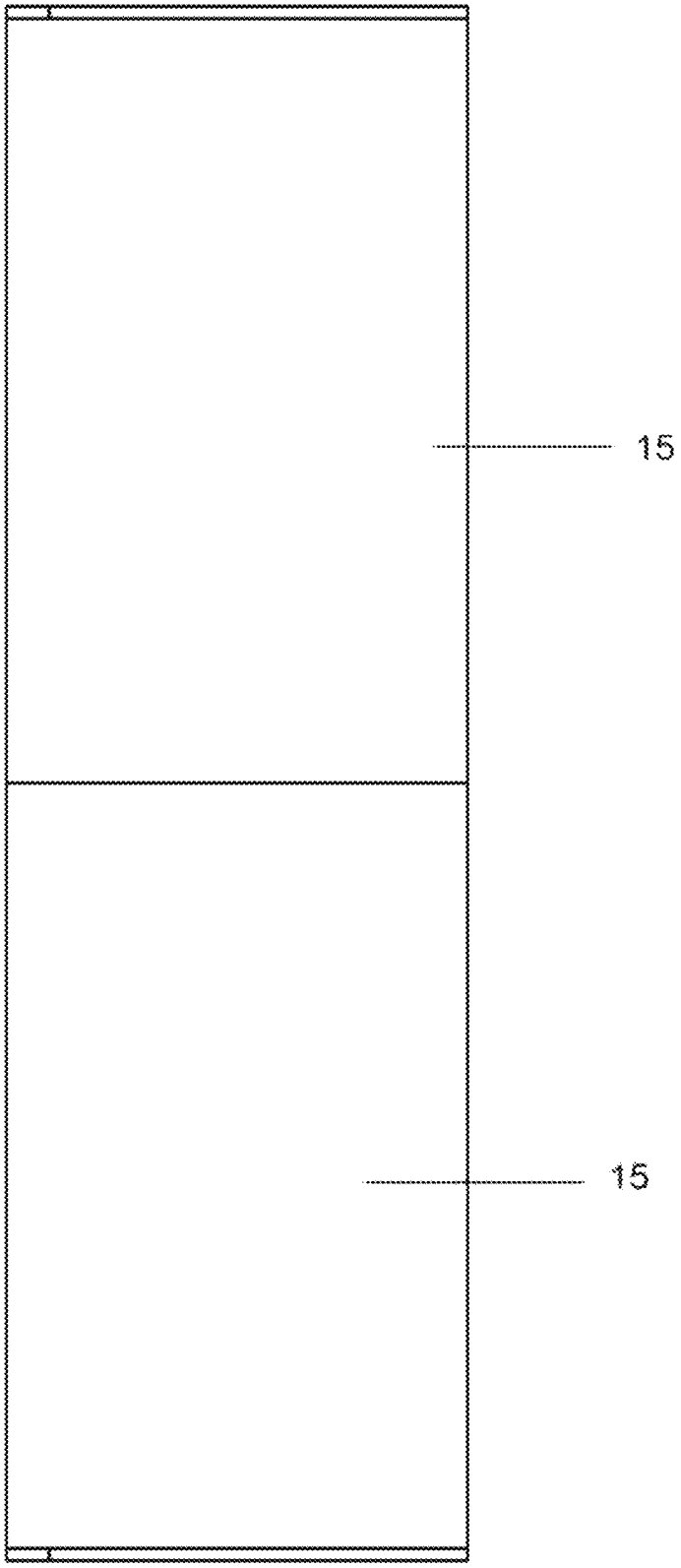
FIG. 21 is a top plan view of FIG. 20 thereof.
Figure 22:
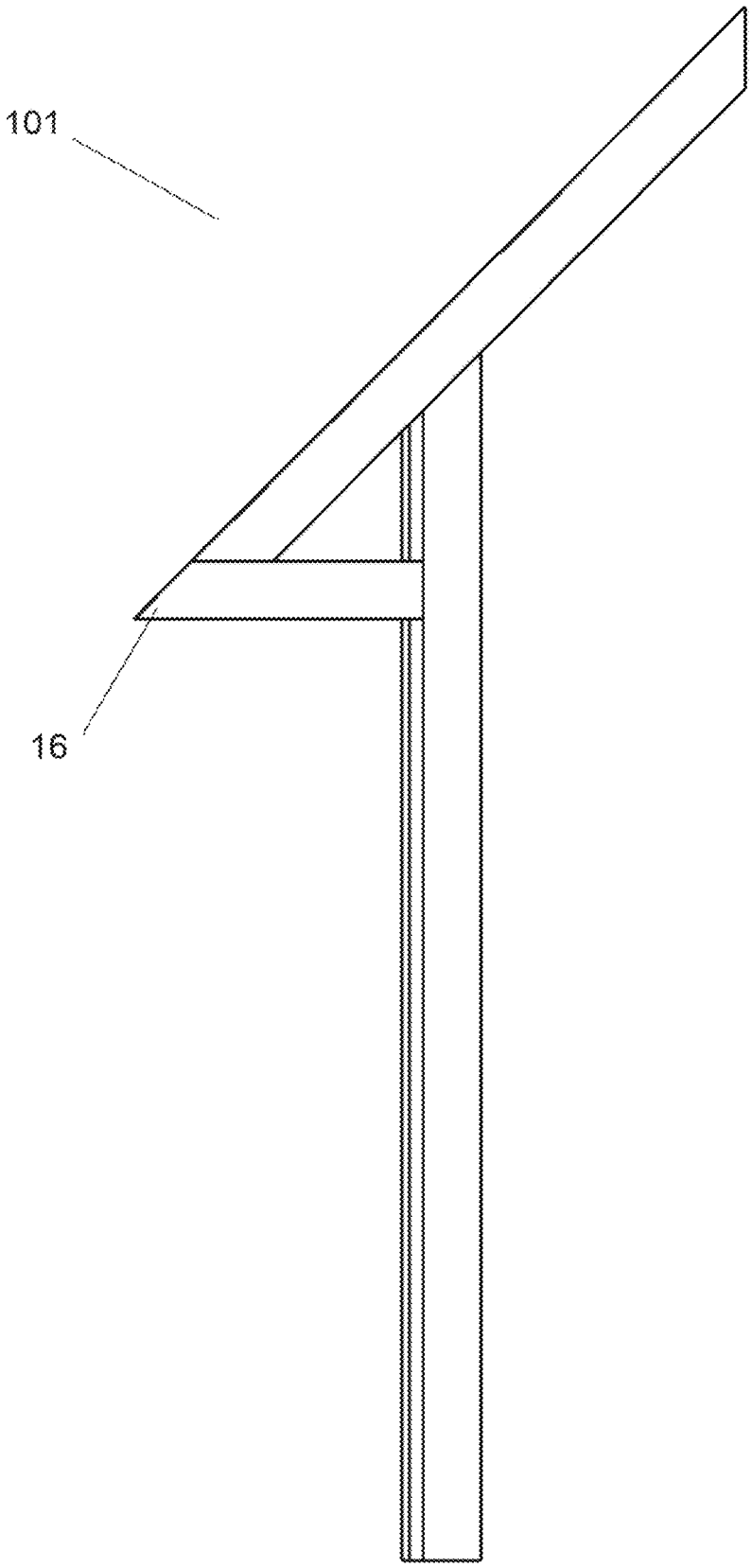
FIG. 22 is a left side elevation view of FIG. 20 thereof, with the right side elevation view being a mirror image.
Figure 23:
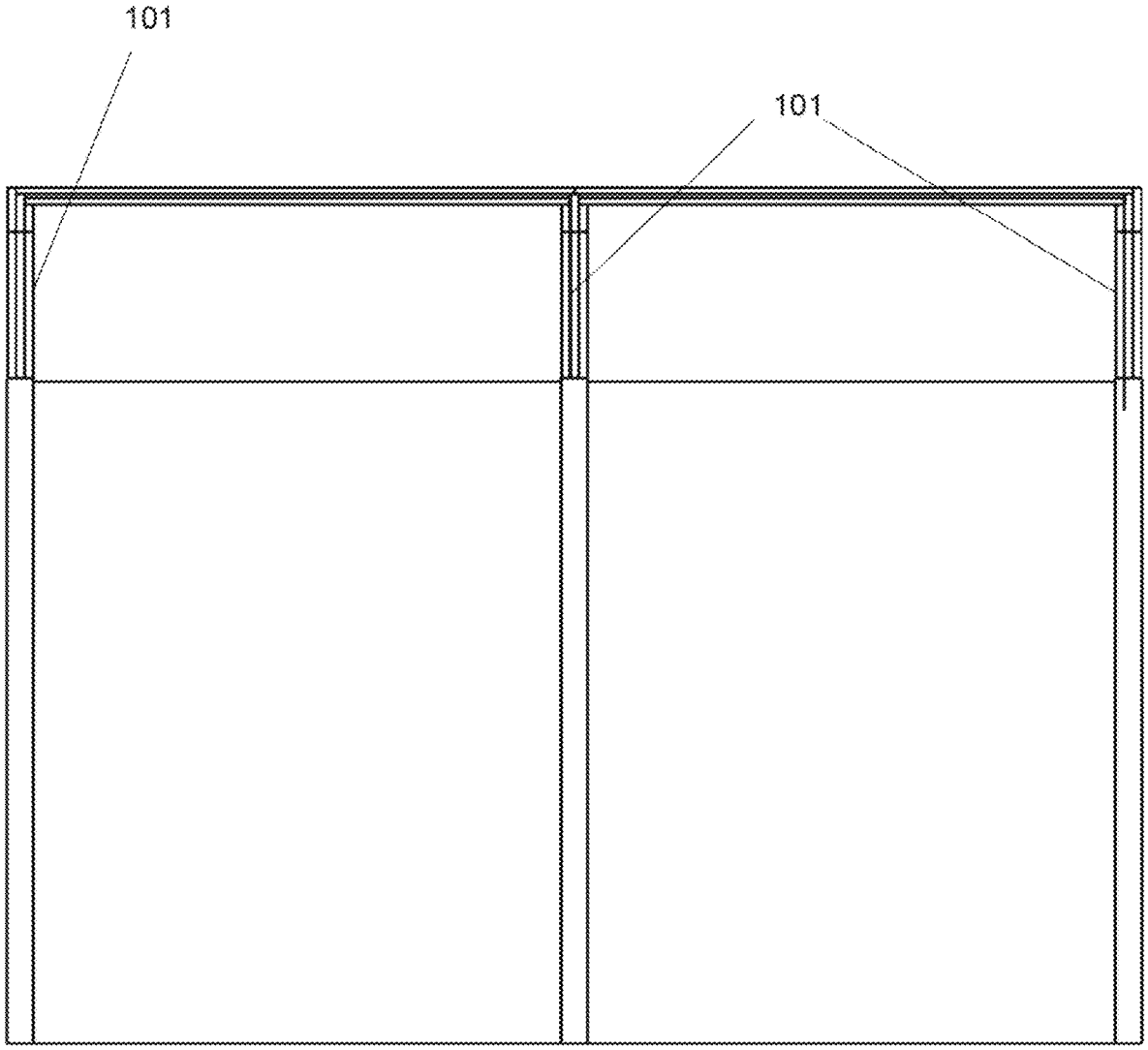
FIG. 23 is a front elevation view of FIG. 20 thereof.
Figure 24:
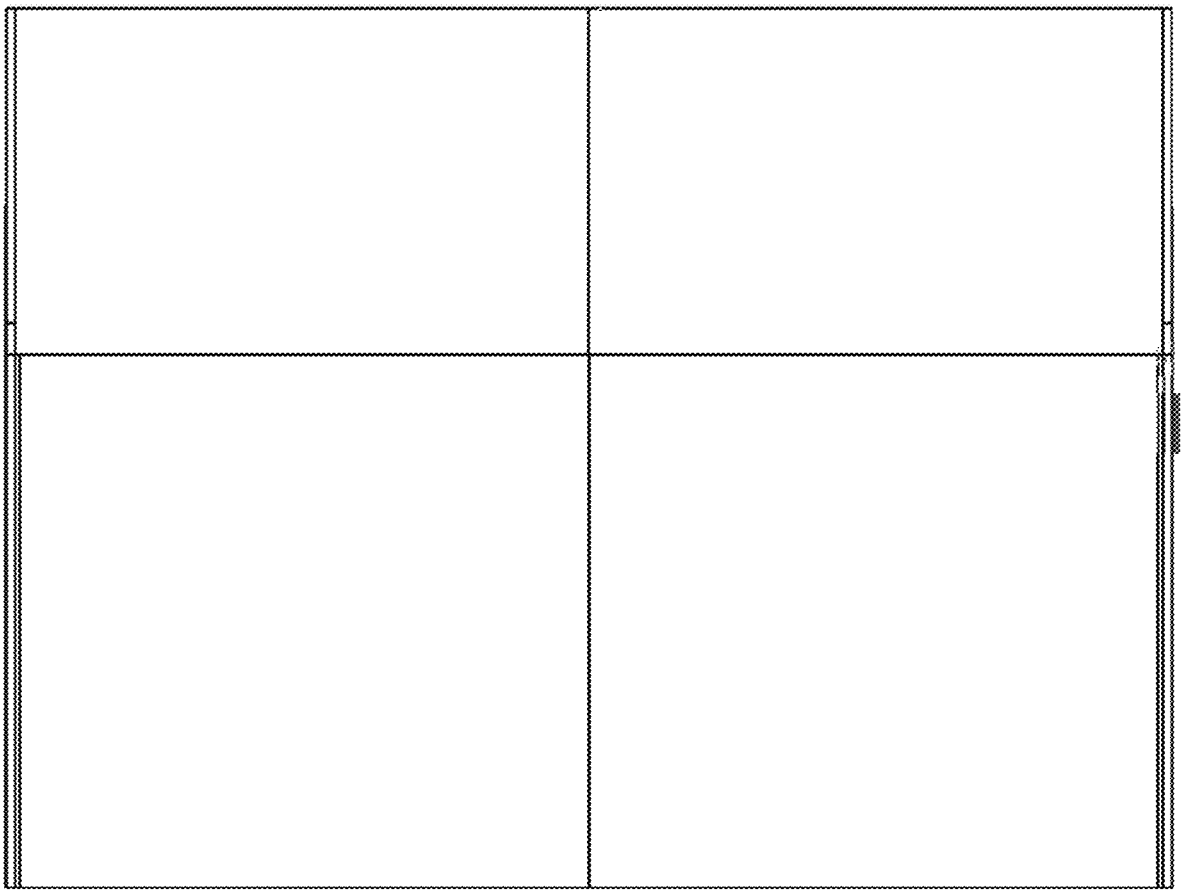
FIG. 24 is a rear elevation view of FIG. 20 thereof.
Figure 25:
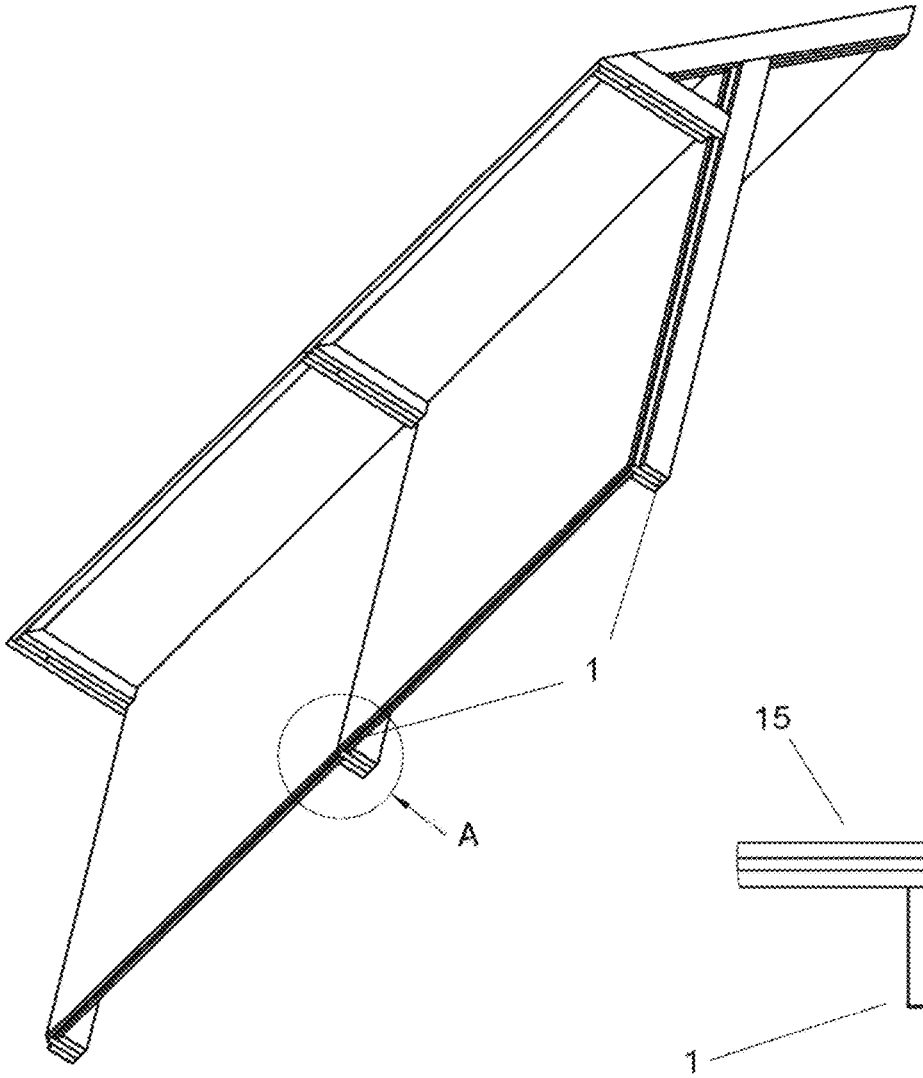
FIG. 25 is another perspective view of FIG. 20 thereof.
Figure 26:
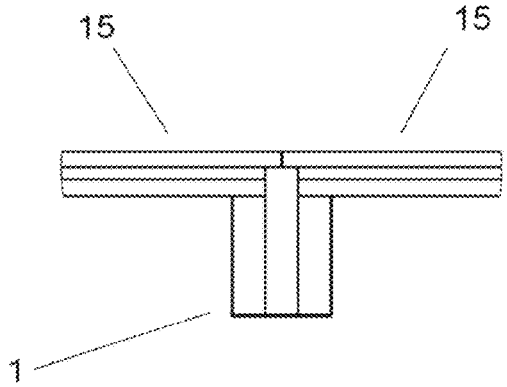
FIG. 26 is is an exploded elevation view of FIG. 25 thereof.
Figure 27:
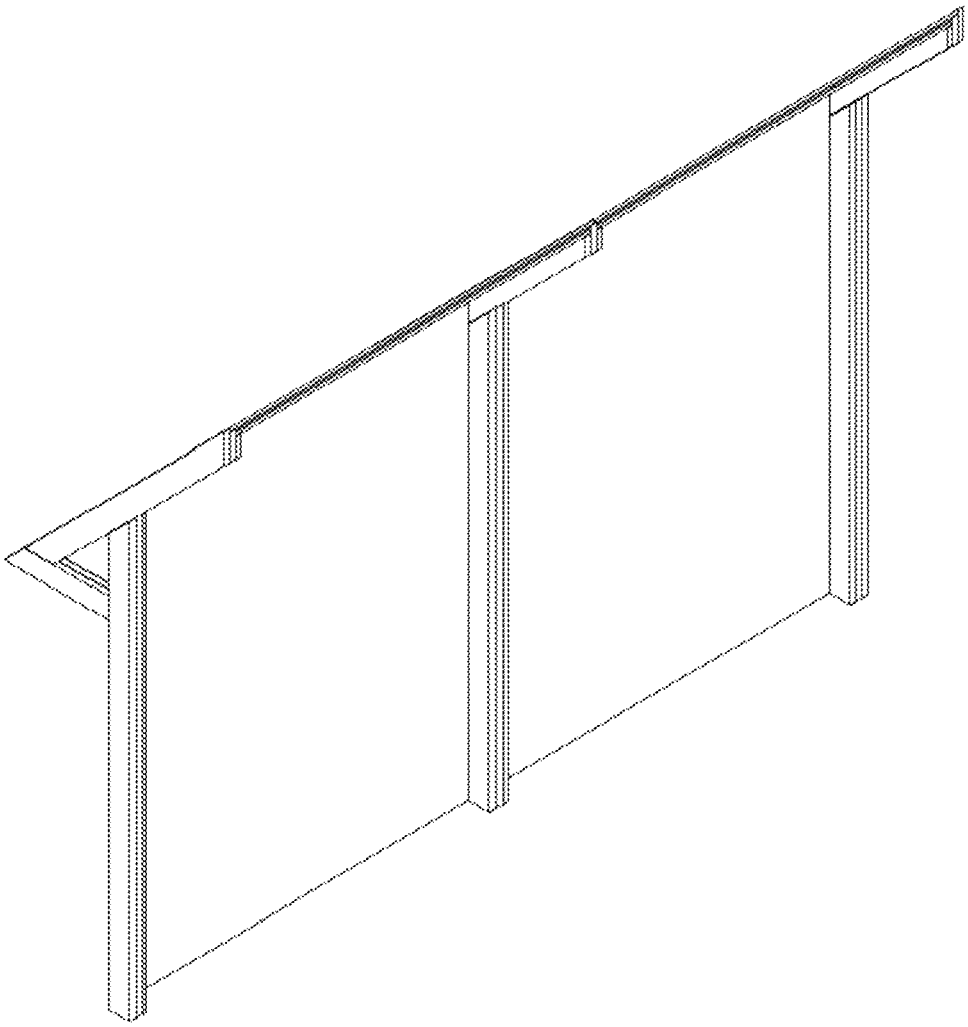
FIG. 27 is is another perspective view of FIG. 15, with the plurality of surface attachment members removed.
Figure 28:
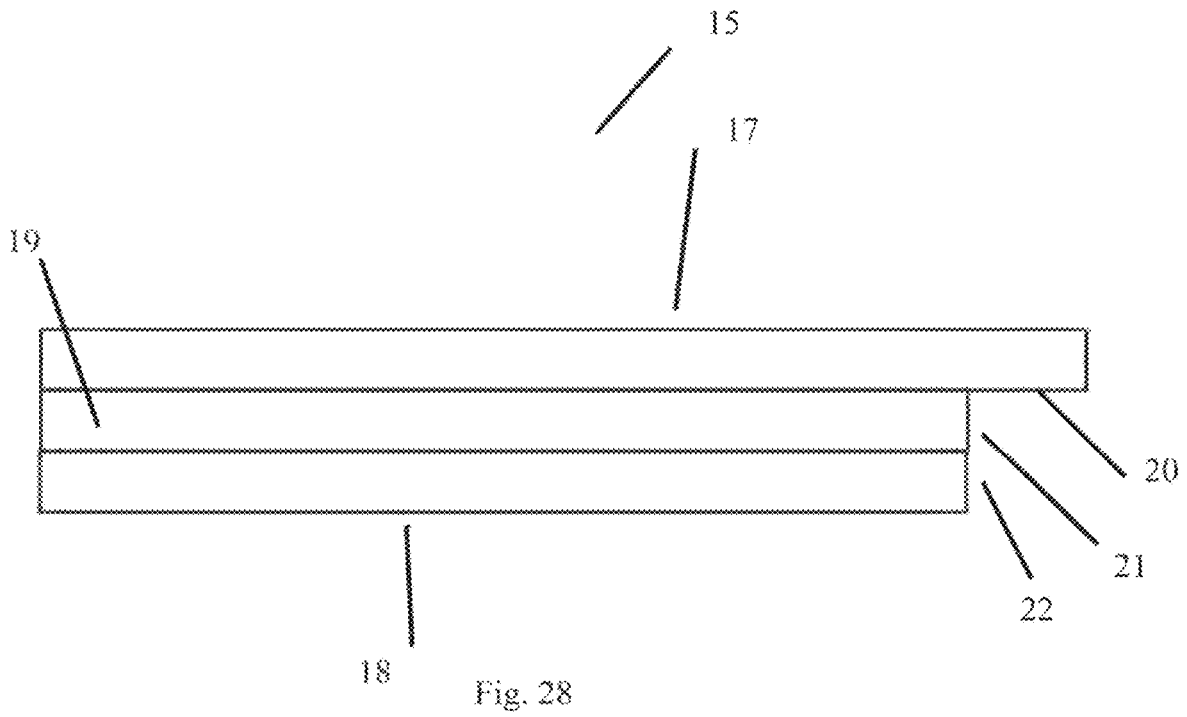
FIG. 28 is an elevation view of an excerpt of a modified structural insulated panel, showing at least one side having an outer skin overhang with a recessed foam core and a recessed inner skin.
Figure 29:
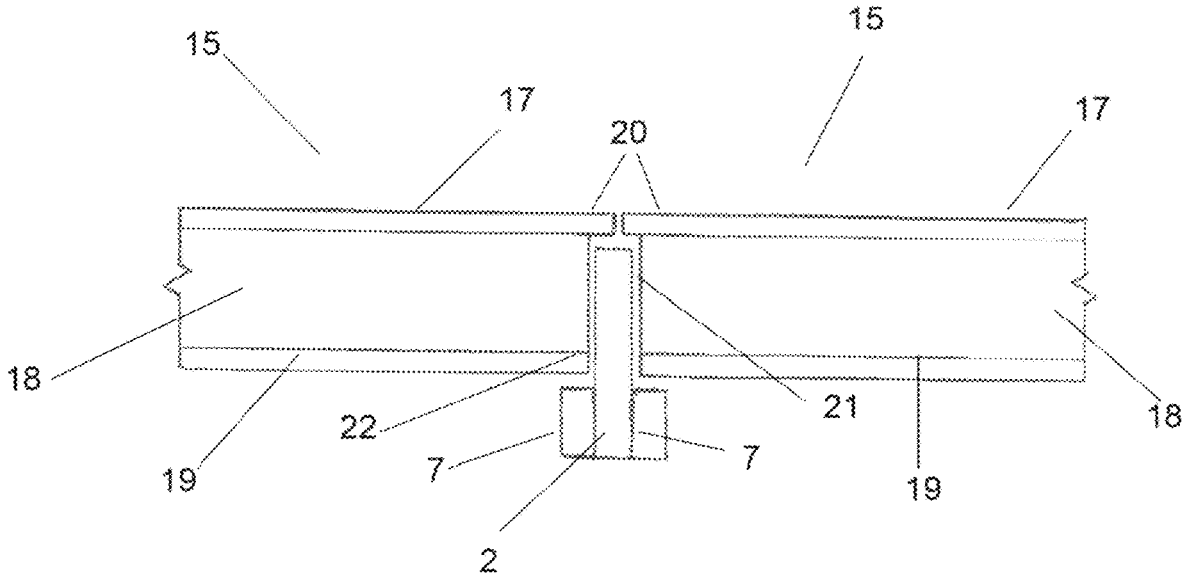
FIG. 29 is another elevation view of the modified structural insulated panels assembled with a spline.
Figure 30:
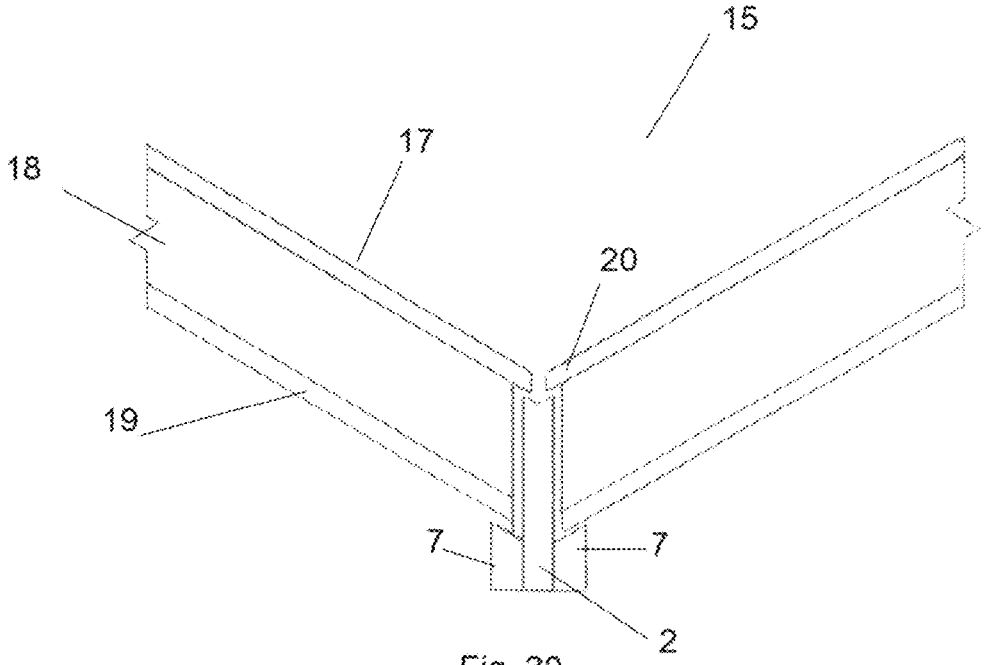
FIG. 30 is another view of the framing assembly in use.
Figure 31:
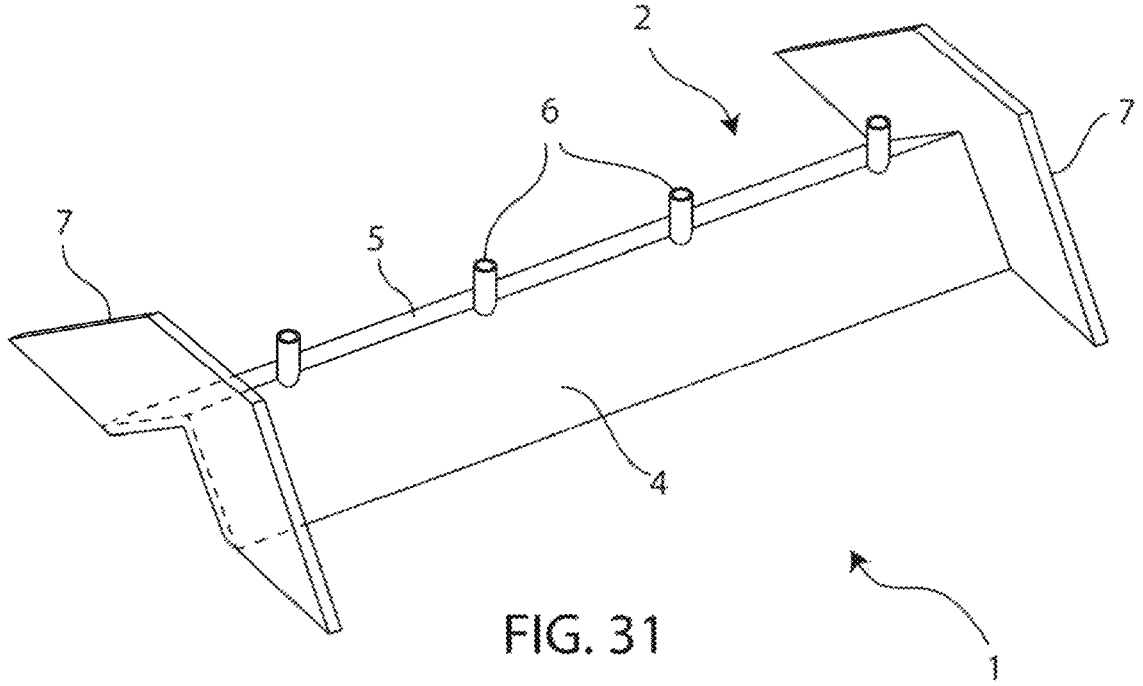
FIG. 31 is a perspective view of another embodiment of the framing assembly, showing a rafter vent assembly.
Figure 32:
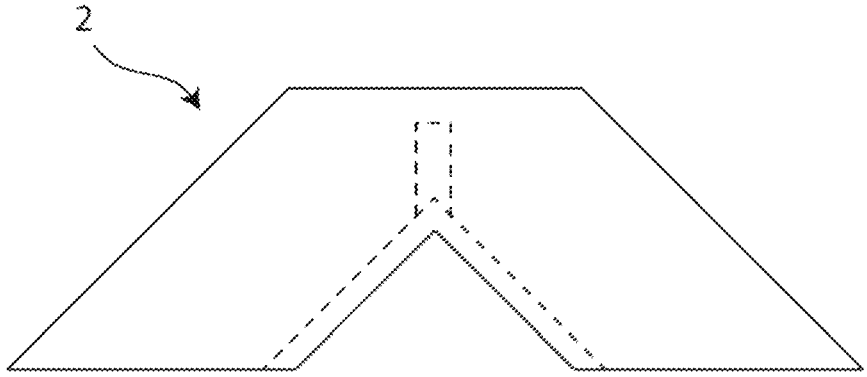
FIG. 32 is a front elevation view of FIG. 31, with the rear elevation view being a mirror image thereof.
Figure 33:
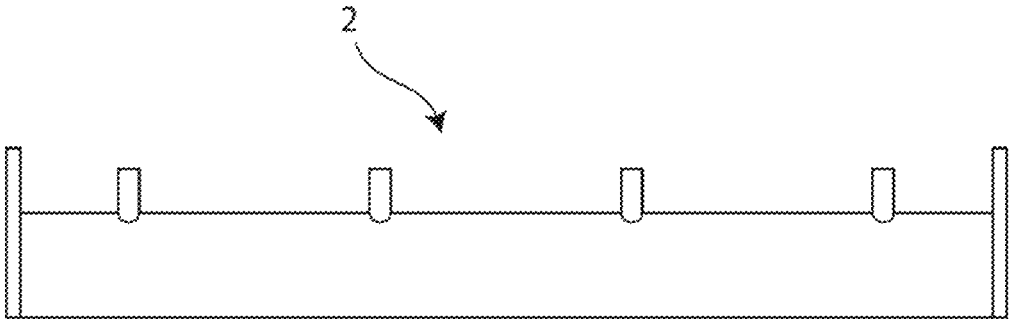
FIG. 33 is a first side elevation view of FIG. 31, with an opposite second side elevation view being a mirror image thereof.
Figure 34:
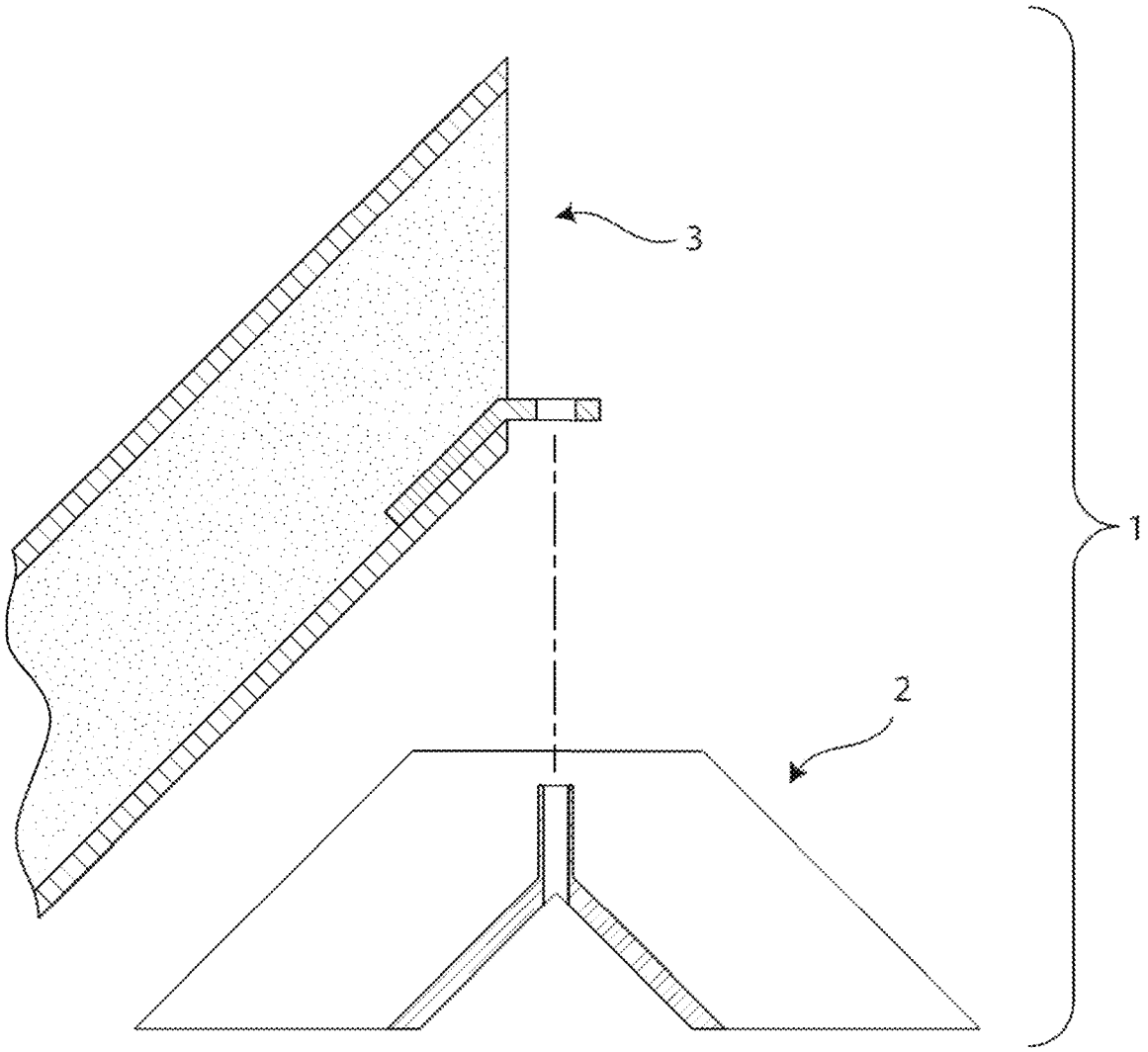
FIG. 34 is a section view of FIG. 31 thereof.
Figure 35:
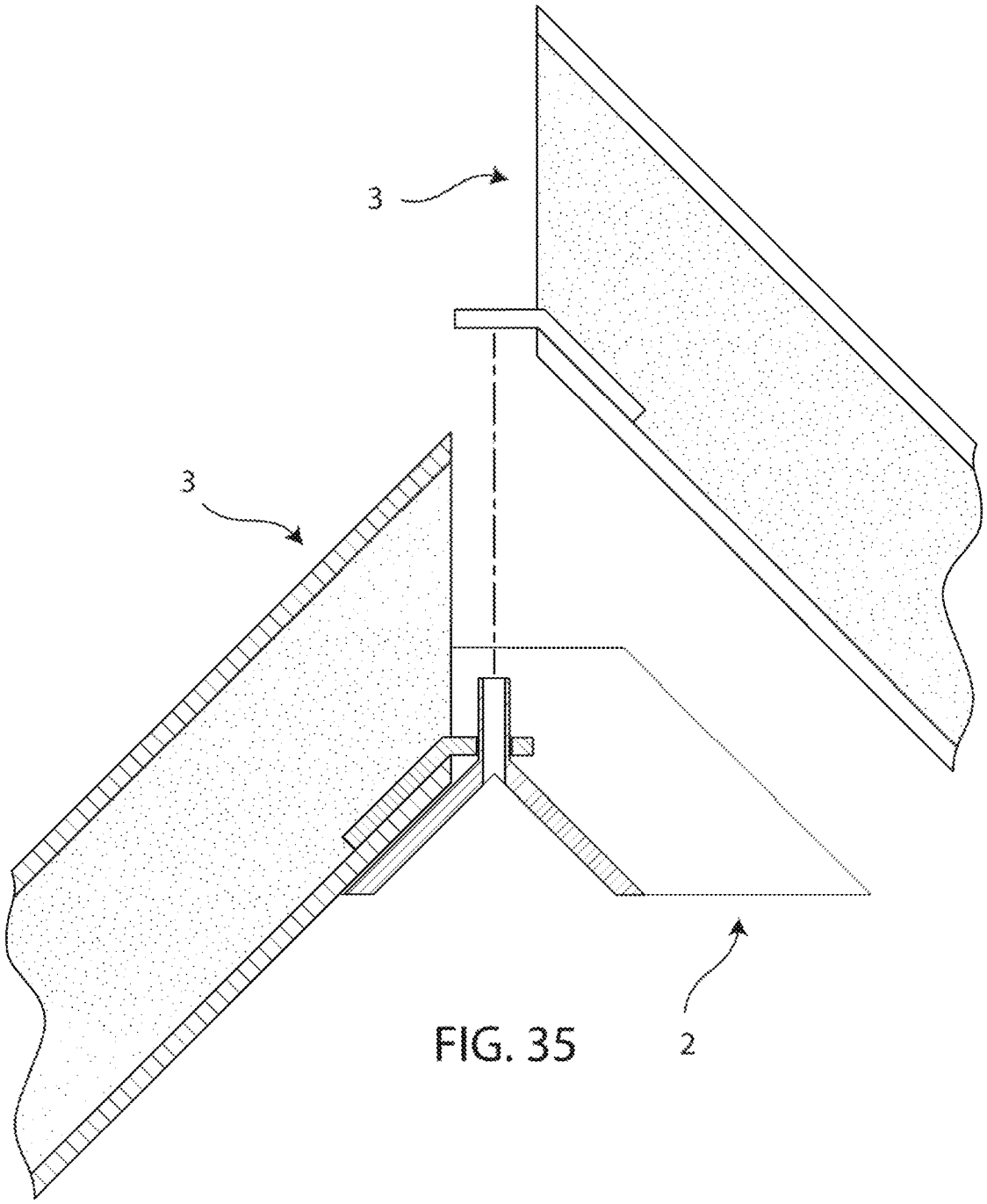
FIG. 35 is another section view of FIG. 31 thereof.
Figure 36:
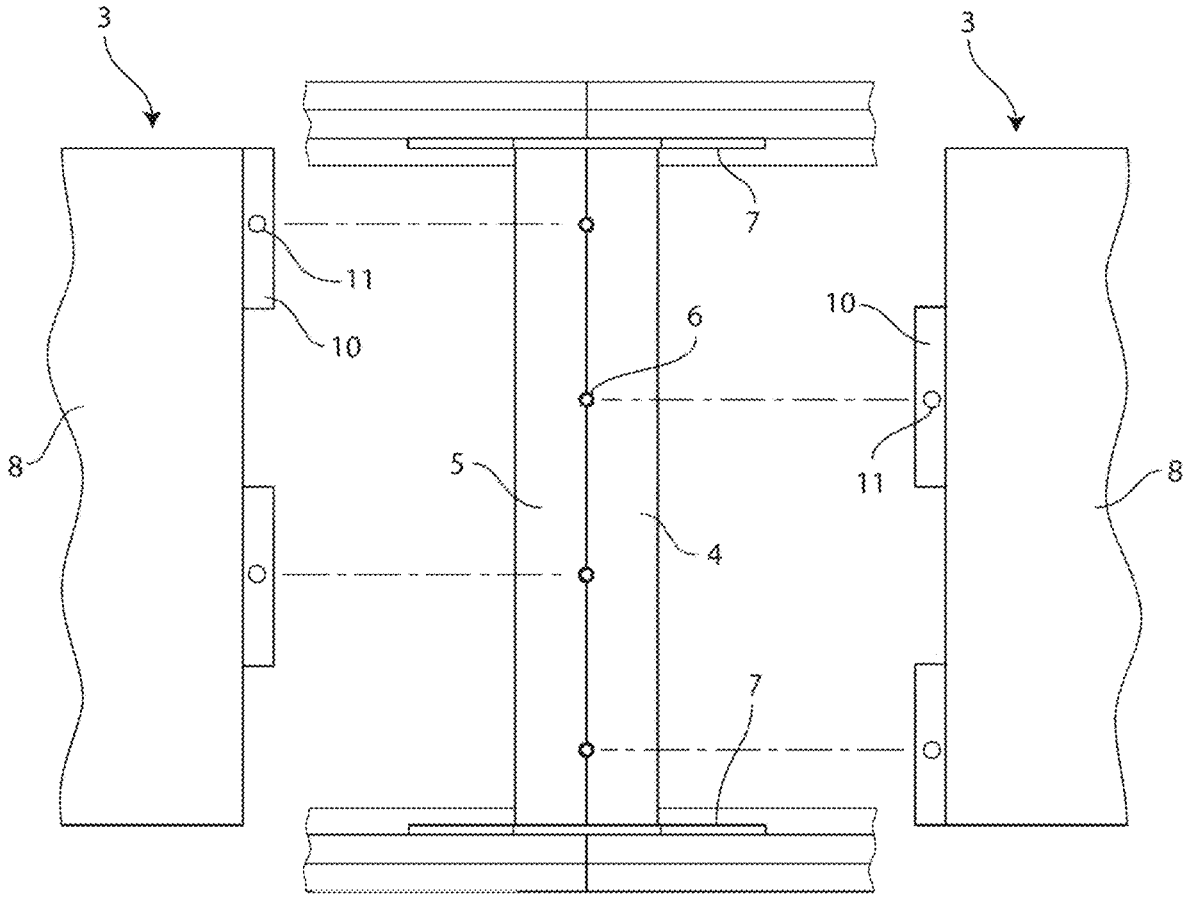
FIG. 36 is a top plan view of FIG. 31 thereof.
Figure 37:
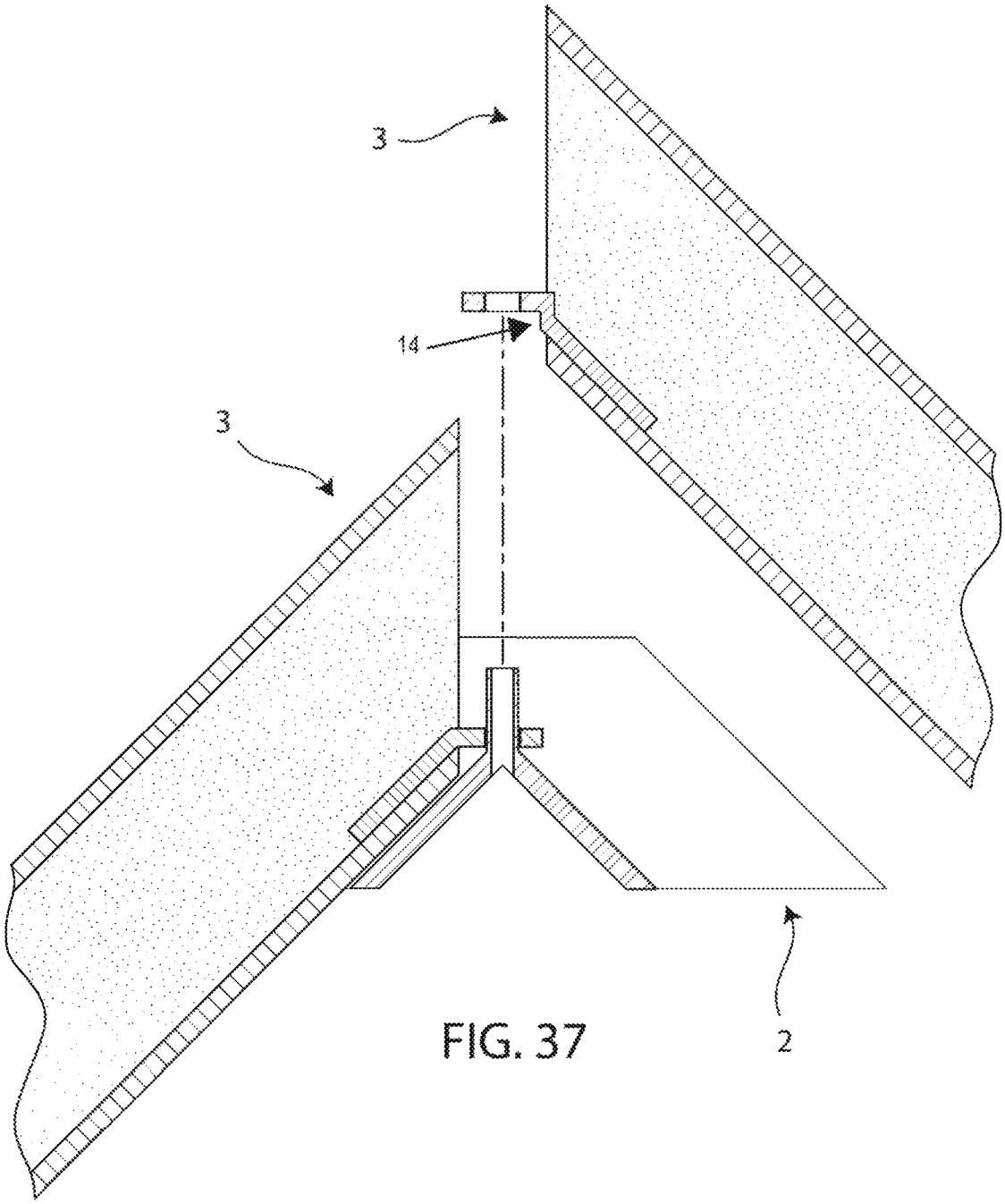
FIG. 37 is a section view of FIG. 41 thereof, showing the opposing brace flanges in a stacked configuration.

As depicted in FIGS. 31-41, each interior rafter vent assembly 1 has at least one brace member 3 and a connecting member 2. As shown in FIG. 36, each interior rafter vent assembly preferably has two brace members 3. When two brace members are used, a first brace member 3 is coupled to a panel (SIP) 12 on a first side of the ridge beam support member (not shown) and a second brace member 3 is coupled to a second panel 12 on a second side of the ridge beam support, forming a peak in the middle. The coupled brace member and panel form an assembled panel-brace member. A bore defined in the brace flange of the first brace member is selectively aligned over and coupled to a corresponding vent tube of the connecting member. A bore defined in the brace flange of the second brace member is selectively aligned and stacked over the bore of the first brace flange. The first panel (SIP) and the second panel (SIP) are considered opposing panels, as reflected in FIG. 35. References to an "assembled panel-brace member" essentially means that a panel has been coupled or otherwise attached to the brace member and the component is ready for further installation onto the appropriate location on the building frame. The brace member provides additional structural support to the ridge rafter beam.

The brace member 3 is essentially an elongated brace body with a lateral end. The lateral end of the brace member 3 is affixed to or otherwise extends from a rear end of the brace flange 10. The brace member is preferably made from steel. Preferably, the brace member is a metal strip. The length of the brace member is preferably substantially the same length as the width of the SIP panel 12. The width of the brace member is less than its length. Each brace member has a length shorter than the length of the connecting plate to assist in assembly of the assembled panel-brace member onto the connecting plate. The width of the brace member is smaller than the width of any side member of the connecting plate. The depth or thickness of the brace member is preferably substantially the same depth as the connecting plate. In one embodiment, the brace member is made from an eleven gauge material. During assembly of the building frame, the brace body of the brace member is positioned over the inner skin of the panel, as shown in FIGS. 34-35 and 37-39. More particularly, the brace member is removably inserted between the inner skin and the core of the panel.

Each brace member 3 of the interior rafter vent assembly 1 has at least one brace flange 10. The brace flange 10 is essentially a flange body having a rear end. The brace flange further defines at least one bore 11, as shown in FIG. 36. In an embodiment wherein the brace flange is a unitary member having a length substantially similar to the length of the brace member brace body, the unitary brace flange defines a plurality of bores. In an embodiment wherein the brace member has a plurality of brace flange segments, each individual brace flange segment defines a bore. The number, size, and spacing of the plurality of bores correspond to the number of the plurality of vent tubes from the connecting member. The connection point between the lateral end of the brace member and the rear end of the brace flange essentially forms a corner or angle. The angle reflects the desired pitch of the rafter peak and is preferably an obtuse angle. Because the brace member angle is fixed, the user must select a brace member having the requisite angle for the requisite pitch in the roof.

The brace flange is made from the same material as the brace member. The brace flange 10 and the brace member 3 is preferably a unitary structural element, with the brace flange being bent to the requisite angle and configured to the disclosed physical arrangement. When the brace member is coupled to the panel, preferably a SIP, the brace flange extends outwardly from both the brace member and the panel, and the brace flange is essentially unencumbered.

Figure 41:
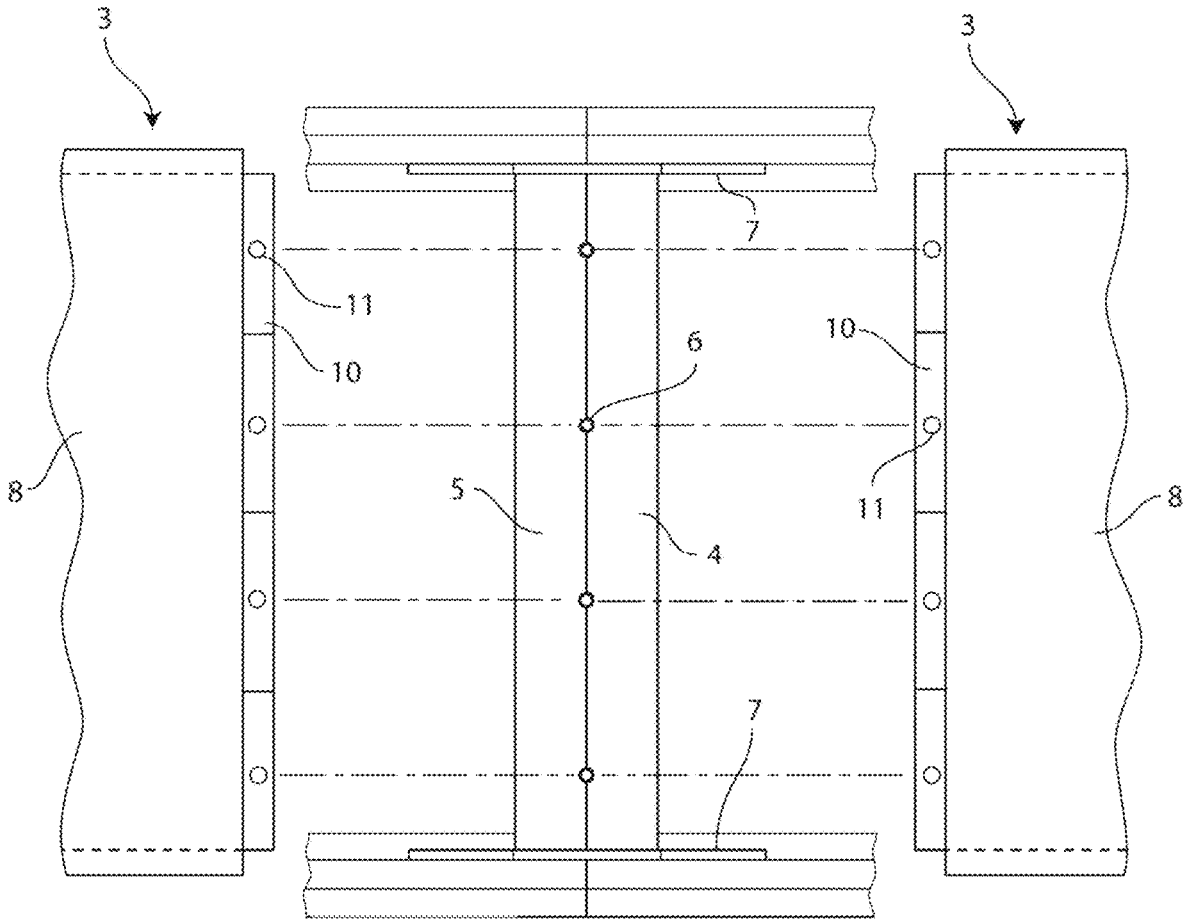
FIG. 41 is a top plan view of FIG. 37 thereof.
Figure 42:
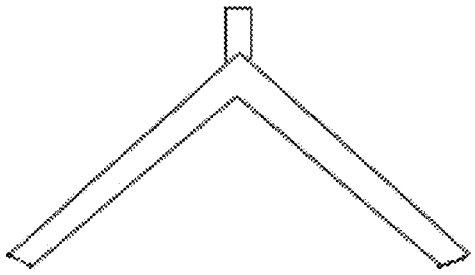
FIG. 42 is a front elevation view of another embodiment of the framing assembly, showing an external connecting member, with the rear elevation view being a mirror image thereof.
Figure 43:
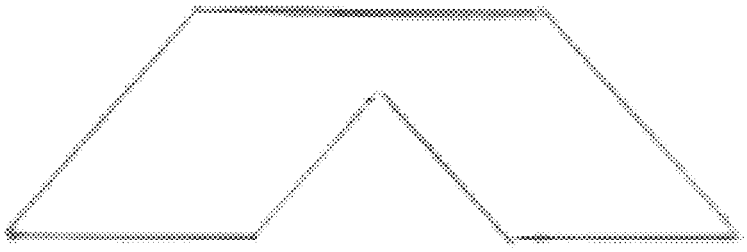
FIG. 43 is a front elevation view of FIG. 42, showing an end plate, with the rear elevation view being a mirror image thereof.
Figure 44:
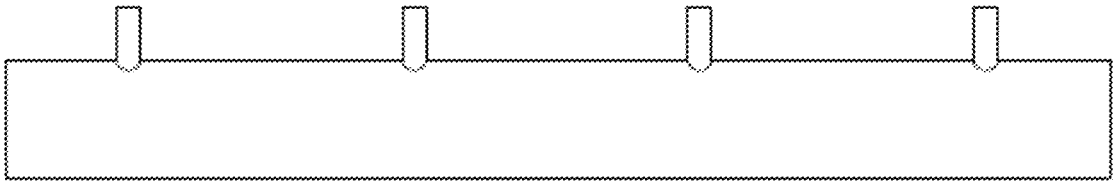
FIG. 44 is a side elevation view of FIG. 42 thereof, with an opposite second side elevation view being a mirror image thereof.
Figure 45:
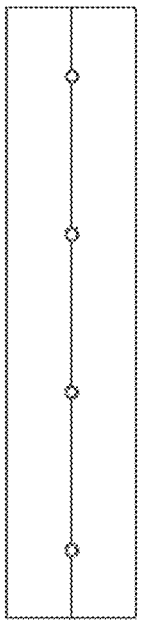
FIG. 45 is a top plan view of FIG. 42 thereof.
Figure 46:
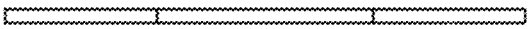
FIG. 46 is a top plan view of FIG. 43 thereof.
Figure 47:
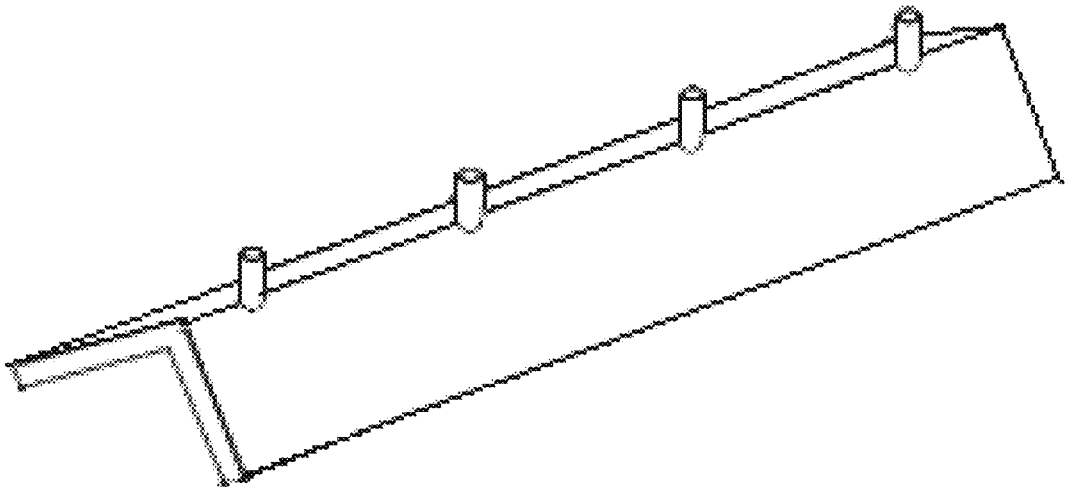
FIG. 47 is a perspective view of FIG. 42 thereof.
Figure 48:
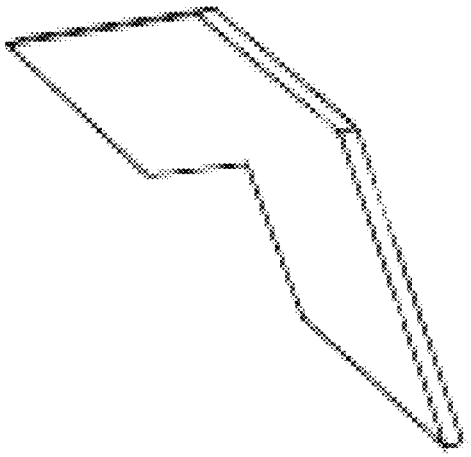
FIG. 48 is a perspective view of FIG. 43 thereof.

In one embodiment of the brace flange shown in FIG. 41, the brace flange 10 is substantially the same length as the brace member 3, and is a single, continuous, unitary brace flange. Here, rafter vent assembly has a first brace member and a second brace member. The first brace member comprises a unitary brace flange 10 that defines a plurality of bores 11. Each of the individual bores 11 is spaced along the length of the brace flange 10 of the first brace member. The second brace member comprises a riser 14 and a unitary brace flange 10. The riser 14 is upstanding from the brace body of the brace member 3 and extends to the unitary brace flange. The unitary brace flange defines a plurality of bores 11. Each of the individual bores 11 is spaced along the length of the brace flange 10 of the second brace member. During assembly, each of the plurality of bores of the first brace member is selectively aligned over and coupled to each of the plurality of vent tubes to connect the first brace member, and thereby the assembled first panel, to the connecting member. The second brace flange from an opposing second assembled panel-brace member is stacked onto the first brace flange and coupled to an upper part of the plurality of vent tubes. See FIG. 37. The riser of the second brace member keeps the second panel from having too high a profile when the second assembled panel-brace member is stacked on top the first assembled panel-brace member. The riser 14 of the second brace member 3 accommodates sitting over the lower, first brace flange. A benefit for this unitary brace flange arrangement is the assembled panel-brace member are held into place, which in turn increases efficiency and speed when erecting the roof structure.

Figure 38:
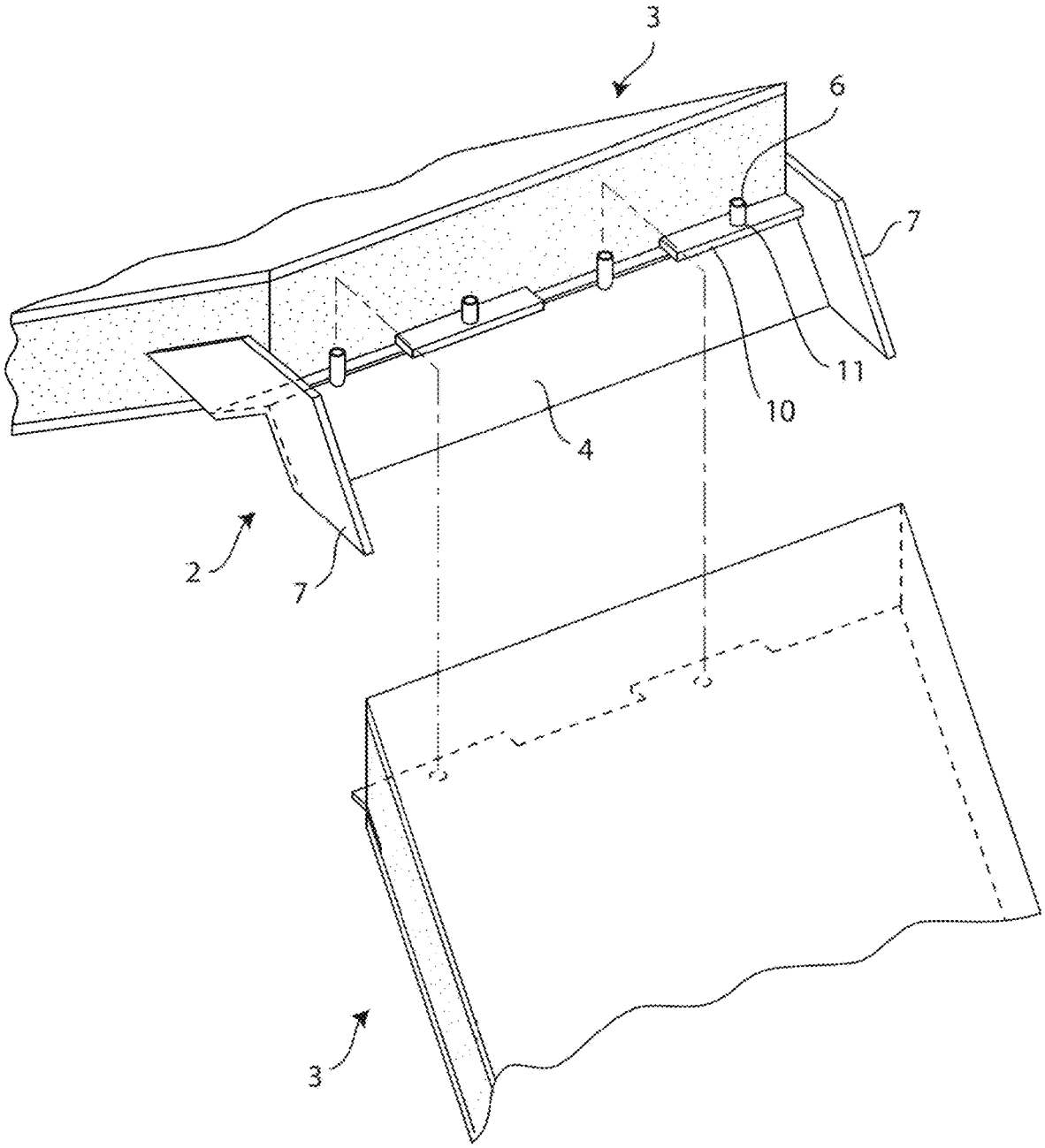
FIG. 38 is a perspective view of FIG. 31, showing installation of SIPs coupled to the vent tubes.
Figure 39:
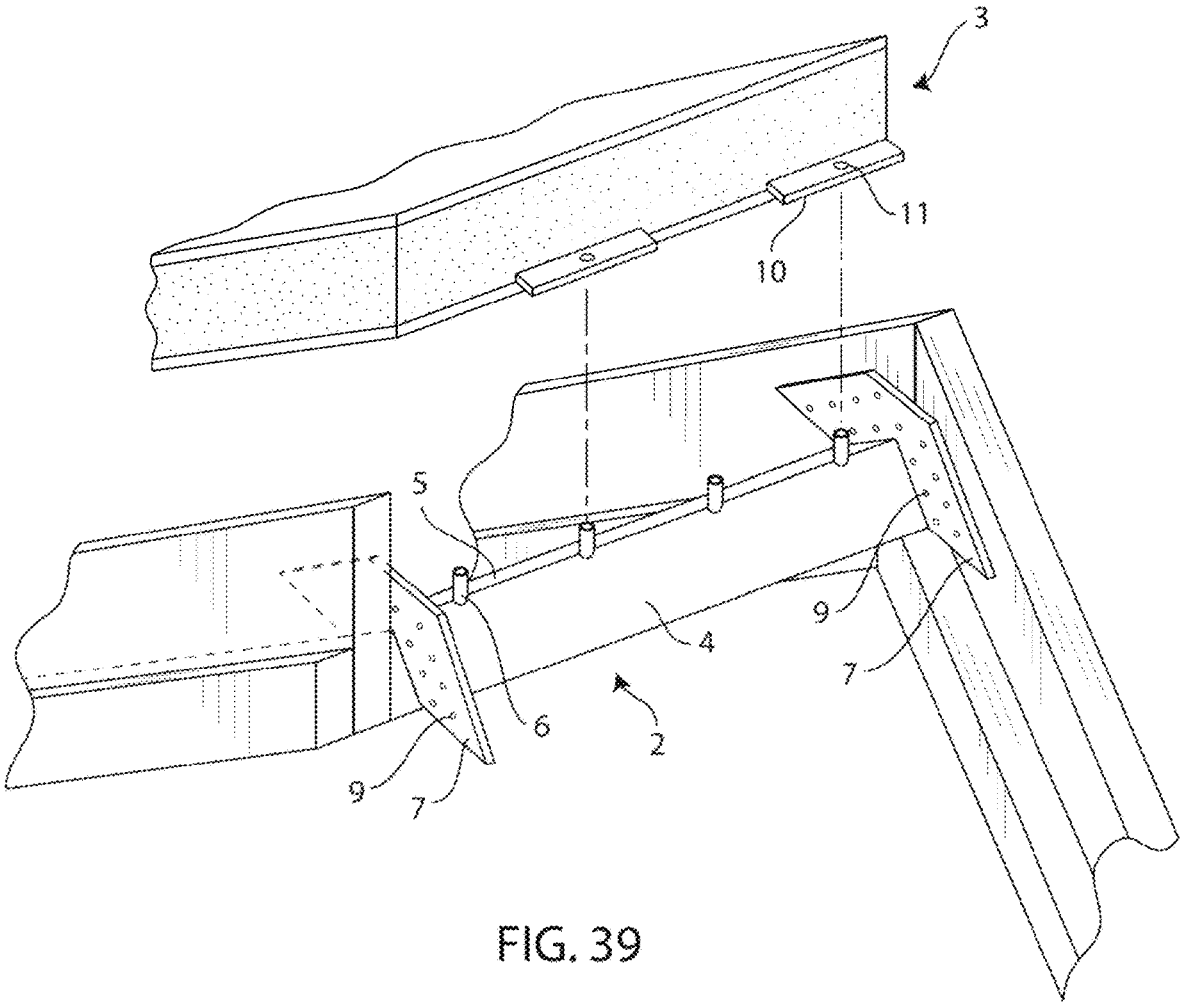
FIG. 39 is another perspective view of FIG. 31, showing installation of SIPs coupled to the vent tubes.

In another embodiment of the brace flange shown in FIG. 36, the brace flange further defines spaced apart gaps along the length of the brace flange that separate the brace flange into essentially a plurality of brace flange segments. Each brace flange segment 10 defines a single bore 11 therethrough. The brace flange segments 10 are affixed to the brace member. The brace flange segments are spaced along the lateral end of the brace member 11. As shown in FIGS. 34-36, an end portion of the brace flange may be absent due to the placement or arrangement of the gaps separating the brace flange segments. This gap may give the illusion that the length of the entire brace flange is shorter than the brace member length. The gaps between the brace flange segments allow intermediate coupling with the plurality of vent tubes to allow a flush overall assembly of the two assembled brace members, as shown in FIGS. 36 and 38-39. When a plurality of brace flange segments is used, the plurality of brace flange segments for a first assembled panel-brace member is coupled to respective alternating vent tubes of the plurality of vent tubes of the connecting member. The plurality of brace flange segments for a second assembled panel-brace member is coupled to the remaining alternating vent tubes of the plurality of vent tubes on the connecting member. See FIGS. 36 and 38-39.

The brace member may further include a plurality of brace fasteners (not shown). The plurality of brace fasteners for the brace member may be selected from the group consisting of bolts, screws, or adhesives. Screws are the preferred brace fastener. The brace fasteners fasten the brace member to the SIP panel during assembly. The amount and type of brace fasteners depend on the desired length of the brace member.

The connecting member of the interior rafter vent assembly has two end plates, a connecting plate, and a plurality of vent tubes. The connecting member connects the assembled panel-brace members to the rafter splines and to the ridge rafter beam.

Figure 40:
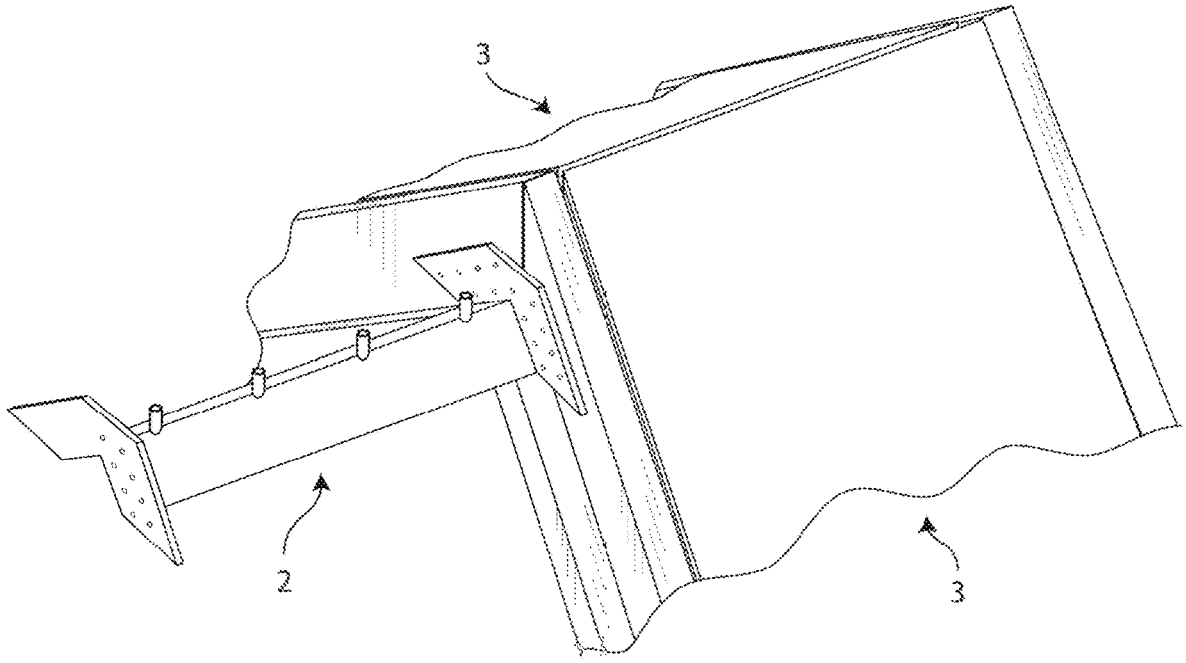
FIG. 40 is is another perspective view of FIG. 31, showing SIPs installed between rafter splines, and showing another tube vent installed adjacent thereto.

Each end plate of the connecting member of the interior rafter vent assembly has an outer surface and an inner surface. In one embodiment of the end plates shown in the FIGS. 31-41, each end plate is a substantially trapezoidal end plate having top and a bottom with an inverted V-shaped recess. The top of the end plate has as height shorter than the height of the rafter spline support member to which it abuts. The inverted recess in the bottom of the end plate has an angle, length, and width corresponding to the angle of the bend in the connecting plate. The bottom of the end plate fits into a slot cut in the bottom flanges of the rafter beams (rafter splines). Each end plate is preferably made from steel. As shown in FIGS. 39-40, the outer surface of each of the end plates secures the connecting member to the respective rafter spline sections. The outer surface of each of the end plates abuts the joined opposing rafter splines support members, with the bottom of the end plates abutting the spline rafter flange. The inner surface of each of the end plates is affixed to and abuts a respective end of the connecting plate. Exposed sections of the inner surface of the end plate abuts against an installed assembled panel-brace member. The top of the end plates does not extend above the top of the rafter beams or above the top of the SIP. When the assembled panel-brace member is installed over the connecting member, the brace flange, whether unitary or segmented, has a length substantially similar to the length of the connecting plate to accommodate installation between the end plates. See FIG. 36.

Each end plate may further include a plurality of apertures therethrough and a plurality of connecting fasteners. During installation, the inverted recess of the end plate rests on top of the respective rafter spline flange as it abuts against the inner side of the rafter spline support member. A plurality of connecting fasteners is inserted through the plurality of apertures of the end plate to fasten the end plate to the rafter spline support member. The plurality of connecting fasteners may be screws or bolts. Sex bolts are preferred and are countersunk through the end plate apertures to become flush with the surface of the end plate. Alternatively, or additionally, the plurality of connecting fasteners may further include an adhesive applied to each end plate so that the end plate is further adhered to the top of the rafter spline flange. Using an adhesive depends on whether the end plates are attached to the rafter spline support members to the truss plates connecting opposing spline members.

The connecting plate of the connecting member of the interior rafter vent assembly has two side members that are configured to form a peak. The connecting plate is preferably a unitary, continuous connecting plate that is bent downwardly and longitudinally into the two side members at the selected and desired angle, pitch, or peak that corresponds to the pitch of the building frame. The angle of the peak in the connecting plate is the same angle that the opposing rafters would form as dictated by the pitch of the roof. Each side member is essentially an elongated substantially flattened bar having a top lateral end, a bottom lateral end, and two opposing ends. The top lateral end of one side member and the top lateral end of the opposing side member of the connecting plate forms the peak. The bottom lateral ends of the two side members form the underside of the peak, which may remain exposed to the interior environment of the building. The bottom of each assembled panel sits over the top of the respective side member of the connecting plate during roof installation.

The connecting plate is preferably made from metal, and more preferably made from steel. The length of the side members is selectively determined by the spacing of the rafters or rafter sections. The width of each side member is approximately 2", with the approximate total width of the connecting plate being approximately 4". The depth or thickness of the side member is approximately $1/16^{th}$ inches. The connecting plate is capable of acting as the ridge rafter beam itself and is positioned between each rafter spline section.

In the embodiment of the exterior rafter vent assembly as depicted in FIGS. 42-50, the exterior rafter vent assembly comprising a connecting member having a connecting plate and a plurality of vent tubes. Here, the connecting plate is positioned over the abutting the outer skins of SIPs at the peak of the roof and is not shown on the interior of the building. In this embodiment, the connecting member lacks the two end plates, and the exterior rafter vent assembly lacks to the brace member. A brace member is not required for the exterior rafter vent assembly because the connecting member is attached directly to the exterior or outer skin of the SIPs. The connecting plate also does not require end plates because the connecting plate is not suspended between the internal rafter spline support members but is instead attached and supported on top of the SIPs directly with a plurality of connecting fasteners. The plurality of vent tubes for the exterior rafter vent assembly remains the same as the plurality of vent tubes for the interior rafter vent assembly. The structure, configuration, and bend of the connecting plate of the exterior rafter vent assembly remains the same as the connecting plate of the interior rafter vent assembly.

Each of the plurality of vent tubes of the connecting member of both the interior and exterior rafter vent assemblies has opposing ends. The vent tubes are essentially spaced apart along the length of the side members of the connecting plate. The vent tubes are upstanding from or substantially close to the peak in the connecting plate. In the embodiment for the interior rafter vent assembly, the vent tubes with the connecting plate are located at the apex or peak of the interior of the building. In the embodiment for the exterior rafter vent assembly, the vent tubes with the connecting plate are located above the SIPs at the apex or peak of the exterior of the building. Each end of the vent tube defines an opening to allow air flow to enter or to leave the building structure. Each vent tube is essentially made from ½ inch steel tubing. In one embodiment, each vent tube is upstanding from within a corresponding plurality of holes therethrough. The plurality of holes are essentially ventilation holes within which the plurality of vent tubes is seated.

Figure 49:
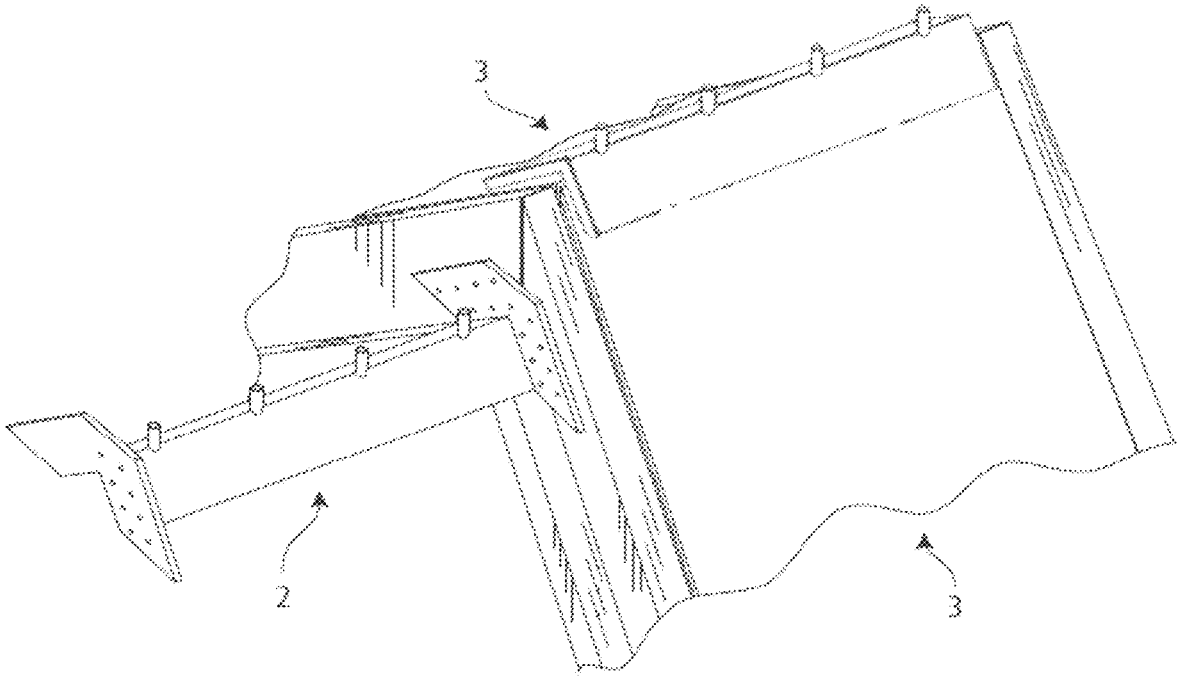
FIG. 49 is a perspective view of FIGS. 40 and 42, showing the interior connecting member in use and the external connecting member in use, respectively.
Figure 50:
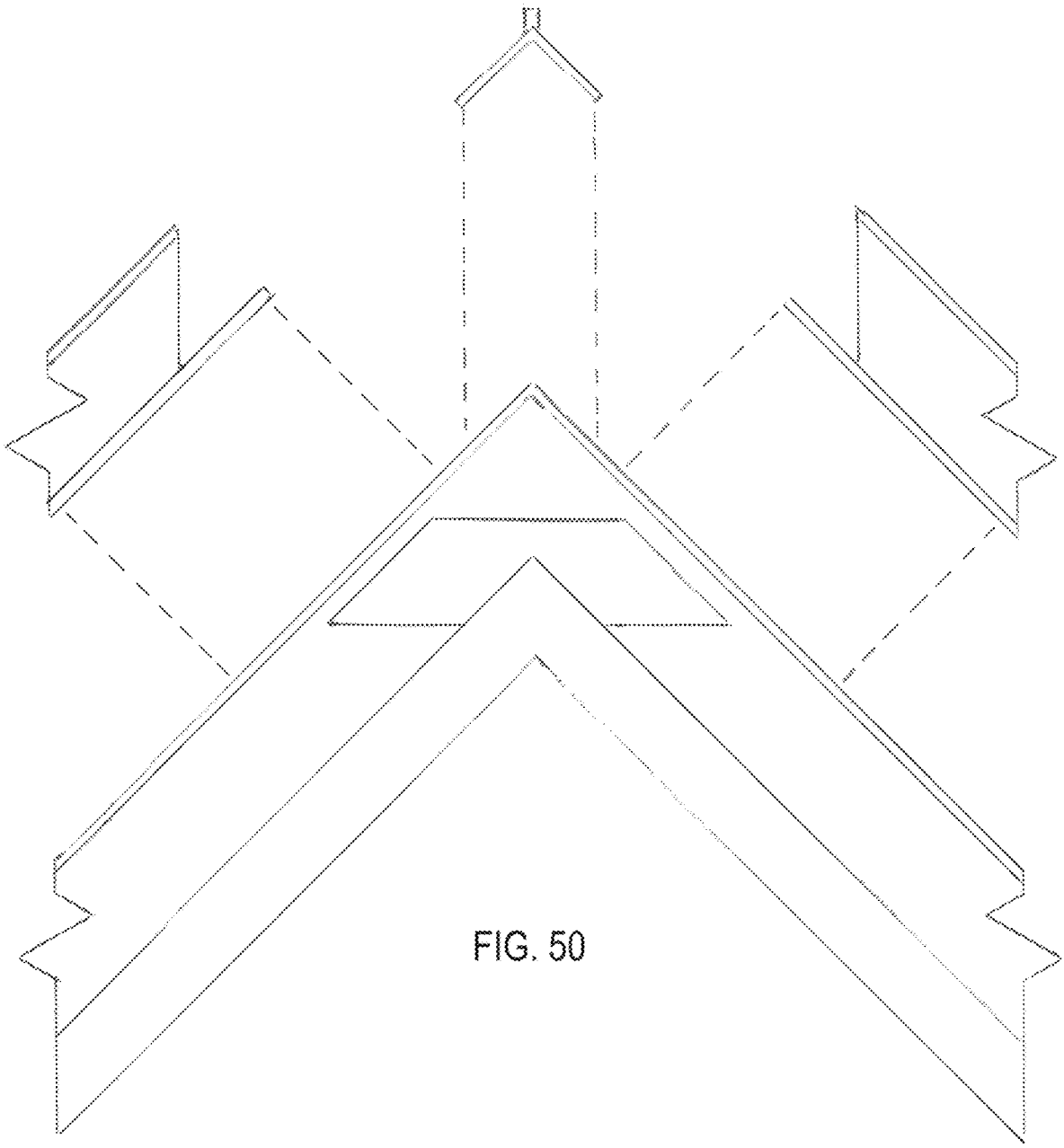
FIG. 50 is another front elevation view of FIGS. 42 and 43, shown in use.

The requisite number of vent tubes are arranged on or near the peak (or apex) of the connecting plate, then a corresponding number of holes are made in the connecting member and the vent tubes are inserted therein for a snug fit. The quantity of vent tubes depends on the amount of ventilation required for the building structure. For example, as shown in FIG. 49, a set of four vent holders are spaced apart on each connecting member for every approximate four foot length of the roof rafter line. The vent tubes may be fastened to the connecting plate by welding. The length of each vent tube is preferably longer than the thickness of the connecting plate and is preferably shorter than the height of the end plate. The length of the vent tube should be of sufficient length at least to accommodate stacking of one or more brace flanges and selectively variable seating distance within the hole defined in the connecting plate. The vent tube may be made of metal.

The vent tubes dual purpose includes venting the excess moisture and holding the opposing roof panels (SIPs) in place during assembly. The placement and placement of the vent tubes at the apex of the building utilizes a vapor buoyancy effect to vent the moist stale air outside. The intake of drier fresh air can be metered and controlled so it does not impact the interior temperature within the building.

The connecting member of the interior rafter vent assembly and of the exterior rafter vent assembly may further include a plurality of extender tubes. For the interior rafter vent assembly, the extender tubes increase the overall length of the vent tubes beyond the panel to the exterior environment. For the exterior rafter vent assembly, the extender tubes increase the overall length of the vent tubes beyond any supplemental exterior structural layers installed on top of the exterior connecting plate. Each extender tube has an upper portion that is exposed above the roof of the frame. The extender tube has a wider diameter than the vent tube so that the extender tube can be slidably inserted over the vent tube. The extender tubes are preferably made rigid plastic. This material is preferable because it will not transfer the heat between the metal plates and the exterior environment, and, for interior connecting plates, the extender tubes will not be crushed by expanding foam of the SIPs.

At least one panel (SIP) has an outer skin, a core, and an inner skin. The core is located between the outer skin and the inner skin. The core is preferably a foam core. For the interior rafter vent assembly, the brace member is insertable between the inner skin and the core then fastened together with the plurality of brace fasteners. Each brace member has substantially the same length as the width of the at least one panel to which it is fastened. The outer skin of the modified SIP panel may be approximately 1½ inches wider (or ¾ inches wider on each side of the outer skin) than the core and the inner skin of the modified SIP. For the exterior rafter vent assembly, the roof panels (SIPs) are positioned so that an approximate ½ inch space is centered at the peak or apex of a vaulted ceiling of the building structure when the exterior connecting plate is installed on top of the outer skin of the SIPS. End plates are not affixed to the exterior connecting plate.

To further insulate any spacing gaps between the installed panels and/or the peak of the frame, a high compressive strength expanding polystyrene foam or other insulating material can be applied to further minimize air leakage. This foam preloads the roof SIPs and adds additional strength to the structure. When expandable foam is used after the roof SIPs are secured, the expandable foam is sprayed into any gaps between the roof SIPs preloading the rafter vent assembly.

During installation or construction, the bottom of wall panels are positioned and secured on top of a bottom framing plate. The framing bent is then positioned with the bottom of the wall splines abutted against the bottom of the foam core of a wall panel (SIP) and on top of the bottom framing plate. The framing bent is raised by lifting the rafter spline portion of the framing bent upward while keeping the bottom of the wall splines resting on top of the bottom framing plate. Once raised, the framing bent is upstanding perpendicular to the bottom framing plate. The framing bent is then secured to the wall SIPs with half of a cross section of a wall spline that protrudes from a wall SIP. Another set of opposing wall panels are placed on the bottom framing plate and are slid against an exposed cross section of the wall spline and secured. Another framing bent is assembled, and the process is repeated until the building structural framing is completed.

After the building frame is raised, any remaining SIP wall panels that were yet to be assembled are then positioned and secured into place. The soffit is secured into place and pulled taut against the wall SIPs, then adhered and mounted to the bottom of the lookouts. Conventional dimensions for the soffit may have an approximate 24 inch width and an approximate ½ inch thickness. With this invention, a soffit extension extends beyond the length of the lookout and the extended rafter spline (or roof tail) by approximately ½ inches. A grooved member fascia may cover the ½ soffit extension and is fastened to the outer edge of the extended rafter spline (or roof tail). The grooved member may be a 2×4 or 2×6 or 2×8 wood member. The combination of the fascia and the soffit essentially becomes a load bearing beam. The length of the soffit is selectively determined by the placement of the framing bents that have rafter ties. This framing configuration strengthens the frame to support heavier loads.

The invention further provides an arrangement whereby a rafter spline is attached to the top of a wall stud or spline with the end of the rafter tail extending beyond the exterior of the building to form an eave. The end of the rafter spline is then attached to a lookout, which is fastened to the wall stud or spline through the use of truss plates or med plates. This assembly strengthens and stiffens the bents, thereby assisting in the raising of the bents.

After the above bent is raised into place, a piece of OSB is fastened to the underside of the lookout to form a soffit that extends beyond the length of both the lookout and the extended rafter spline (or other roof tail) by approximately ½ inches. A fascia header is then attached to the ends of the rafter tails. The fascia board is grooved to accommodate the soffit overhang. With the soffit acting as a beam, alternating wall splines are in tension and compression due to the thrust loads generated by the roof. The bents with a rafter tie forming a truss have no thrust loads while the bents with no rafter ties have outward thrust that must be addressed. If the ties are connected to each other with a soffit beam, the bents with rafter ties assist the bents without them. All of the thrust load is carried by the rafter ties in the form of tension load. Since some wall splines experience tension through the lookout, the lookout is fastened with the truss plate or mend plate. This same arrangement can be applied to stick framing. With proper spacing at the ends or joints of the soffit correlating with bents having the rafter ties, the soffit acts as a beam to carry part of the roof load. The soffit also stiffens the wall to withstand against high wind loads.

In another embodiment, a framing assembly for a roof of a building frame, the framing assembly comprising (including or has): at least one rafter vent assembly comprising a connecting member comprising a connecting plate and a plurality of vent tubes, with the connecting plate of the connecting member comprising two side members configured to form a peak, with the peak of the two side members of the connecting plate being selectively determined at an angle based on a desired pitch of the roof of the building frame, and with each of the plurality of vent tubes of the connecting member upstanding from the connecting plate; wherein the connecting member is coupled at an apex of two abutting roof panels of the building frame, with the plurality of vent tubes of the connecting member providing supplemental ventilation and air circulation to allow venting of excess moisture from inside the building frame to an exterior environment, to minimize ridge rot, and to provide supplemental support to the building frame.

In yet another embodiment, a framing assembly is provided for a roof of a building frame. Here, the framing assembly comprises (includes or has) at least one interior rafter vent assembly, each of the at least one interior rafter vent assemblies comprising:

1. two brace members, each of the two brace members comprising a brace body and a brace flange; with the brace flange extending from the brace body at an angle that is selectively determined by the desired pitch of the roof of the building frame, with the brace flange defining at least one bore therethrough, and with the brace flange extending outwardly from the coupling of the each of the two brace members and the two respective roof panels of the building frame; and with the brace body of each of the two brace members being insertable between a core and an inner skin of two respective roof panels of the building frame and fastened thereto to form an assembled panel-brace member; and 2. a connecting member comprising two end plates, a connecting plate, and a plurality of vent tubes; with each of the two end plates being affixed to and sandwiching opposing ends of the connecting plate, and with each of the two end plates being fastened to a respective roof rafter spline support member section of the building frame and abutting against respective opposing ends of the roof panel of the assembled panel-brace members; with the connecting plate comprising two side members configured to form a peak, with the peak of the connecting plate being selectively determined at an angle based on a desired pitch of the roof of the building frame, and with each of the plurality of vent tubes upstanding from the connecting plate;
3. wherein the connecting member is coupled underneath the apex of two abutting assembled panel-brace members of the building frame, with each of the at least one bore of the brace flange of the brace member of the assembled panel-brace member being slidably insertable over each of the plurality of vent tubes of the connecting member so that the plurality of vent tubes is positioned between a gap in the apex of two abutting assembled panel-brace members of the building frame; and wherein the plurality of vent tubes of the connecting member provides supplemental ventilation and air circulation to allow venting of excess moisture from inside the building frame to an exterior environment, to minimize ridge rot, and to provide supplemental support to the building frame.

In yet another embodiment, a framing assembly is provided for a roof of a building frame. Here, the framing assembly comprises (includes or has) at least one exterior rafter vent assembly, the at least one exterior rafter vent assembly comprising a connecting member comprising:

1. a connecting plate comprising two side members configured to form a peak, with the peak of the two side members being selectively determined at an angle based on a desired pitch of the roof of the building frame; and with the connecting plate being positioned over an outer skin of two abutting roof panels of the building frame and the apex of the building frame, and attached thereto with a plurality of connecting fasteners; and
2. a plurality of vent tubes, with each of the plurality of vent tubes of the connecting member upstanding from the connecting plate; and with the plurality of vent tubes aligned over the apex of the building frame for supplemental ventilation and air circulation to allow venting of excess moisture from inside the building frame to an exterior environment, to minimize ridge rot, and to provide supplemental support to the building frame.

Figure 53:
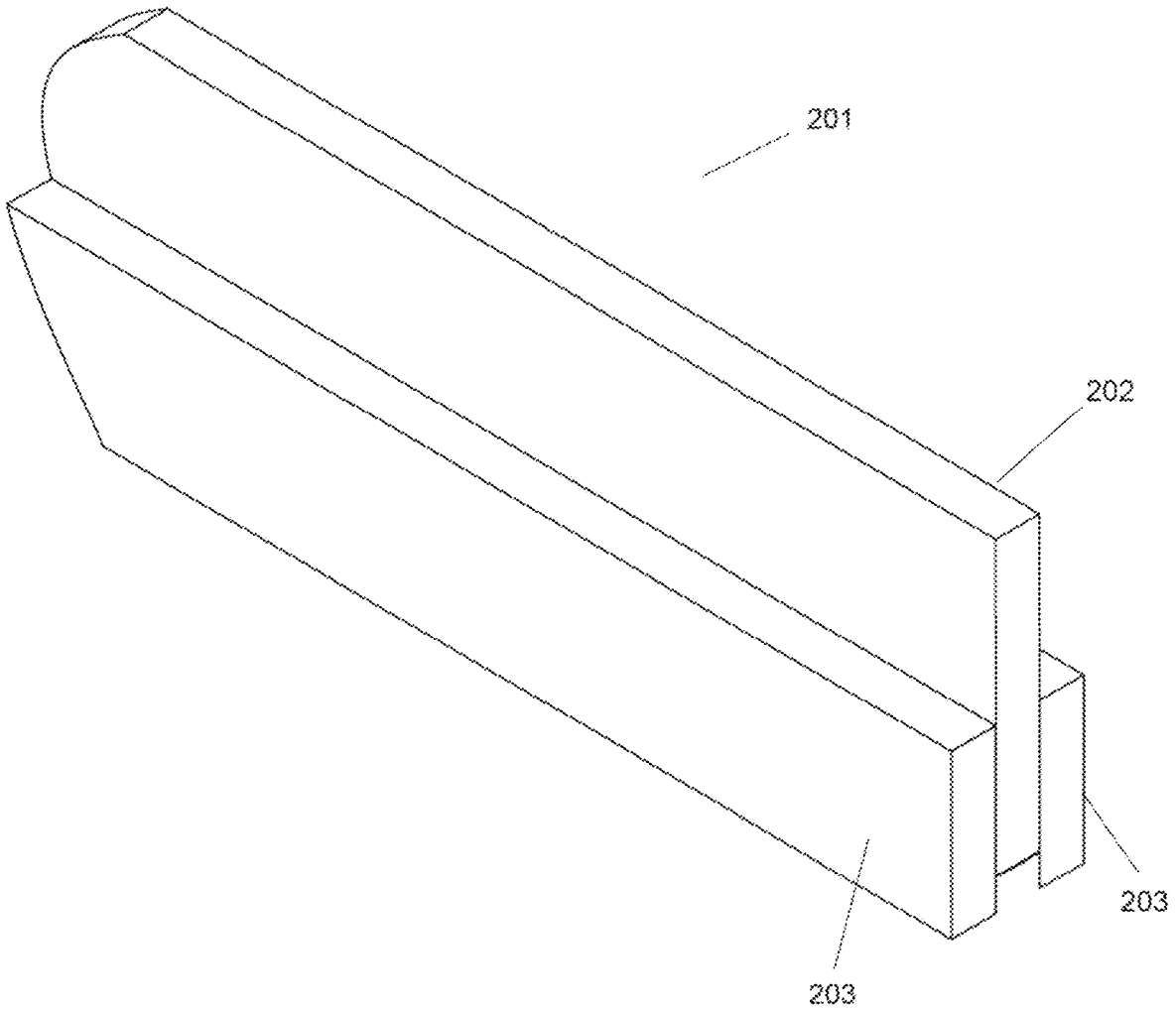
FIG. 53 is a perspective, exploded view of another embodiment of the framing assembly, showing a T-rafter, with the T-rafter having an indeterminable length.

In yet another embodiment as in FIGS. 53-56, the framing assembly has at least one T-rafter spline 201 for use when constructing the roof. In a preferred embodiment, a plurality of T-rafter splines are provided. FIG. 53 depicts that each T-rafter is essentially a rafter spline 1, 101 or a modified T-rafter spline 201. Each of these splines 201 has a support member 202 and a pair of flanges 203. Here, each flange 203 abuts a lateral side of the support member 202 to resemble a T-shaped beam. The support member 202 is flanked by the pair of flanges 203 to form a lower, distal, and bottom portion of the T-rafter spline. An upper, proximal, or top portion of the T-rafter spline 201 is the support member 202. This upper portion of the T-rafter spline 201 has a width smaller than a width of the lower portion of the T-rafter spline 201 due to the pair of flanges 203 sandwiching the lower portion of the support member 202. In the embodiment shown in FIGS. 53-56, the bottom of the flanges 203 are not flush with the bottom of the support member 202, thereby defining a longitudinal slot between the bottom of the support member 202 and the two flanges 203.

Each T-rafter spline 201 is manufactured by applying an adhesive to one lateral side of each of the two flanges 203, sandwiching a lower portion of the support member 202, and applying pressure to assure good adhesion. Each flange 203 may be a dimensional lumber board. The support member 202 may be structural composite lumber (SCL). The positioning of the flanges 203, 7 with respect to the SCL beam or support member 202 is dependent upon the application of use. The positioning of the flanges also affects the load bearing capacity of the T-rafter spline. The greater distance from the top of the web or support member to the top of the flange, the greater the load bearing capacity of the T-rafter spline. This distance is limited by the required surface area of the flanges to maintain adequate adhesion to the support member SCL.

Figure 54:
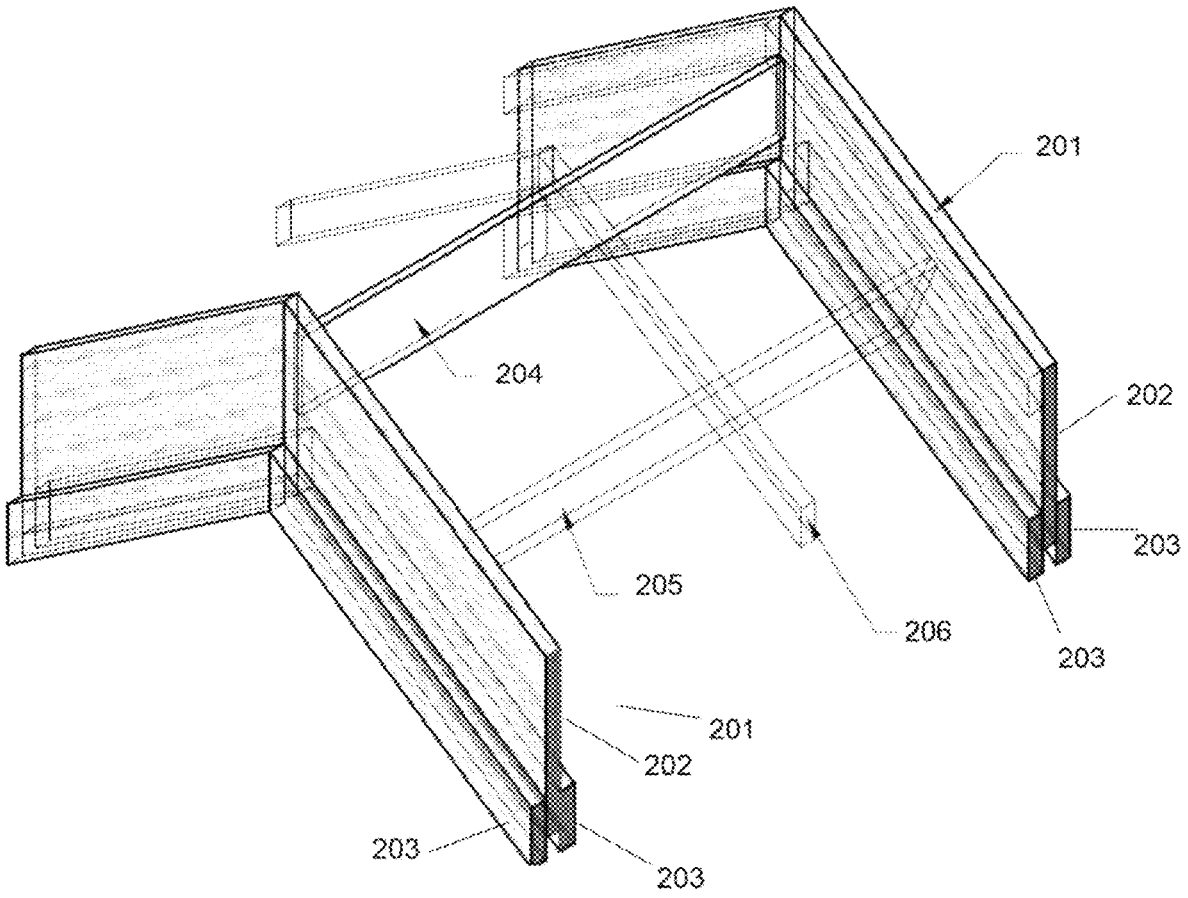
FIG. 54 is another perspective, exploded view of FIG. 53, showing the T-rafter assembled for dimensional lumber construction.
Figure 55:
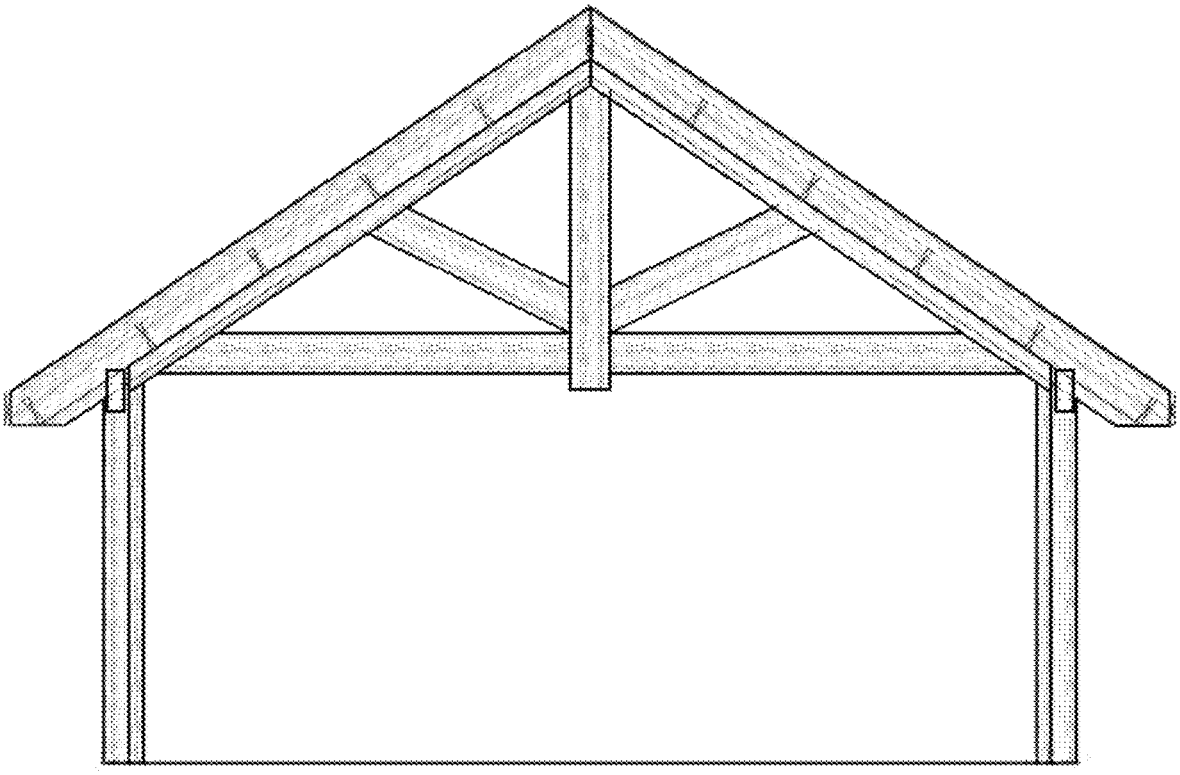
FIG. 55 is a front elevation view of FIG. 53 of a T-rafter in a bent configuration.
Figure 56:
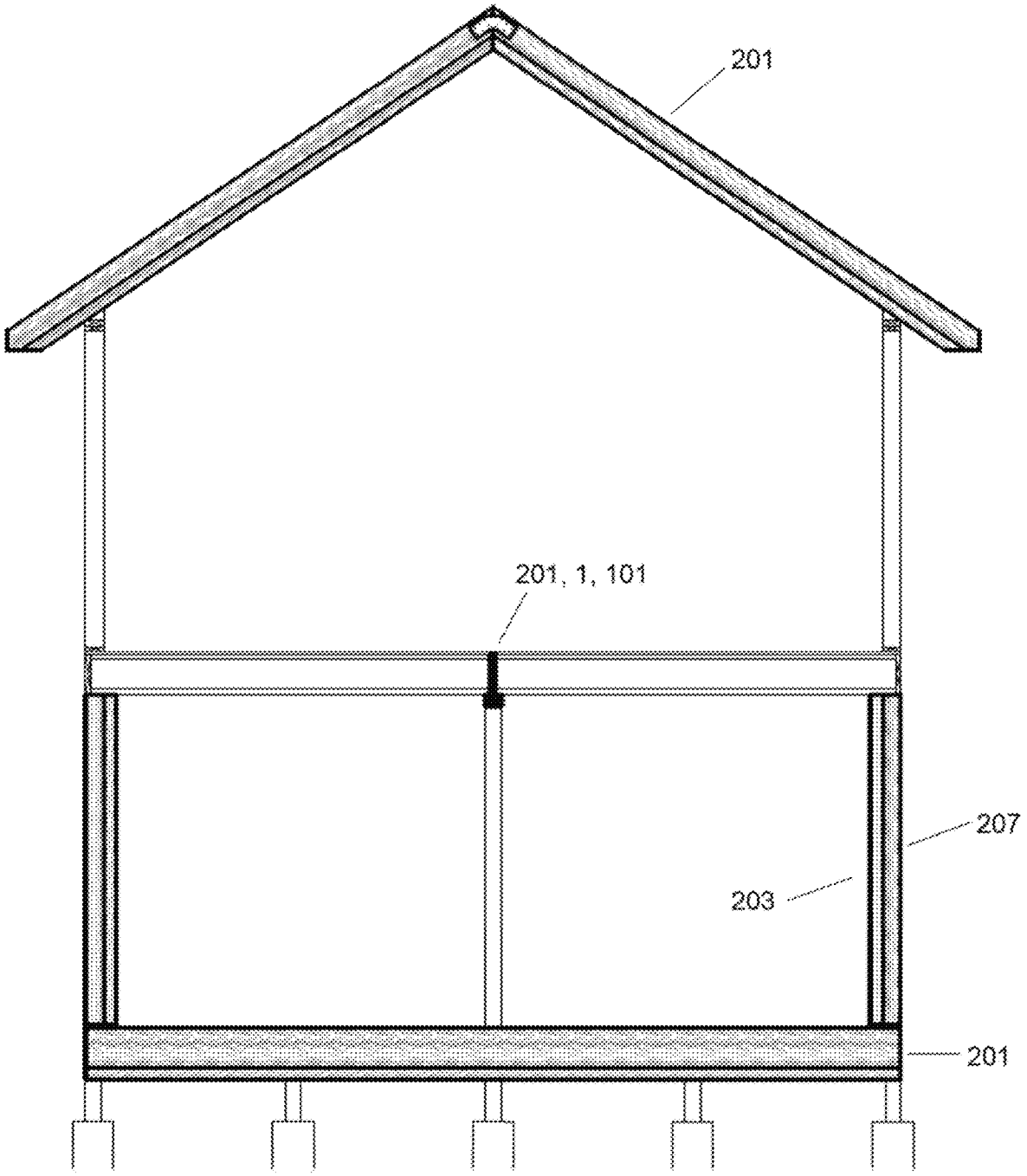
FIG. 56 is another front elevation view of FIG. 53, showing the T-rafter frame being used in different locations of the framing assembly including as wall splines and as floor joists.

In the embodiment shown in FIGS. 54-56, the T-rafter spline 201 can be used as a roof ridge beam with the pair of flanges 203 adapted as ledges that further support the bottom of one or more purlins 205. The flanges 203 of the T-rafter spline 201 stiffen and strengthen the ridge brace 204 in addition to providing a simplified and easier method of constructing the building. When a ridge beam is used during construction, the T-rafter spline 201 is supported by the ridge beam (not shown) at the apex of the building and by the top plate of the exterior wall at the eave of the building. As shown in FIG. 54, one or more purlins 205 are used to span the lateral spacing between two parallel T-rafter splines 201. The purlin 205 may be a 2×8 dimensional lumber board, the ridge brace 204 may be a 2×8 dimensional lumber board, and each of the supplemental rafters 206 may be a 2×4 dimensional lumber board, each of which is suitable for the environmental conditions of a roof. In this configuration, each end portion of the purlin 205 is supported by the corresponding flange 203 of the T-rafter spline 201, with the purlin 205 being secured to the T-rafter spline 201 with nails or screws through the web or support member 202 of the T-rafter spline 201. The T-rafter spline 201 to purlin 205 to T-rafter spline 201 combination provides continuous blocking for the T-rafter splines 201 thereby providing additional strength to offset any lateral loads encountered. Foam insulation may be placed between the purlins 205, then one or more secondary rafters 206 may be fastened perpendicular to the top of the purlins. This arrangement provides a void or plenum when decking is fastened to the rafters thereby creating a cold roof configuration and also for providing ventilation.

The T-rafter spline may also be used as an upper chord of a truss when a ridge beam is not desired. In this arrangement, the flanges are used as ledges adapted to support SIPs or purlins that are placed on top of the flanges. The T-rafter spline may also be used in a monoslope building (not shown). Purlins and secondary rafters would be arranged in the same configuration as when used in other rafter applications.

In the embodiment shown in FIG. 56, the T-rafter splines may also be used as a floor beam or a perimeter beam rather than as a ridge beam. Using the T-rafter spline 201 for a floor beam application is beneficial when the floor joists in the floor framework cannot span the entire width of the building. The floor joists rest on top of the pair of flanges 203 while the top of the web or support member 202 is flush with the top of the floor joists. By placing rim board on top of the exterior T-rafter spline flanges, the floor joints may be staggered with the T-rafter spline joints, then attached and secured with screws to form a strong, straight beam. Using the T-rafter spline in this manner eliminates the need for a stem wall foundation while still facilitating expansion of the building without extensive modification.

In the embodiment shown in FIG. 56, the T-rafter splines may further be rotated vertically for use as wall columns or wall splines 207. The flanges 203 of the T-rafter spline is left exposed to the interior of the building for the aesthetic appearance as a timber column. Using the T-rafter splines as wall splines provides additional support for the roof or an upper floor in a multi-story building. A platformed wall, cross laminated panels, or insulated panels can be placed between two adjacent T-rafter wall splines and affixed to the support member and the flanges to create an exterior wall.

Furthermore, in an embodiment depicted in FIGS. 53-56, the invention discloses a framing assembly for constructing the frame of a building structure, the framing assembly comprising a plurality of T-rafter splines, with each of the plurality of T-rafter splines comprising a support member and a pair of flanges, with the support member having a lower portion and an upper portion, with the each of the pair of flanges abutting and sandwiching the lower portion of the support member, with the pair of flanges each being affixed to the lower portion of the support member with an adhesive to form a lower portion of the T-rafter spline and with the upper portion of the support member to form an upper portion of the T-rafter spline, wherein a lower portion of each of the pair of flanges extends below the lower portion of the support member to define a longitudinal slot therethrough in the lower portion of the T-rafter spline.

In an embodiment depicted in FIGS. 53-56, the invention discloses a framing assembly for constructing the frame of a building structure, the framing assembly comprising at least one T-rafter spline comprising a support member and a pair of flanges, with the support member having a lower portion and an upper portion, with the each of the pair of flanges abutting and sandwiching the lower portion of the support member, with the pair of flanges each being affixed to the lower portion of the support member with an adhesive to form a lower portion of the T-rafter spline and with the upper portion of the support member to form an upper portion of the T-rafter spline, wherein a lower portion of each of the pair of flanges extends below the lower portion of the support member to define a longitudinal slot therethrough in the lower portion of the T-rafter spline Those skilled in the art who have the benefit of this disclosure will appreciate that it may be used as the creative basis for designing devices or methods similar to those disclosed herein, or to design improvements to the invention disclosed herein; such new or improved creations should be recognized as dependent upon the invention disclosed herein to the extent of such reliance upon this disclosure.

I claim:

1. A framing assembly for constructing the frame of a building structure, the framing assembly comprising a plurality of T-rafter splines, with each of the plurality of T-rafter splines comprising a support member and a pair of flanges, with the support member having a lower portion and an upper portion, with the each of the pair of flanges abutting and sandwiching the lower portion of the support member, with the pair of flanges each being affixed to the lower portion of the support member with an adhesive to form a lower portion of the T-rafter spline and with the upper portion of the support member to form an upper portion of the T-rafter spline; wherein the upper portion of the T-rafter spline is upstanding and has a height greater than a height of the lower portion of the T-rafter spline having the pair of flanges affixed to the lower portion of the support member; wherein an upper portion of each of the pair of flanges is a straight-edge ledge that provides lateral support upon which selectively at least one purlin, at least one floor joist, at least one roof panel, or at least one structural insulated panel configured as a wall panel selectively abuts; and wherein each of the plurality of T-rafter splines being adapted for use as a wall column, a perimeter beam, a floor beam, or a rafter beam to replace the need for a standard foundation.

2. The framing assembly of claim 1, wherein the plurality of T-rafter splines being adapted for use when using dimensional lumber rather than using one or more of the at least one structural insulated panels with continuous blocking to offset lateral loads wherein the at least one purlin is positioned between two of the plurality of T-rafter splines by resting a bottom of the at least one purlin on top of the ledge of the corresponding pair of flanges of each of the two T-rafter splines and securing the at least one purlin to the support member of the two T-rafter splines with fasteners, and wherein an end of each of the two T-rafter splines sandwiches and abuts a ridge beam at an apex of the building and a top plate of an exterior wall at an eave of the building, and are secured to the ridge beam with fasteners.

3. The framing assembly of claim 2, the framing assembly further comprising a plurality of the at least one purlins and a plurality of secondary rafters, with foam insulation being placed between the plurality of purlins, and with each of the plurality of secondary rafters being arranged perpendicular to each of the plurality of purlins and fastened to a top of the plurality of purlins to provide a plenum for fastening decking to the plurality of secondary rafters for ventilation of the building structure.

4. The framing assembly of claim 1, wherein the plurality of T-rafter splines being adapted for use as an upper chord of a truss when a ridge beam is not used, with the framing assembly further comprising one or more of the at least one structural insulated panels or one or more of the at least one purlins each of which is positioned and secured on top of the pair of flanges of the plurality of T-rafter splines.

5. The framing assembly of claim 1, wherein each of the pair of flanges is made from dimensional lumber boards.

6. The framing assembly of claim 1, wherein the support member is made from structural composite lumber.

7. The framing assembly of claim 1, wherein the plurality of T-rafter splines being adapted for use as floor beams when at least one floor joist cannot span the entire width of the building, wherein a plurality of the at least one floor joists is positioned on top of the pair of flanges of each of the plurality of T-rafter splines, with the upper portion of the support member of each of the plurality of T-rafter splines being flush with a top of each of the plurality of floor joists.

8. The framing assembly of claim 1, each of the plurality of T-rafter splines being adapted for use as vertical wall splines with at least one of the pair of flanges being exposed to an interior of the building structure as a timber column and as additional support for the roof or an upper floor of the building.

9. The framing assembly of claim 8, the framing assembly further comprising a plurality of wall members selected from the group consisting of platform framed walls, cross laminated panels, or insulated panels, each of which is placed between two adjacent T-rafter splines and affixed to a rear of the pair of flanges to form an exterior wall.

10. The framing assembly of claim 8, the framing assembly further comprising a plurality of rim board, with the plurality of rim board being placed at a rear of the flanges, with joists being staggered and secured with fasteners to form a strong, straight beam to eliminate the need for a stem wall foundation.

11. A framing assembly for constructing the frame of a building structure, the framing assembly comprising at least one T-rafter spline comprising a support member and a pair of flanges, with the support member having a lower portion and an upper portion, with the each of the pair of flanges abutting and sandwiching the lower portion of the support member, with the pair of flanges each being affixed to the lower portion of the support member with an adhesive to form a lower portion of the T-rafter spline and with the upper portion of the support member to form an upper portion of the T-rafter spline; wherein the upper portion of the T-rafter spline is upstanding and has a height greater than a height of each of the pair of flanges; wherein an upper portion of each of the pair of flanges is a straight-edge ledge that provides lateral support upon which at least one purlin, at least one floor joist, at least one roof panel, or at least one structural insulated panel configured as a wall panel selectively abuts; and wherein the T-rafter spline being selectively adapted for use as a wall column, a perimeter beam, a floor beam, or a rafter beam to replace the need for a standard foundation.

12. The framing assembly of claim 11, wherein the at least one T-rafter spline being adapted for use when using dimensional lumber rather than using one or more of the at least one structural insulated panels with continuous blocking to offset lateral loads wherein at least one purlin is positioned between two of the at least one T-rafter splines by resting a bottom of the at least one purlin on top of the corresponding pair of flanges of each of the two T-rafter splines and securing the at least one purlin to the support member of the two T-rafter splines with fasteners, and wherein an end of each of the two T-rafter splines sandwiches and abuts a ridge beam at an apex of the building and a top plate of an exterior wall at an eave of the building, and are secured to the ridge beam with fasteners.

13. The framing assembly of claim 11, the framing assembly further comprising a plurality of the at least one purlins and a plurality of secondary rafters, with foam insulation being placed between the plurality of purlins, with each of the plurality of secondary rafters being arranged perpendicular to each of the plurality of purlins and fastened to a top of the plurality of purlins to provide a plenum for fastening decking to the plurality of secondary rafters for ventilation of the building structure, and with at least one of the plurality of purlins being positioned between two of the at least one T-rafter splines by resting a bottom of the at least one of the plurality of purlins on top of the corresponding pair of flanges of each of the two T-rafter splines and securing the at least one of the plurality of purlins to the support member of the two T-rafter splines with fasteners.

14. The framing assembly of claim 13, wherein an end of each of the two T-rafter splines sandwiches and abuts a ridge beam at an apex of the building and a top plate of an exterior wall at an eave of the building and are secured to the ridge beam with fasteners.

15. The framing assembly of claim 11, wherein the at least one T-rafter spline being adapted for use as an upper chord of a truss when a ridge beam is not used, with the framing assembly further comprising one or more of the at least one structural insulated panels or one or more purlins each of which is positioned and secured on top of the pair of flanges of the at least one T-rafter spline.

16. The framing assembly of claim 11, wherein each of the pair of flanges is made from dimensional lumber boards and the support member is made from structural composite lumber.

17. The framing assembly of claim 11, wherein the at least one T-rafter spline being adapted for use as floor beams when floor joists cannot span the entire width of the building, wherein a plurality of the floor joists is positioned on top of the pair of flanges of each of the at least one T-rafter spline, with the upper portion of the support member of each of the at least one T-rafter spline being flush with a top of each of the plurality of floor joists.

18. The framing assembly of claim 11, wherein the at least one T-rafter spline being adapted for use as vertical wall splines or wall columns with at least one of the pair of flanges being exposed to an interior of the building structure as a timber column and as additional support for the roof or an upper floor of the building.

19. The framing assembly of claim 18, the framing assembly further comprising a plurality of wall members selected from the group consisting of platform framed walls, cross laminated panels, or insulated panels, each of which is placed between two adjacent T-rafter splines and affixed to a rear of the pair of flanges to form an exterior wall.

20. The framing assembly of claim 18, the framing assembly further comprising a plurality of rim board, with the plurality of rim board being placed at a rear of the flanges, with joists being staggered and secured with fasteners to form a strong, straight beam to eliminate the need for a stem wall foundation.

* * * * *